US009292994B2

(12) United States Patent
Rose, Jr. et al.

(10) Patent No.: US 9,292,994 B2
(45) Date of Patent: Mar. 22, 2016

(54) DUAL ELEVATOR LARGE BOTTLE VENDING APPARATUS AND METHOD

(71) Applicant: BlueRock Ventures, LLC, Norwell, MA (US)

(72) Inventors: R. Edward Rose, Jr., Hingham, MA (US); R. Edward Rose, III, Cohasset, MA (US); Michael J. Verrochi, Norwell, MA (US); Stephen H. Hancock, Wake Forest, NC (US)

(73) Assignee: Bluerock Ventures, LLC, Norwell, MA (US)

( * ) Notice: Subject to any disclaimer, the term of this patent is extended or adjusted under 35 U.S.C. 154(b) by 57 days.

(21) Appl. No.: 14/131,684

(22) PCT Filed: Nov. 16, 2012

(86) PCT No.: PCT/US2012/065503

§ 371 (c)(1),
(2) Date: Jan. 9, 2014

(87) PCT Pub. No.: WO2013/074915

PCT Pub. Date: May 23, 2013

(65) Prior Publication Data

US 2014/0312051 A1 Oct. 23, 2014

Related U.S. Application Data

(63) Continuation-in-part of application No. 13/651,353, filed on Oct. 12, 2012.

(51) Int. Cl.
*B65H 3/00* (2006.01)
*G07F 11/00* (2006.01)
(Continued)

(52) U.S. Cl.
CPC ..... *G07F 11/30* (2013.01); *G07F 7/0609* (2013.01); *G07F 11/28* (2013.01); *G07F 11/34* (2013.01)

(58) Field of Classification Search
CPC ..... B65G 1/06; B65G 1/08; B60P 3/055; G07F 7/0609; G07F 7/06; G07F 11/30; G07F 11/28; G07F 11/34
USPC ..... 221/102, 166, 74, 192, 78, 124; 312/72, 312/211; 211/74; 194/212
See application file for complete search history.

(56) References Cited

U.S. PATENT DOCUMENTS 1,004,998 A * 10/1911 Crecelius ..... B65G 59/067 193/27
1,530,288 A * 3/1925 Balkema ..... G07F 7/0609 194/296

(Continued)

FOREIGN PATENT DOCUMENTS

FR 2599723 A1 * 12/1987 ..... B60P 3/055
WO WO 2008045247 A2 * 4/2008 ..... B65B 5/106

*Primary Examiner* — Rakesh Kumar
(74) *Attorney, Agent, or Firm* — Lorusso & Associates

(57) ABSTRACT

A combination vending/return apparatus includes a series of stacked counter-sloped, gravity fed track assemblies with radiused transition segments to receive and store empty large-volume bottles and to deliver pre-filled large-volume fluid-containing bottles. The apparatus is configured to accommodate, among other sizes, at least one of three (3) gallon, (4) four gallon, or (5) five gallon size bottles. A. dual elevator subassembly permits filled bottle dispensing and empty bottle receiving from a single door. The apparatus includes a processor-controlled transaction panel to make bottle selections for purchases and returns, and to handle electronic payment, promotional and credit transactions. Also disclosed is a method to vend large-volume fluid-containing bottles and retrieve used and emptied large-volume water bottles.

39 Claims, 68 Drawing Sheets

(51) Int. Cl.

| | |
|---|---|
| ***G07F 11/30*** | (2006.01) |
| ***G07F 7/06*** | (2006.01) |
| ***G07F 11/34*** | (2006.01) |
| ***G07F 11/28*** | (2006.01) |

(56) References Cited

U.S. PATENT DOCUMENTS 3,141,571 A * 7/1964 Moore ..... G07F 11/34 221/195
4,778,042 A * 10/1988 Warren ..... G07F 11/58 194/212
5,009,329 A * 4/1991 Farrentine ..... G07F 11/34 221/175
5,447,407 A * 9/1995 Weaver ..... B65G 1/127 193/27
5,462,198 A * 10/1995 Schwimmer ..... A47F 1/087 221/130
8,827,068 B2 * 9/2014 Weiss ..... A21B 1/48 198/456
2014/0103062 A1 * 4/2014 Rose, Jr. ..... G07F 7/0609 221/124

* cited by examiner

DUAL ELEVATOR LARGE BOTTLE VENDING APPARATUS AND METHOD

CROSS-REFERENCE TO RELATED APPLICATIONS

This application claims priority to U.S. Provisional Application Ser. No. 61/654,585, filed Jun. 1, 2012; 61/568,661, filed Dec. 9, 2011; 61/560,835, filed Nov. 17, 2011; 61/546,091, filed Oct. 12, 2011 and U.S. Regular Utility application Ser. No. 13/407,452, filed Feb. 28, 2012, the contents all of which are incorporated in their entirety herein by reference.

FIELD OF THE DISCLOSURE

The disclosure relates generally to a vending apparatus for vending consumable goods and for receiving emptied reusable containers for the consumable goods. More specifically, the disclosure relates to an apparatus for vending large volume water bottles and receiving emptied re-sanitizable and reusable bottles.

BACKGROUND OF THE DISCLOSURE

Potable, portable water has become an increasingly sought-after and common-place commodity by modern day consumers. Whether natural spring water, or purified and/or re-mineralized drinking water, to address varying consumer demands for convenience and availability, water vendors have developed a number of bottle sizes and approaches to dispense and to deliver water. One such approach described more fully below uses established food stores. e.g., supermarkets, wholesale and convenience stores, as well as other types of retail establishments, within which bottled water in varying sizes is normally offered on store shelves. A second approach is to offer larger 3, 4 and 5 gallon bottles, often stacked independently of the market's shelves due to their considerable weight, and later to normally be used with water coolers for dispensing.

For companies involved in the home and office water delivery business, competition with respect to price, service, contract terms, availability of product, consistency of product, permitting in and out of state, delivery expenses including the acquisition of, or lease of, government approved trucks, fuel costs, tolls, taxes, maintenance and repair, labor and labor related benefits all add considerably to the cost of the delivered water. Additional costs such as a sales force, bookkeeping department, plant inventory, delivered inventory, truck-loaded inventory and FIFO handling of product inventory, further add to the cost. Regional weather and security-related issues can affect deliveries to homes, offices and apartment buildings.

An additional problem is the use of rented water coolers. Companies providing on-site delivery services that rent coolers to their customers have to deal with repair and maintenance, cleaning, billing and collection of rental fees and access to gated communities and high-rise apartments.

A yet further set of issues with respect to the home/office delivery business concerns state permitting practices and procedures. States vary considerably in their permitting requirements such that one company may decide against doing business in certain states to avoid disparate permitting requirements.

Distribution of particular brands of water for home/office delivery may be further restricted by geographical considerations, such as distance from a bottling facility. Many homes and businesses may be outside the feasible mileage radius of the bottling plant to warrant delivery at a competitive or acceptable price. The end result is the delivery of bottles and coolers along with all the related costs creates a fractionalized cost model that requires high volume to achieve low margins.

Similar problems surface with the distribution of 3 and 5 gallon bottles through supermarket and wholesale club stores. "Centralizing" distribution does centralize costs and simplify bottle delivery and empty bottle pickup. It also reduces or eliminates many of the other problems associated with home/office delivery. Problems such as billing and collection, however, still remain, even though on a centralized, consolidated manner wherein the bottler invoices the supermarket and wholesale stores rather than invoice individual home and/or office customers. One solution to the invoicing issue is to rely on the retailer to electronically transfer funds directly and automatically. This has become increasingly popular with the advent of e-commerce.

In this particular model of distribution, the customers serve themselves and prepay for the bottled water products, and often prepay for the bottles as well, at a central location instead of being invoiced separately at dispersed locations for the delivered bottle water purchase and/or cooler rental. One of the drawbacks of this model is retailer control over hours of operation and location that limits customer access to water bottles.

As an added difficulty/inconvenience, the customer must carry/handle the product to a certain extent in order to get the 3, 4 or 5 gallon bottle to their vehicle from inside the store. Such purchases are often performed simultaneously with shopping for other items inside the store, (depending upon whether it's a grocer or retailer—this can be a significant limitation), that only adds to the inconvenience. And often times, this will result in a separate trip back and forth to the vehicle and back and forth to customer service to return empties, and in some cases, to receive a voucher, to stand in line in order to present to a cashier as a credit against the purchase of a new bottled water product and then again out to the vehicle (or continue to shop inside the store before travelling back to the vehicle). This can have the unfortunate effect of limiting sales brought about by the inconvenience inherent when large water bottles are purchased.

This model of distribution thus has significant temporal and convenience limitations as it relies entirely on the individual store hours and on the location(s) of the stores. A further inconvenience and limitation is based upon the location(s) inside stores where bottles are returned and where bottles are purchased and retrieved. Added to this is the common practice of using vouchers to confirm bottle returns for a return-bottle credit, which, if lost, or the receipt printer is out of order, cannot be used to obtain a credit against a subsequent purchase of a filled bottle.

A substantial reason why water bottles are sold in stores is due to the effect of climate and weather on water. If left exposed to the elements—even in sealed containers—water can freeze and/or overheat. In the alternative, even if the bottled water were to be stacked outside the store on the sidewalk (so to speak) for purchase, it would still have to be brought back into the store at closing to reduce the risk of theft and to prevent freezing in colder climates. By way of example, there can be as many as 75-100 bottles stacked on the shelves of wholesale clubs. If not left inside the store, but displayed for sale outside, the bottles would need to be taken in each and every night absent some form of security measure such as a security fence with a locked door/gate. It should come as no surprise that water bottles sold by wholesale clubs are more likely to sell than bottles from store racks/shelves inside the club facilities.

Not only does this model create extra effort and handling for the customer, just as importantly, it places a constant burden on the retailer as it can involve the ongoing and tedious tasks of price-labeling, of handling the piles of empties and of planning the use of valuable floor/shelf space in designated "water aisles" such as those found in a supermarket or a Wal-Mart store. The same burden is experienced when the bottles are placed on separate shelving or pallets in retail stores such as Home Depot, or Lowe's, or in food clubs such as B.J.'s Wholesale Club. Sam's Club, Costco, etc. These problems are exacerbated by the fact that these self-serve products weigh about 44.5 lbs. per five gallon bottle and about 25.5 lbs. per 3 gallon bottle. This creates significant handling logistics for both the consumer and the store. For example, a 3 gallon bottle typically takes up an 8"D-10-½"D×13"H space and an 11"D×20"H space for a 5 gallon bottle. Sales of, and even profits derived from, this product can sometimes be negated by the extra handling and "shelf-space" required, and the available interior floor space and location available.

Several other problems involving this distribution model are not readily apparent. For example, in the case of a grocery store, the customer must carry the 45 lb., 32 lb., or 25 lb. bottles around the store in a grocery cart, wait in line for a check-out clerk and then bring the bottle out to his or her vehicle, sometimes in inclement weather conditions and across a parking lot, to their parking space location that could be several hundred feet or yards away.

This scenario is equally relevant to wholesale and retail store locations and may be worse because the customer must park their car; bring any empties to the "customer service area" to redeem their deposit(s) and get a receipt; go to the cashier (wait in another line); pay for a new bottle(s) of water; go to the location where the 3's and 5's are kept; pick up the purchased bottles; place them in a basket carrier and then wheel them out to their vehicle, much the same as in the supermarket model. This is not the most customer friendly or convenient delivery model and again can stifle sales because many, if not most, shoppers at supermarkets are consumers doing their weekly shopping. In this scenario, buying drinking water in large quantities is not necessarily a "destination," or "convenient purchase."

In an improved form of distribution, 3, 4 and 5 gallon bottled water can be distributed during and outside normal business hours in a vending machine model designed to handle either the 3, 4 or 5 gallon sizes of bottled water and their similarly sized empty returns. This is accomplished by using a single apparatus, located outside a retailer's store on a sidewalk, "end-cap", or some other similar, customer-friendly location where customers can drive up, buy and return their bottles (24/7) and leave. Alternatively, the customers can shop first if they choose, and then purchase their water on the way out of the store or simply come to the store location on their own schedule without having to interact with store personnel or be concerned with store hours.

In this novel distribution system, customers aren't reliant on retailers' hours of operation; both the bottle return and the purchase of the product are in the same apparatus; and retailers can offer guaranteed FDA and Board of Health approved products "packaged" and not delivered "bulk." With use of Applicants' novel apparatus, customers don't have to bring their own "clean and sanitary" containers. The apparatus provides a cashless transaction that should reduce, if not eliminate theft because the apparatus is maintained in a closed condition 24/7 except during lawful purchase events. The apparatus further provides a convenient method of payment for the consumer because one of three or four methods of payment may be offered. If cash is preferable, the system can accept a prepaid water card, which can be purchased from the retailer associated with the apparatus. This method of payment is also compatible with retailers' cross-promotion activities such as discount programs where the customer can receive discounts off their purchase with the use of apparatus-recognized, retailer-approved coupons and/or retailer "advantage" cards, or even the use of RFID payment methods, or 2-D barcode for downloading coupons using new smartphone technologies.

The vending apparatus is configured to include lighting adequate to impart improved nighttime safety and appearance as well as improved customer-friendly operating features. As an example, the entire front of the machine and interior portion of the bottle well are illuminated with LED, energy saving lights. With applicants' novel apparatus, inventory re-supply can be maintained on an "on demand" basis as the apparatus includes wireless communication with the bottler and/or dispatch control center to report when the vending apparatus is low on inventory, or needs service. The apparatus software is further configured to allow manual input of inventory when loading the full bottles thereby creating an "Input" and "Output Sales" Inventory control. A "return bottle" well/window can, if need be, incorporate a vendor controlled reader for RFID or bar codes secured to the bottles and incorporating a Unique Identification Number (UID) acceptable only to that bottler's product bottles for the amount paid when first purchased. The machine and its individual major parts will be "serialized" using unique identification technology as disclosed in U.S. Pat. Nos. RE 40,659 and RE 40,692

With the use of Applicants' novel apparatus, many unnecessary and unwanted business expenses and inconveniences are now eliminated as further explained in this disclosure. The apparatus may also include clear, multilingual signage and voice instructions to assist customers with their purchases unlike some other models of distribution. The need for bookkeeping is essentially eliminated due to the apparatus' wireless, gateway and other automated features for all parties concerned. The size and shape of the vendor machine is expandable or contractible with modular features that allow for customization based upon the location, and re-fill delivery costs.

There should be no building permits or other special permits/license fees required unlike some other types of vending and distribution apparatuses as Applicants' vending apparatus should meet all NAMA, ADA and U/L requirements. Although there are hundreds of various models and types of vending machines, almost all of those machines and kiosks sell "packaged/bottled" water or soft drinks and are "small pack" sizes, less than 3 gallon, and do not address the problems associated with selling larger 3 and 5 gallon size bottles.

Many currently available water vending machines are "unpackaged" bulk water vending machines that require the customer to bring their own "clean, sanitary containers". These type machines are heavily regulated on an individual location basis and require, in many cases, both local and state permits and licenses from boards of health, plumbing, building and wiring inspectors as well as local water quality agencies such as the California Department of Health; the Rhode Island Board of Health; the Massachusetts Department of Environmental Protection (DEP); the New York Department of Health; the Massachusetts Board of Health; the Licensing Board of Certified Operators. These requirements can vary greatly from state to state. The disclosed vending apparatus eliminates these requirements because all necessary permitting issues are already addressed before the product is loaded into a truck to deliver to the vending apparatuses at their retail location(s).

With respect to return bottles, in two currently used self-service vending systems, the "Return Bottle" area is located generally in a customer service area located as one enters the retail store where the "return" is either put in a designated "Return Bottle Area" (loose and unconstrained) or in a "Return Bottle" enclosed compartment that accepts all bottles from all vendors and prints a "refund" slip to be cashed in when purchasing a new filled bottle at a location elsewhere in the store. It falls to the customer to push a grocery cart with their bottled water—bottles which can weigh as much as 45 lbs. per 5 gallon bottle and more, depending on the number of bottles purchased and the style of bottle used—out to their vehicle located some distance from the store exit. The disclosed vending apparatus eliminates these inconveniences and problems almost entirely.

What is needed is an apparatus that accommodates large 3, 4 and/or 5 gallon bottles and allows for the return of emptied bottles and the purchase of filled bottles from the same apparatus. What is also needed is an apparatus that can execute a cashless retail sales transaction without the need for the presence of a merchant during normal business hours. These and other objects of the disclosure will become apparent from a reading of the following summary and detailed description of the disclosure as well as a review of the appended drawings.

SUMMARY OF THE DISCLOSURE

Unless specified, as used herein, large-volume water bottles shall mean reusable bottles holding one or more gallons of fluid. Also as used herein, "water bottle" defines bottles containing water, or fluids other than water. In one aspect of the disclosure, a combination vending/return apparatus includes track assemblies with preset slopes configured to receive filled water bottles for vending and empty water bottle returns. The track assemblies are positioned adjacent to an elevator shaft that includes an elevator apparatus to move empty bottles to, and filled bottles from, the track assemblies.

A vending door with a central processor controlled lock system is positioned in a front wall of the vending apparatus at a height sufficient to meet the requirements of the Americans with Disabilities Act. A shelf can be further included in proximity to the door to enhance the convenience of purchasing multiple bottles. A credit/debit/prepaid card acceptor connected either by Ethernet, landline or wireless connection using a credible wireless provider, e.g., Verizon® or AT&T®, provides a means for customers to make purchases and receive credits for returned bottles via an atypical credit card gateway, e.g., USA Technologies, etc. A completed electronic purchase transaction unlocks the vending door to permit the return of empty bottles and the retrieval of filled bottles. The system includes access to 24/7 service to accommodate any issues resulting from the purchase/return event.

In one aspect of the disclosure, the apparatus can include a double bottle retention gate subassembly comprising two retention gates. A first retention gate retains a lead-most filled bottle on a bottom track assembly. A second retention gate retains the remainder of the filled bottles on the combined track assemblies. The first retention gate is released to permit lead-most bottle migration onto an adjacent elevator. Once the first retention gate is returned to a bottle retention position, the second retention gate is opened to allow the previously second lead-most bottle to roll into the lead-most position behind the first retention gate. The spatial separation of the gates allows only one bottle to move to the lead-most position between the gates. The remaining bottles roll forward approximately one bottle width and remain registered against one another. Once the new lead-most bottle is registered against the first retention gate, and the remaining bottles are registered against one another including the new lead-most bottle, the second retention gate is lowered into the bottle retention position to arrest forward movement of the now second lead-most bottle.

In another aspect of the disclosure, a vending/return apparatus with a double elevator system allows the return of empty bottles and the purchase of filled bottles from the same vending machine access door. In a pre-transaction stage, the double elevator is positioned to align an upper return elevator with the access door. A lower vend elevator is positioned to permit a filled bottle to roll onto the elevator from a lowermost track assembly. A filled bottle may be resident on the lower vend elevator prior to the initiation of a vend/return transaction. During a vend/return transaction, a customer can initiate a transaction by making the appropriate selections on a human-interface control panel. If a return is being made, the customer will be able to open the access door and place an empty bottle on the return elevator. After bottle verification of the 3, 4 and/or 5 gallon bottles, depending on the type of bottles being vended, the double elevator is raised to position the vend elevator in alignment with the access door and the return elevator in a position to transfer the resident empty bottle to one of the track assemblies.

In a further aspect of the disclosure, the double elevator configuration may be configured to have multiple stops. In one embodiment, the return elevator is not positioned to permit transfer of a resident empty bottle when the lower vend elevator is positioned in alignment with the apparatus door. Once a purchased bottle is retrieved, the elevator is raised to align the upper return elevator with a top track assembly. As the elevator approaches the top track assembly, an extended, spring-supported segment of an articulated elevator bottle cradle assembly engages a leading edge of the top track assembly to arrest motion of the segment while the remainder of the cradle continues upwardly. This causes a side edge of the segment to cease elevating while the remainder of the segment and the elevator proceed in an upwardly direction. This causes the support springs to compress and the segment to rotate downwardly from its hinge anchor to form a ramp sloping downwardly toward the top track assembly. The resident empty bottle rolls off the elevator and onto the track assembly via gravity assist. Air operated, hydraulic and/or electric actuators are provided to move the double elevator among the various functional positions. As the elevator moves downward to its next position, the spring loaded segment returns to its original orientation ready to accept the next empty bottle.

In a still further aspect of the disclosure, the vending door may be configured as a hinged door with a processor-controlled door lock, or as a sliding door opened and closed with a processor-controlled linear actuator, belt driven activator and the like. The sliding door is secured in a door slot formed in a door frame and in an apparatus wall. The door configuration permits movement of the door to be controlled by the central processor to eliminate any manual customer control over the door function. These and other aspects and objects of the disclosure will become apparent from a review of the appended drawings and the detailed description below.

BRIEF DESCRIPTION OF THE DRAWINGS

FIG. 68 B shows an additional series of vending apparatus screen displays according to the embodiment of the disclosure shown in FIG. 68A.

FIG. 68 C shows an additional series of vending apparatus screen displays according to the embodiment of the disclosure shown in FIG. 68A.

FIG. 69 B is a continuation of the flow chart shown in FIG. 69 A.

FIG. 69 C is a continuation of the flow chart shown in FIG. 69 B.

FIG. 69 D is a continuation of the flow chart shown in FIG. 69 C.

DETAILED DESCRIPTION OF THE DISCLOSURE

Figure 1:
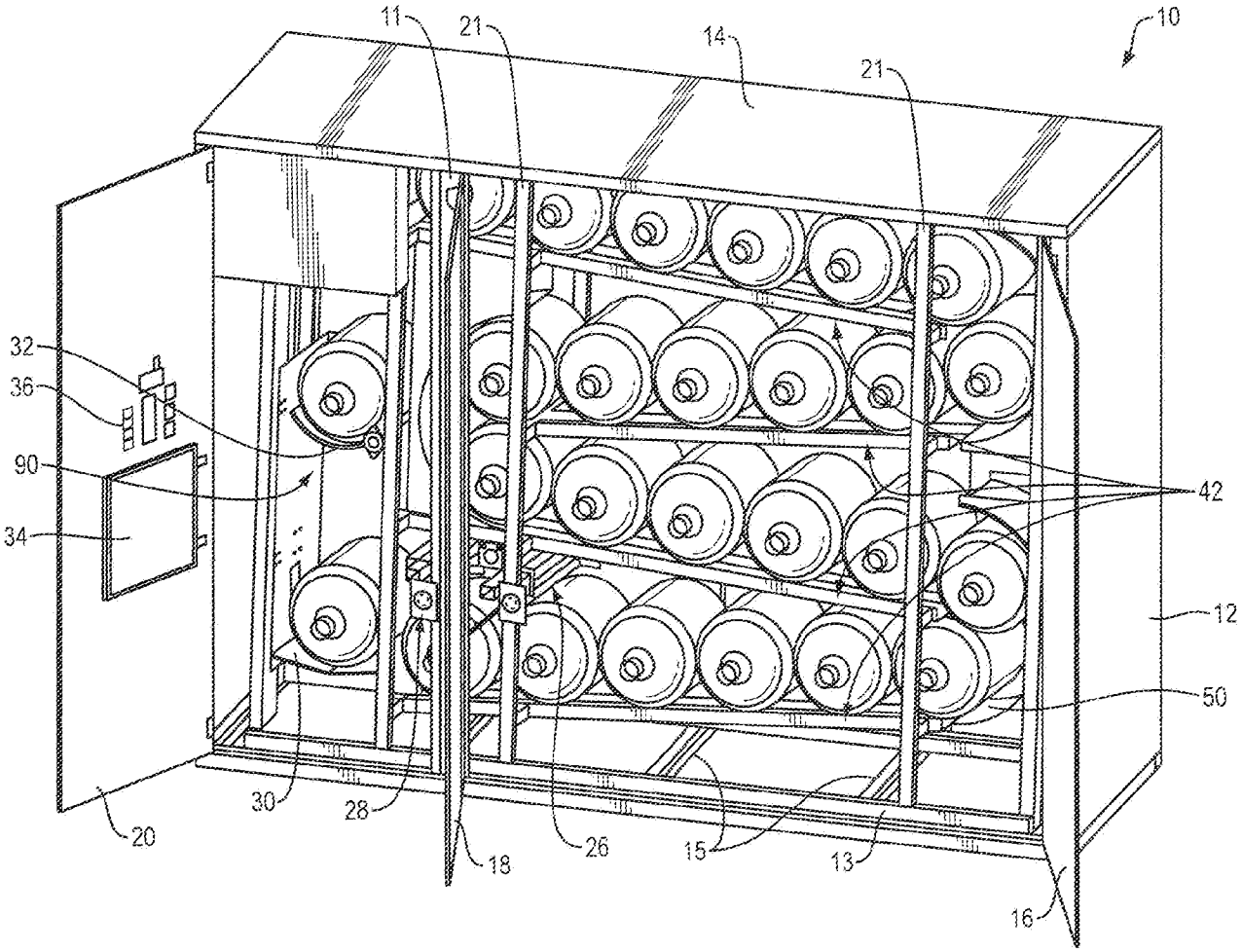
FIG. 1 is a front perspective view of dual elevator vending/return apparatus according to one embodiment of the disclosure.
Figure 2:
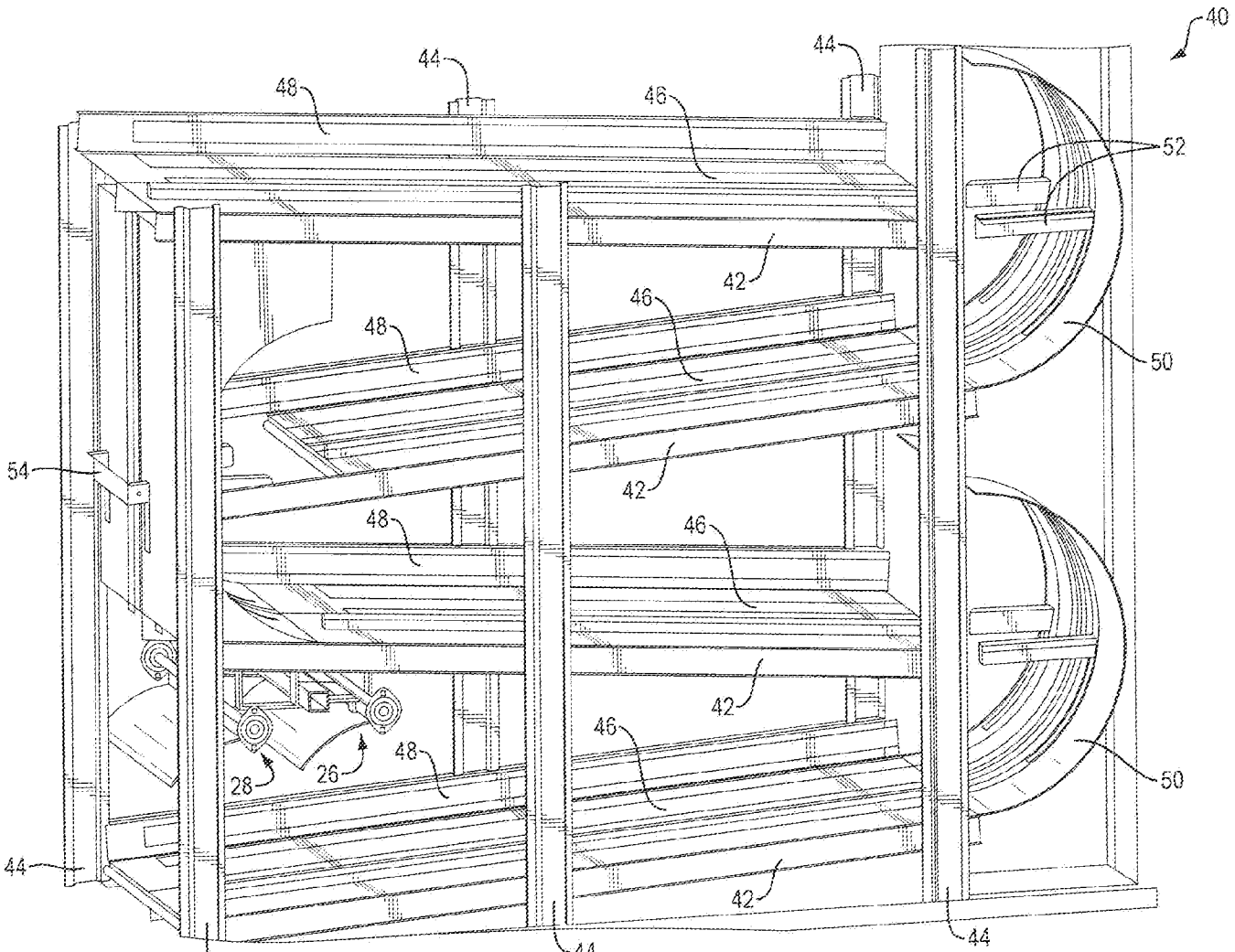
FIG. 2 is a front perspective view of an apparatus track subassembly and double gate according to the embodiment of the disclosure shown in FIG. 1.
Figure 3:
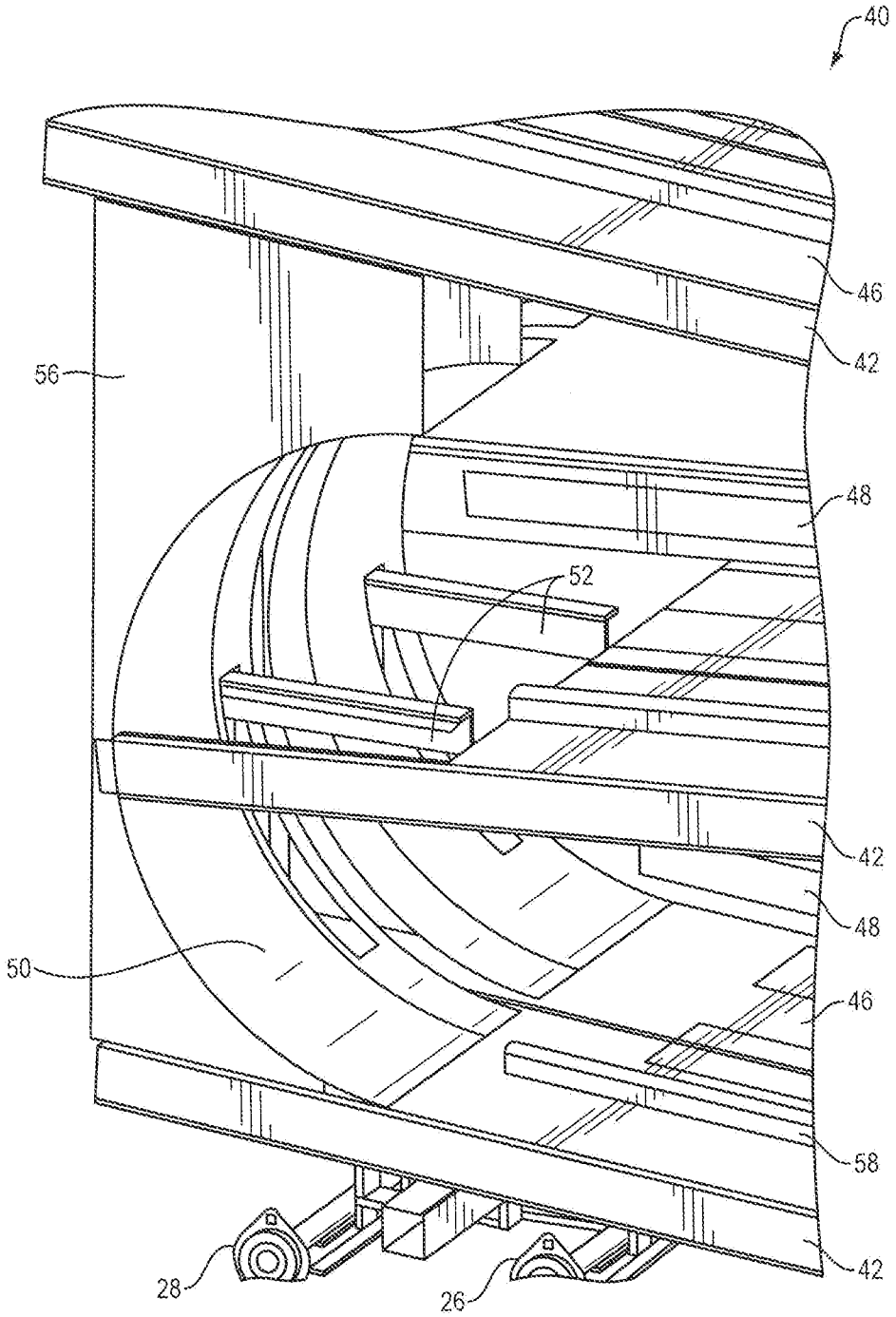
FIG. 3 is a partial front perspective view of a bottle inertia restrictor assembly in an extended position and a double gate according to the embodiment of the disclosure shown in FIG. 1.
Figure 4:
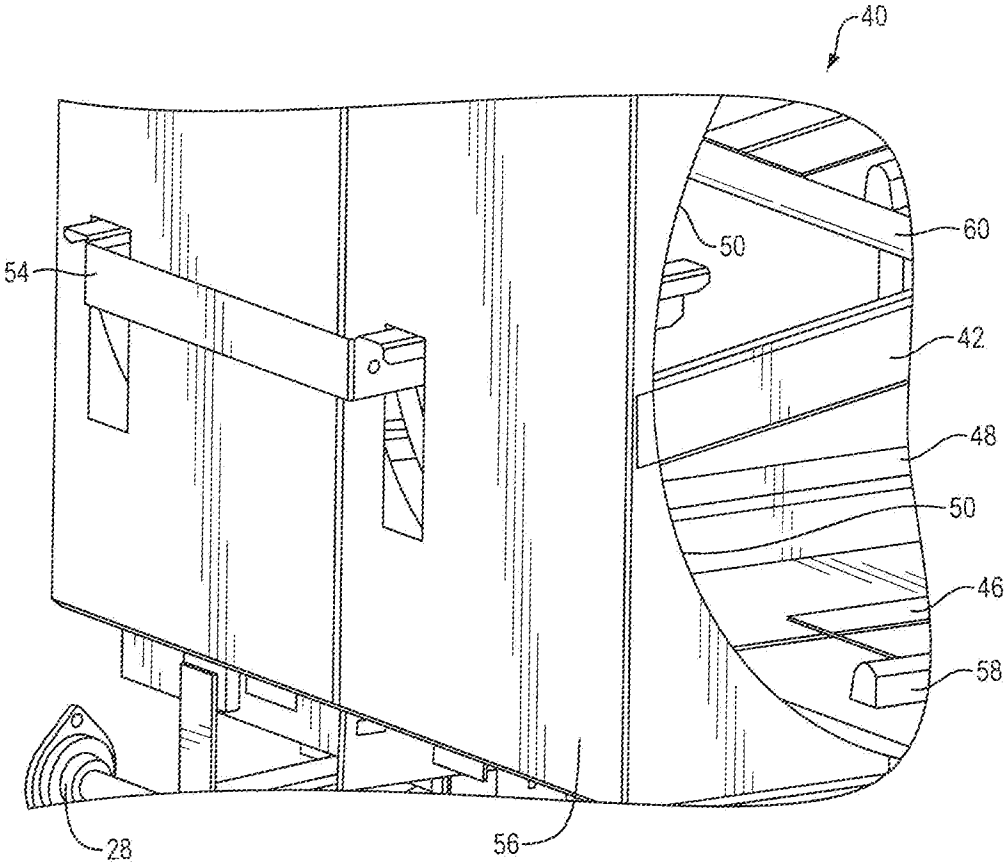
FIG. 4 is a side perspective view of the empty bottle inertia restrictor assembly shown in FIG. 3 in an extended position.
Figure 5:
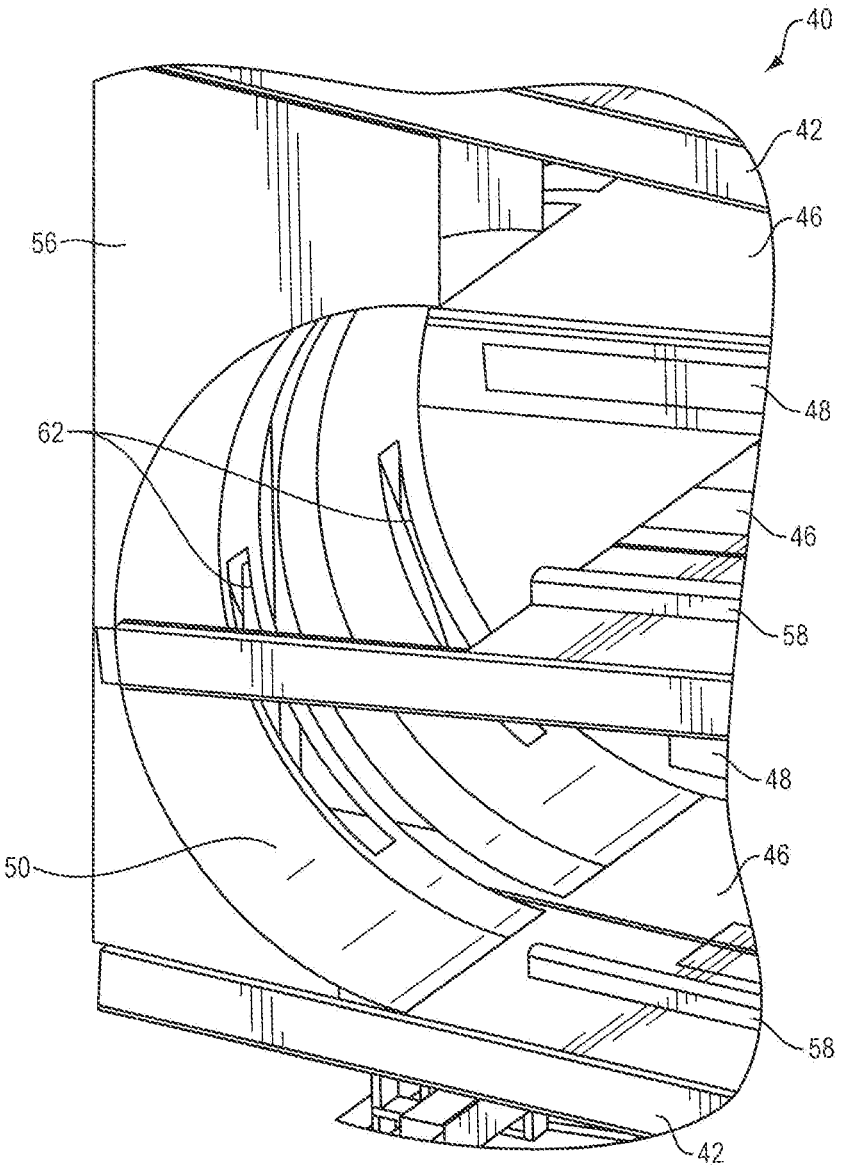
FIG. 5 is a front perspective view of the empty bottle inertia restrictor shown in FIG. 3 in a retracted position.
Figure 6:
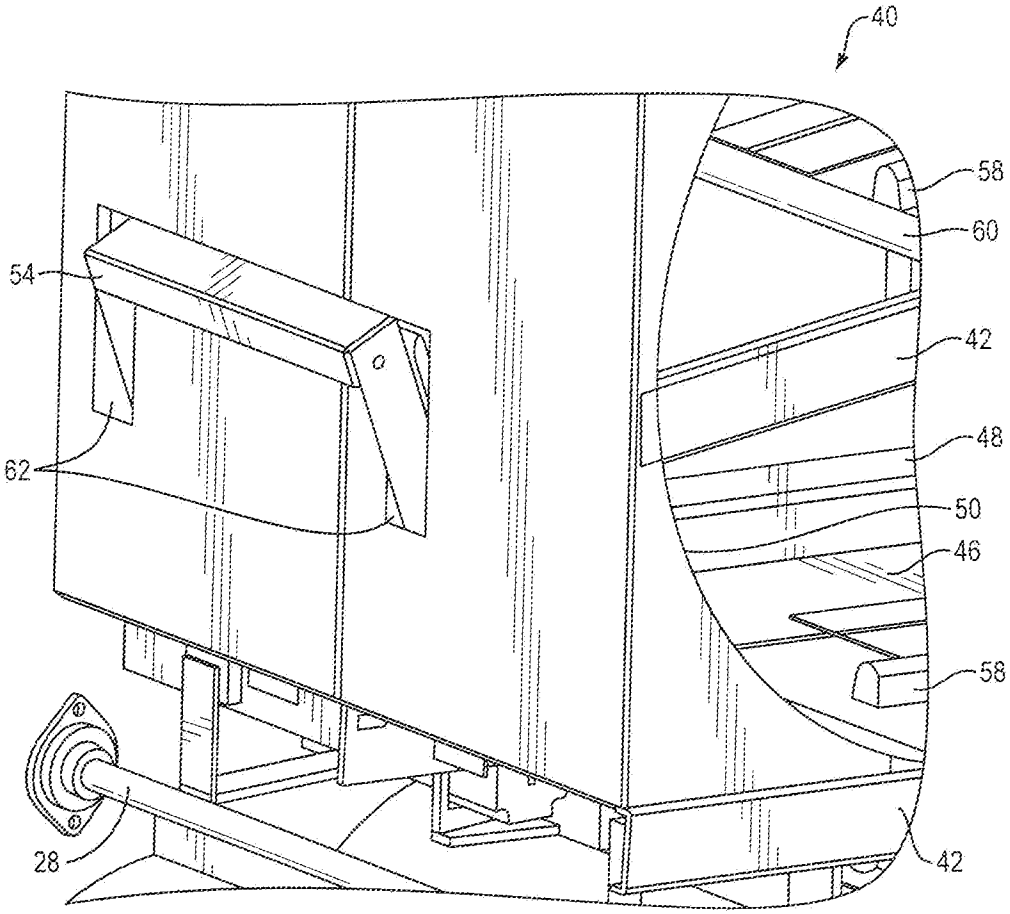
FIG. 6 is a side perspective view of the empty bottle inertial restrictor shown in FIG. 3 in a retracted position.
Figure 7:
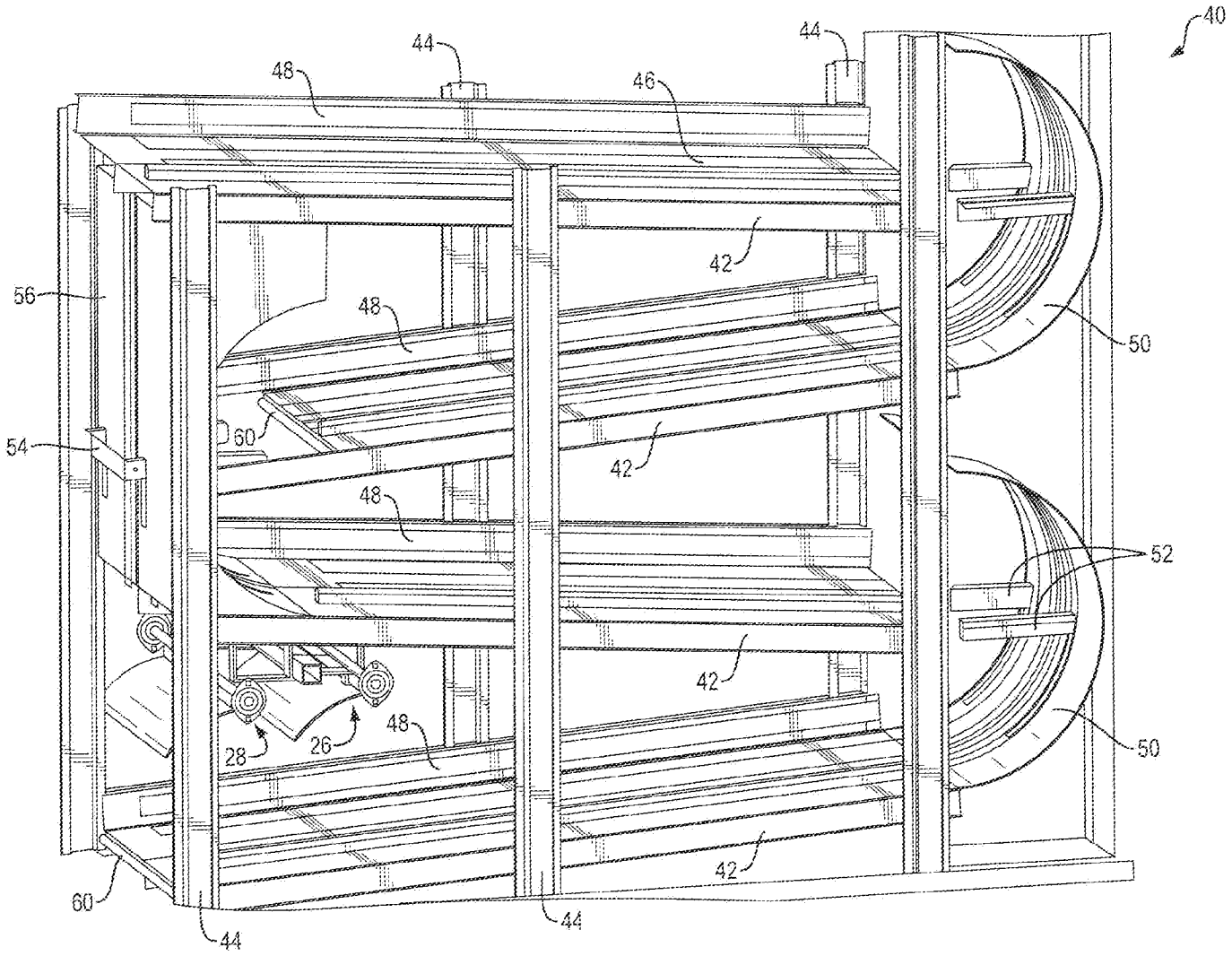
FIG. 7 is a front perspective view of an apparatus track subassembly and double gate according to the embodiment of the disclosure shown in FIG. 1.
Figure 8:
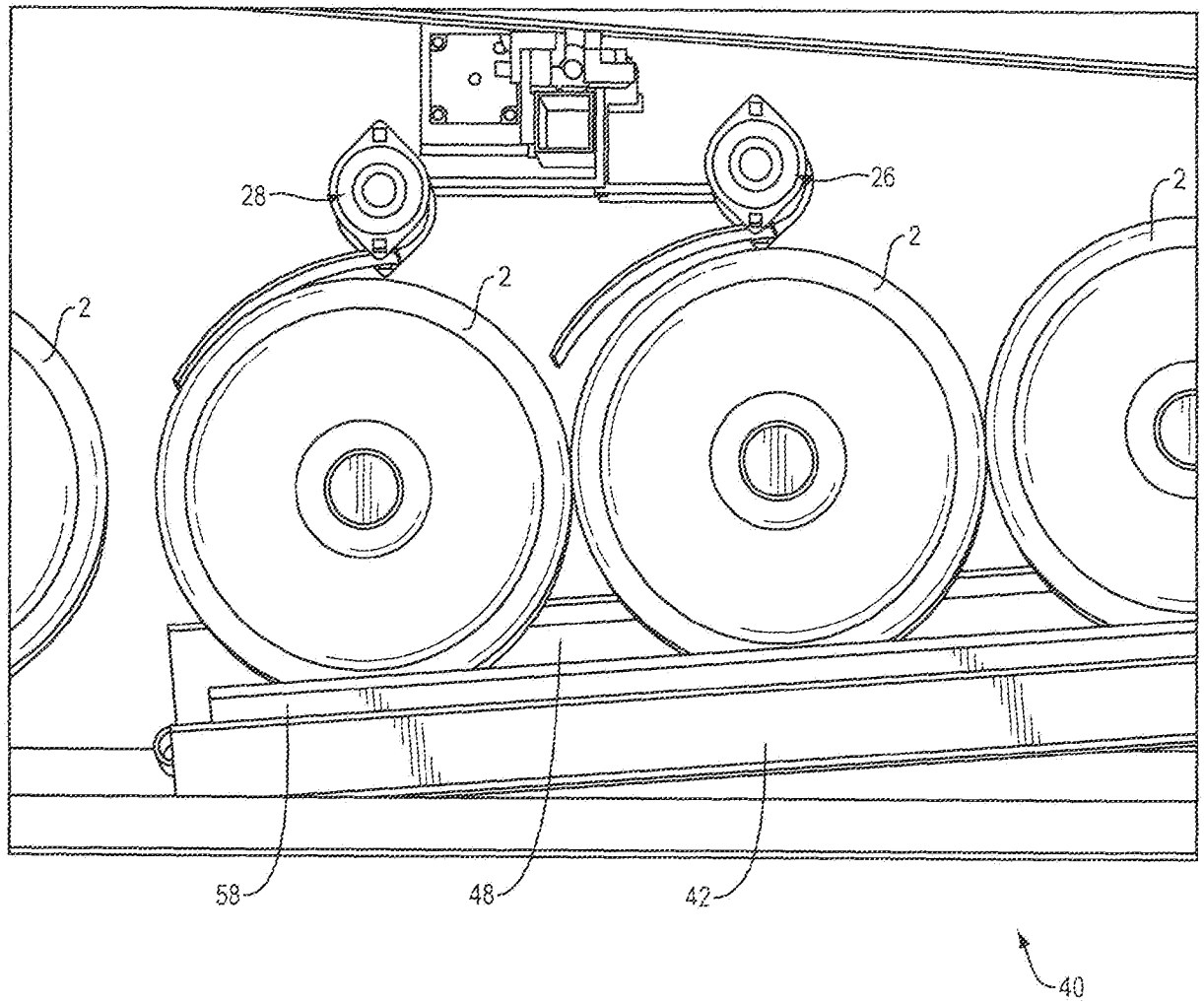
FIG. 8 is a front view of a double gate assembly in a closed position according to the embodiment of the invention shown in FIG. 1.
Figure 9:
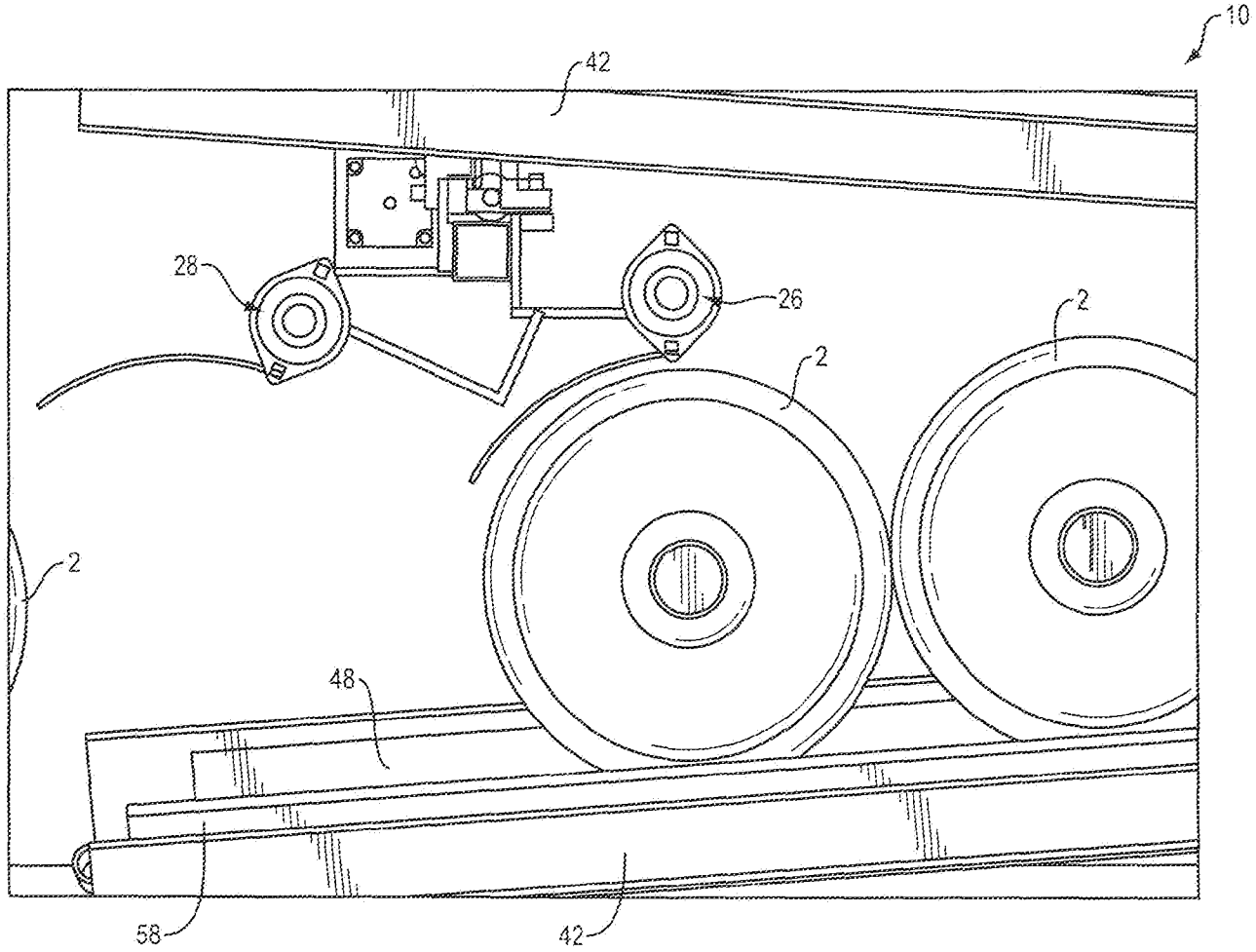
FIG. 9 is a front view of the double gate assembly shown in FIG. 8 in an open position.
Figure 10:
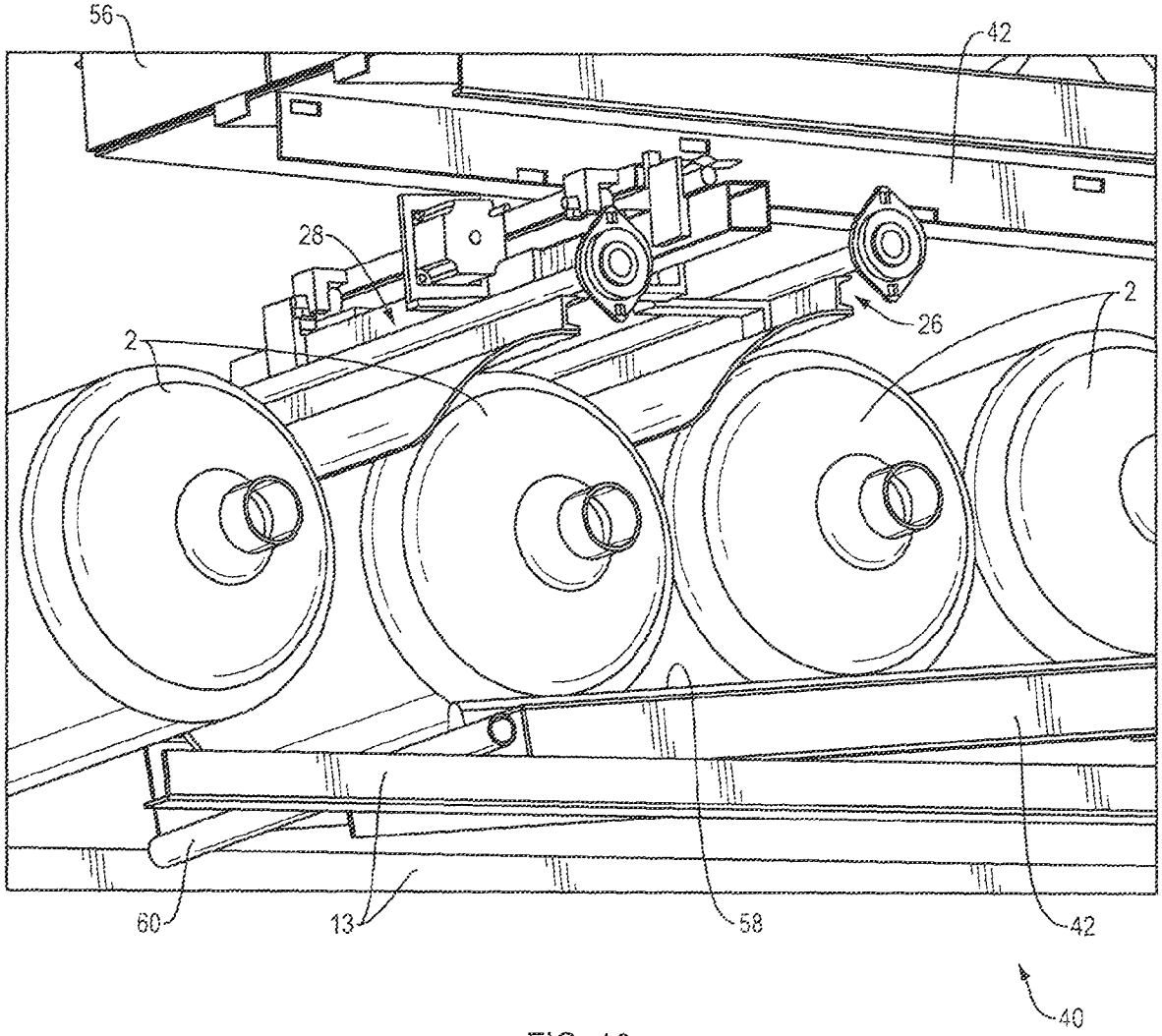
FIG. 10 is a bottom front perspective view of the double gate assembly shown in FIG. 8 after a single full bottle release and reset of the double gate to a closed position.

In one aspect of the disclosure as shown in FIGS. 1 and 2, a combination vending/return apparatus shown generally as 10 includes elements to vend bottles and elements to receive empty return bottles with the use of a single access door. The door location on the apparatus is set to comply with the Americans with Disabilities Act ("ADA") to ensure customers can safely retrieve filled bottles and deposit empty bottles in an ergonomically safe manner.

Apparatus 10 includes a series of spatially stacked track assemblies 42 (shown collectively as 40) used to hold filled and empty bottles. The track assemblies are alternately counter-sloped with radiused transitions 50 to permit bottle movement from a top-most track assembly to, directly or ultimately, a bottom-most track assembly depending upon the presence of intermediary track assemblies between the two extreme position assemblies. A pair of bottle retention gates, shown generally as 26 and 28, provides a means to hold and maintain bottles on the track assemblies and to allow for the controlled release of filled bottles onto a lower elevator 30. Elevator 30 is combined with an upper cradle-type elevator 32 to form a dual elevator shown generally as 90 that moves as a single unit. Lower elevator 30 is configured and dedicated to receive and deliver a filled water bottle from the lowest track assembly. The elevator is then elevated until aligned with a door shown generally as 34. A customer can then open door 34 and retrieve the filled bottle.

Upper elevator 32 is configured to receive an empty bottle when aligned with door 34. Elevator 32 is configured as a cradle to receive and secure an empty bottle for elevation to the top most track assembly 42. Once elevated to the top of the elevator's travel path, a cradle motor (not shown) is activated to rotate the cradle. This rotation urges the resident held empty bottle onto the topmost track assembly 42 for storage until retrieved by an apparatus attendant.

Figure 48:
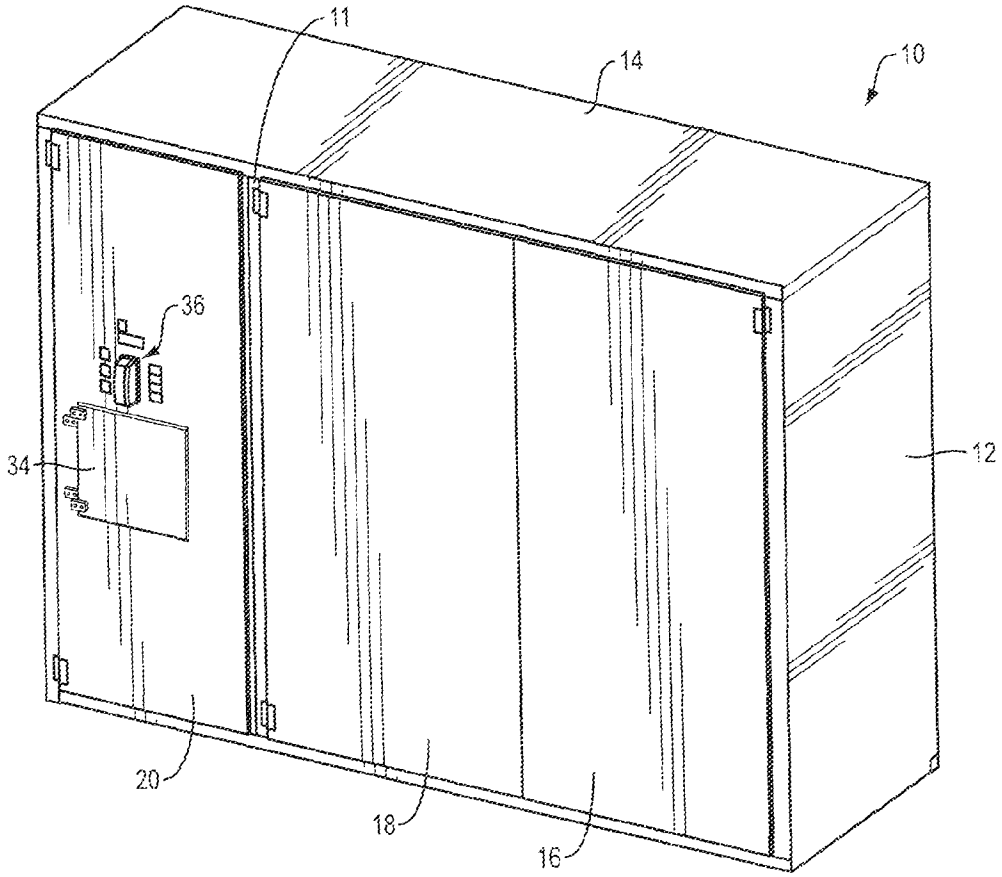
FIG. 48 is a front top perspective view of a closed vending/return apparatus according to the embodiment shown in FIG. 34.
Figure 49:
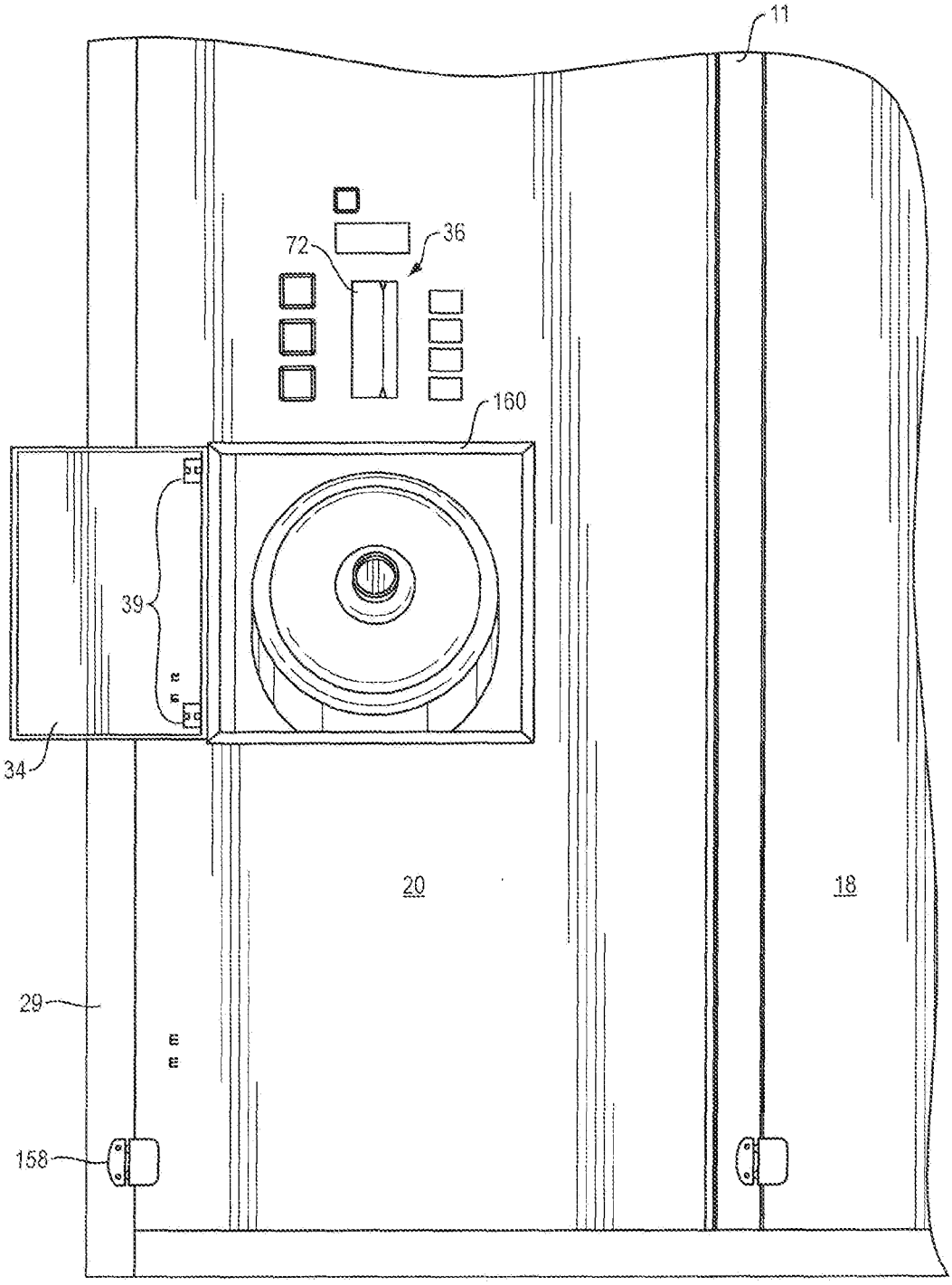
FIG. 49 is an enlarged view of a vending/return door and transaction panel according to the embodiment of the disclosure shown in FIG. 34.
Figure 50:
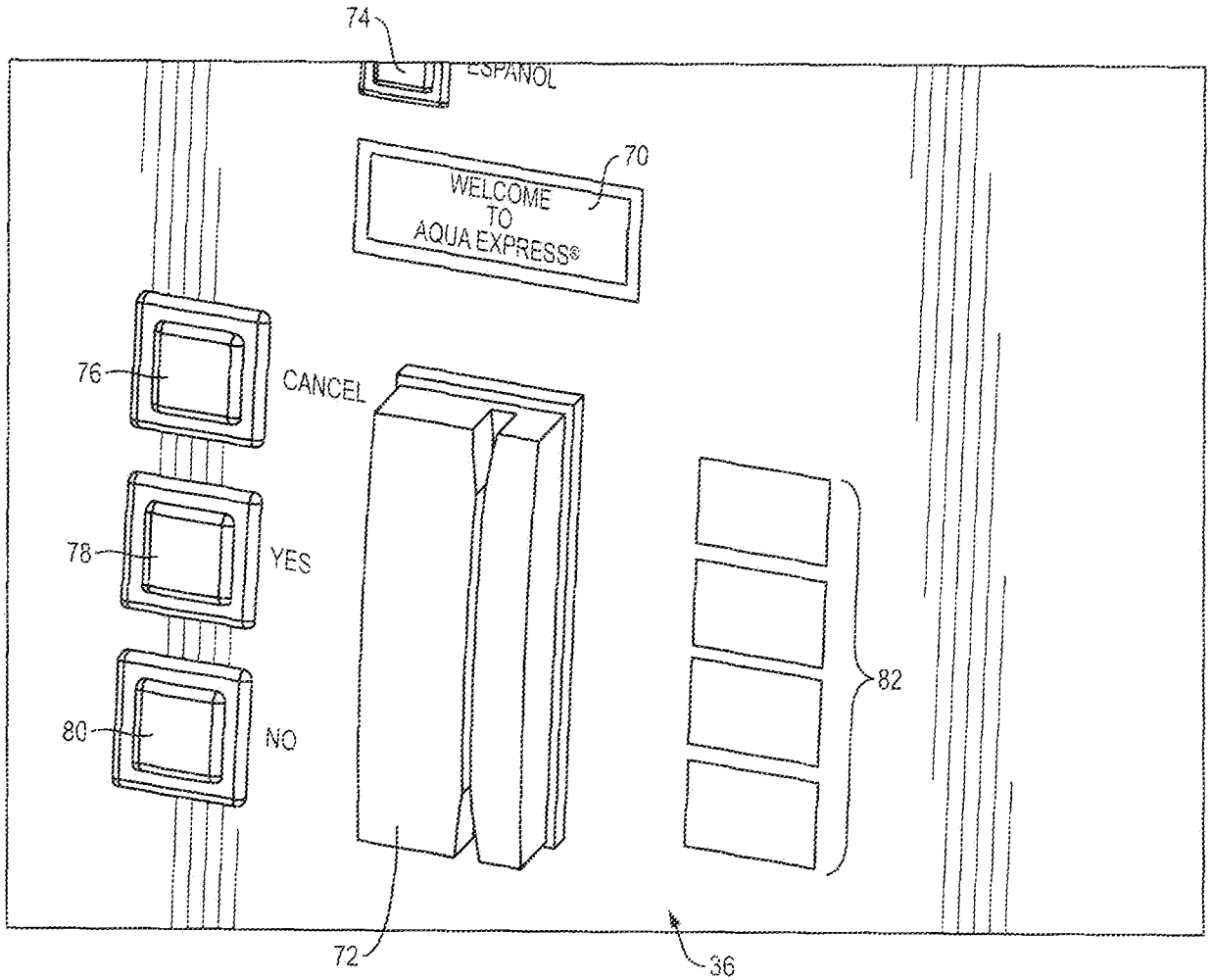
FIG. 50 is an enlarged view of a transaction panel according to the embodiment of the disclosure shown in FIG. 34.
Figure 51:
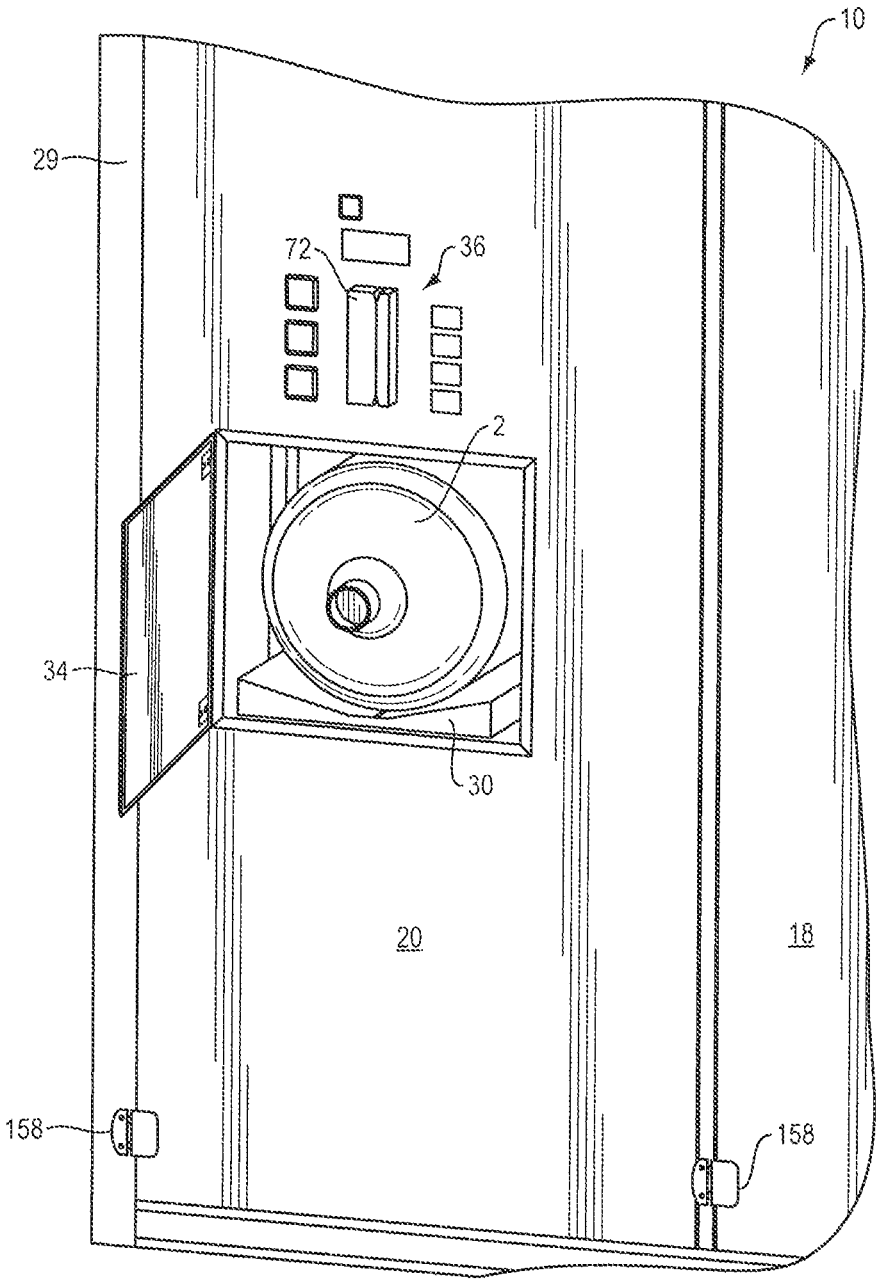
FIG. 51 is a front perspective view of a transaction panel with open vending/return door according to the embodiment of the disclosure shown in FIG. 34.
Figure 52:
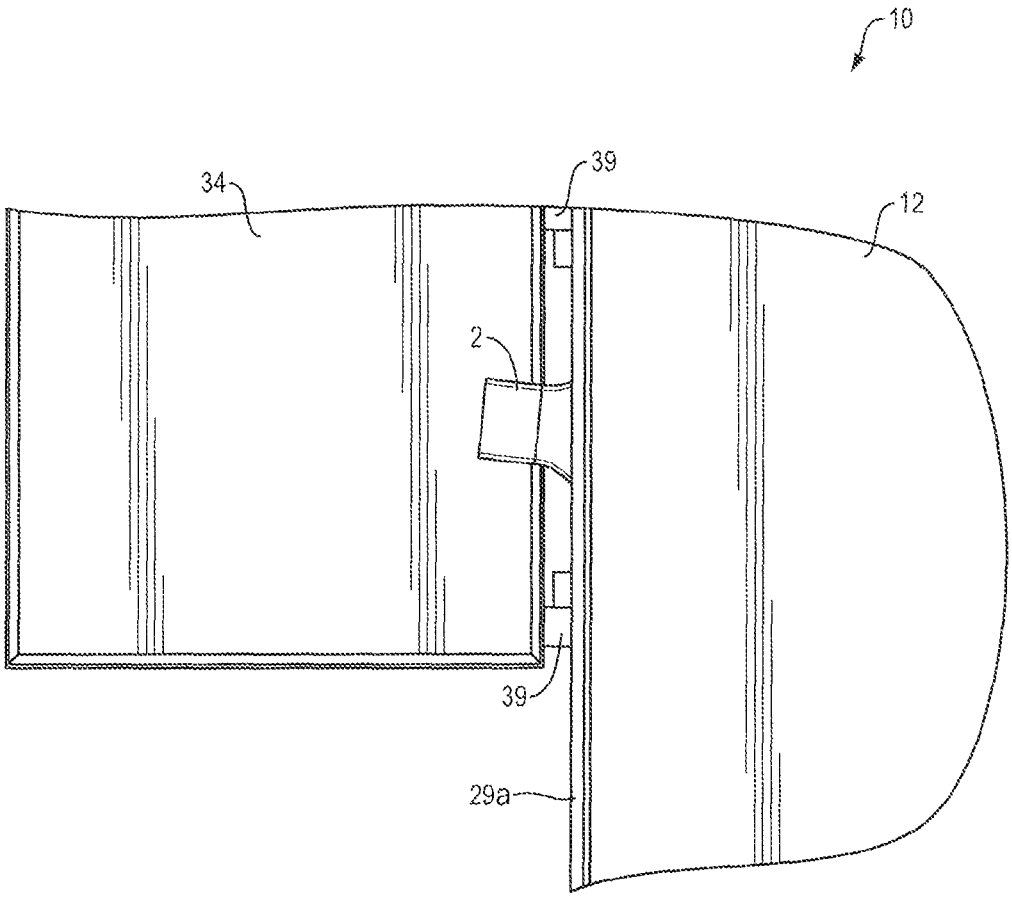
FIG. 52 is a side partial elevational view of a vending/return door in an open position and a filled bottle in a partially removed position according to the embodiment of the disclosure shown in FIG. 34.
Figure 53:
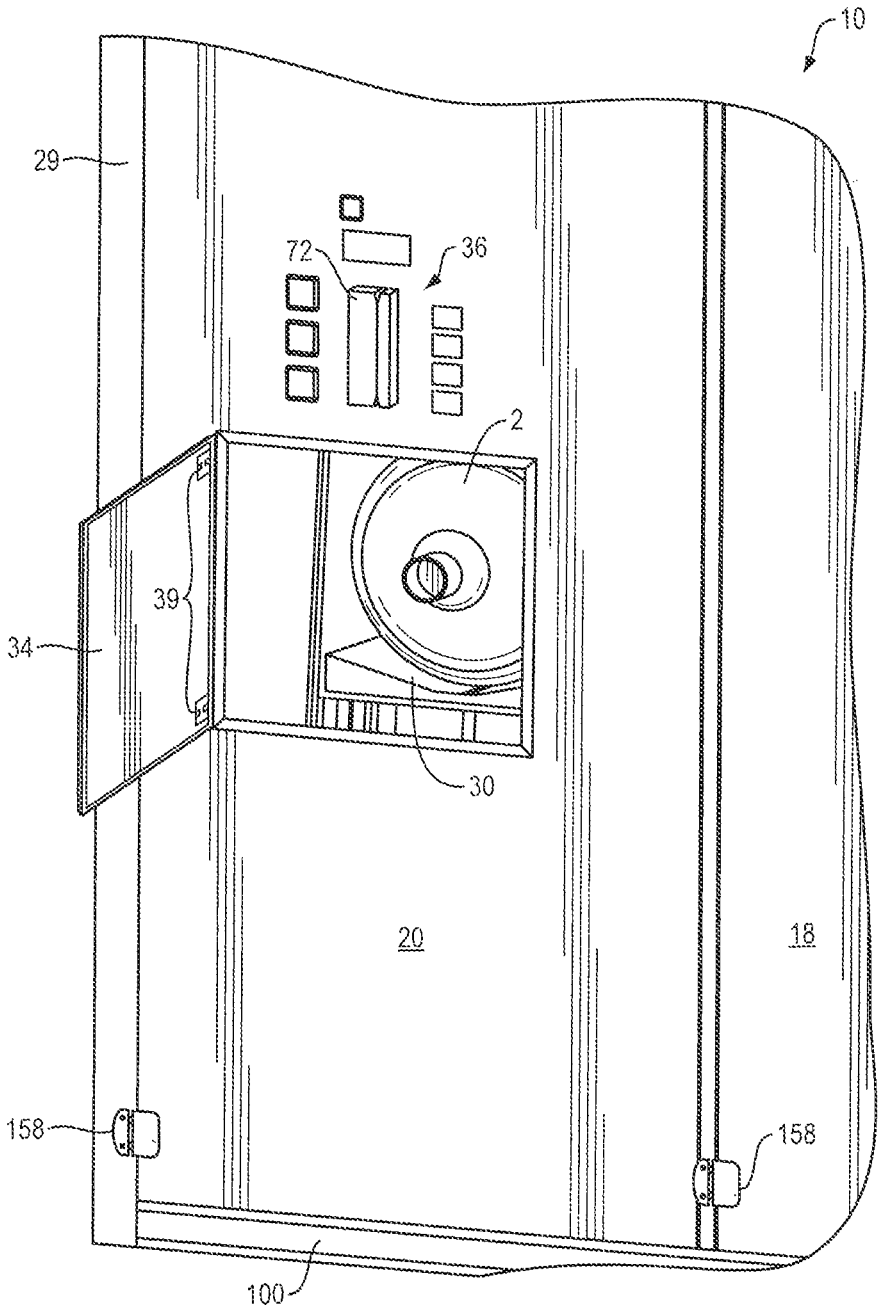
FIG. 53 is a front perspective view of a transaction panel with an open vending/return door and filled bottle on a bottom elevator according to the embodiment of the disclosure shown in FIG. 34.
Figure 54:
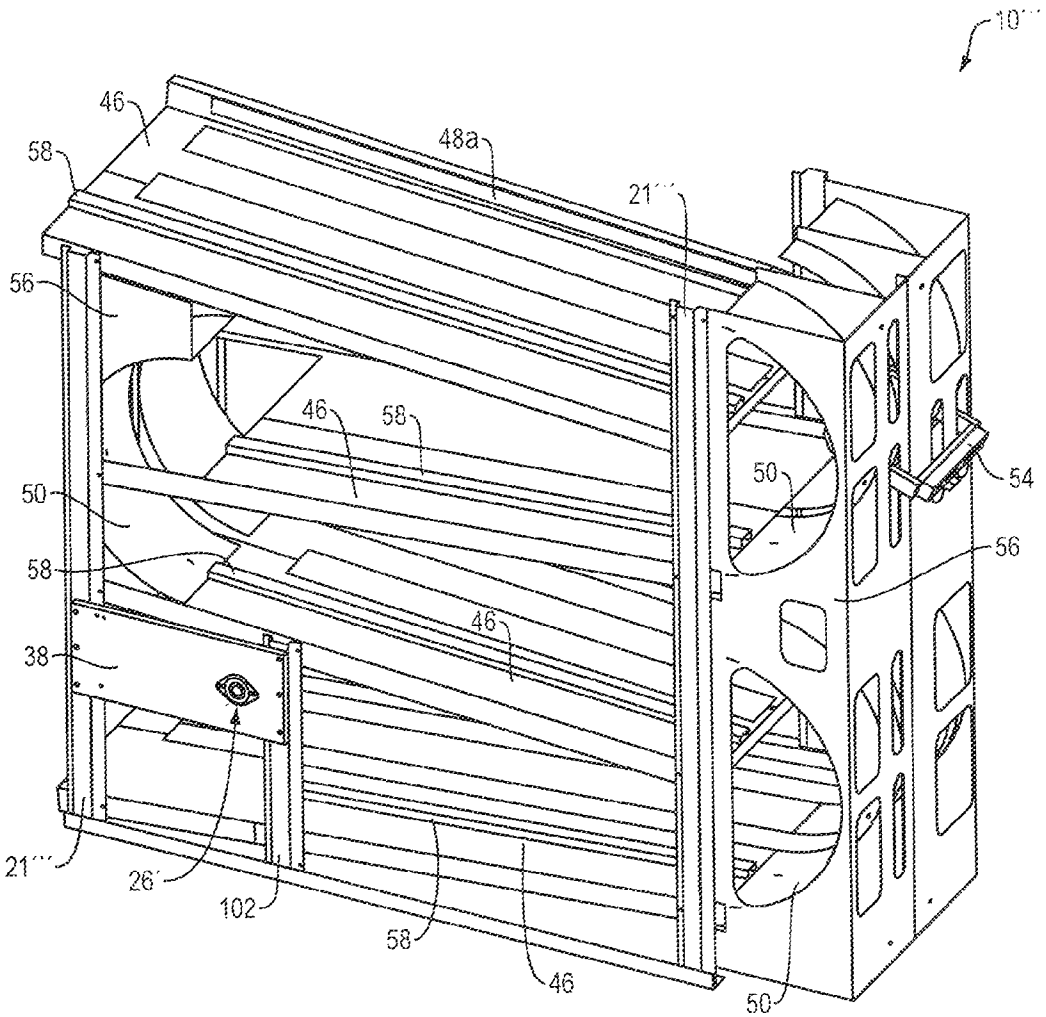
FIG. 54 is a top front perspective view of a modular track assembly and gate mounting assembly according to an embodiment of the disclosure.
Figure 56:
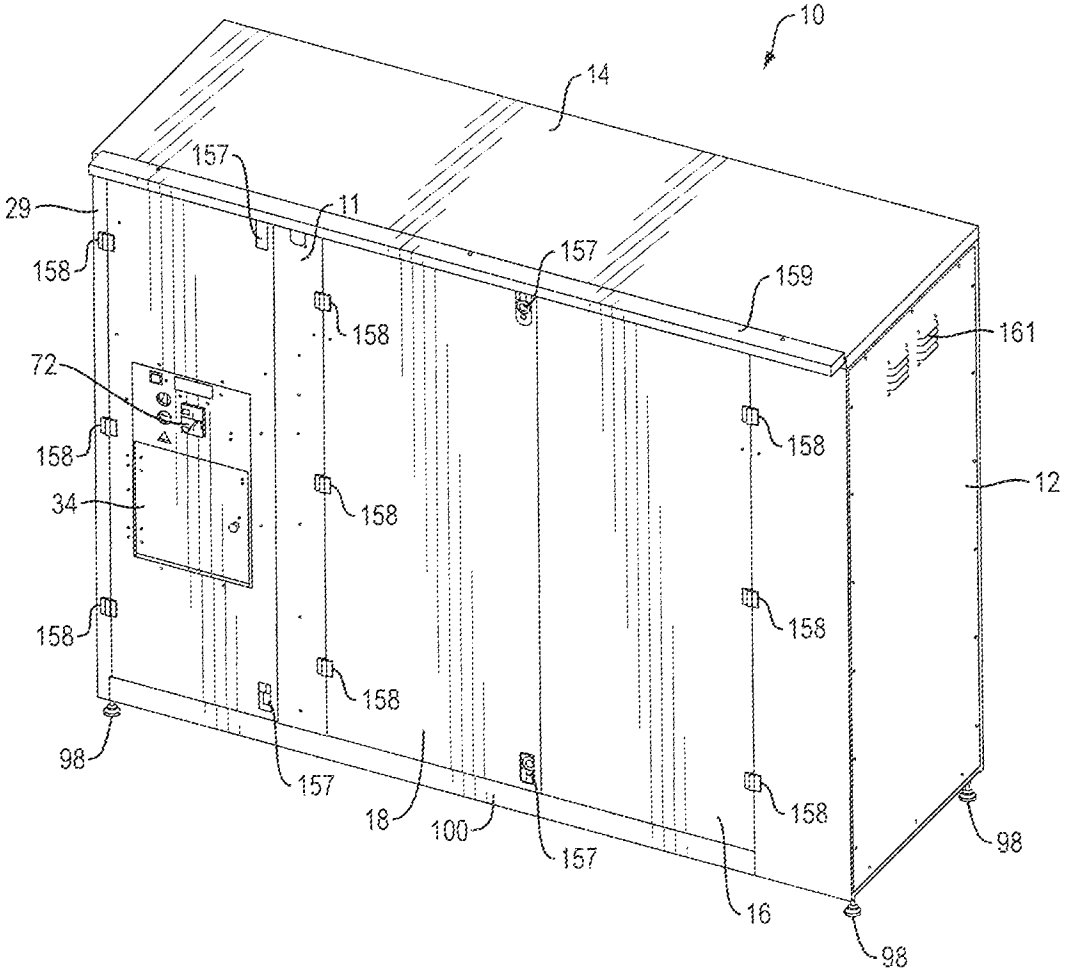
FIG. 56 is a top front perspective view of a vending apparatus according to an embodiment of the disclosure.

The exterior of the apparatus is constructed from sheets of steel, fiberglass or polymer materials as shown in FIGS. 48, 51 and 56. Side panels 12, top 14, a bottom (not shown) and doors 16, 18 and 20 are all constructed from these materials and secured to the apparatus framework. The doors are secured to the apparatus via hinges 158. The hinges may be spring loaded or mechanically actuated with electronically controlled pushrods and the like. Lock assemblies 157 secure the apparatus doors in a closed orientation. A light housing 159 may be incorporated on the upper front of the apparatus to secure lighting, e.g., LED lighting, to illuminate the front of the apparatus and particularly the door and control panel area. Further lighting may be incorporated in the interior of the apparatus to illuminate the mechanical features to, for example, facilitate maintenance and bottle loading and unloading.

Figure 29:
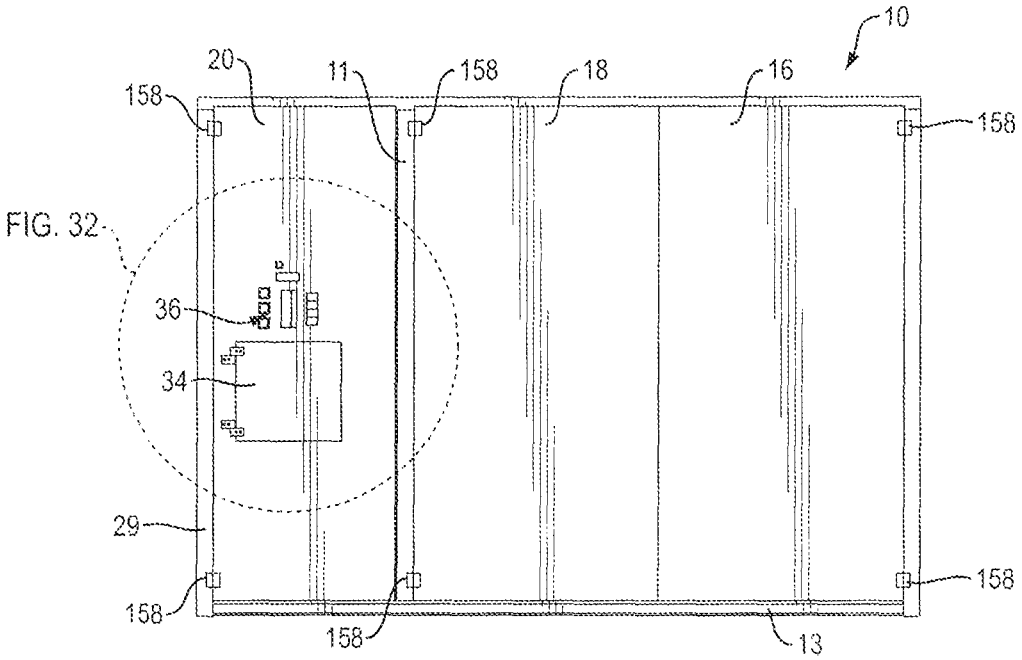
FIG. 29 is a front elevational view of the exterior of the vending/return apparatus shown in FIG. 28.
Figure 30:
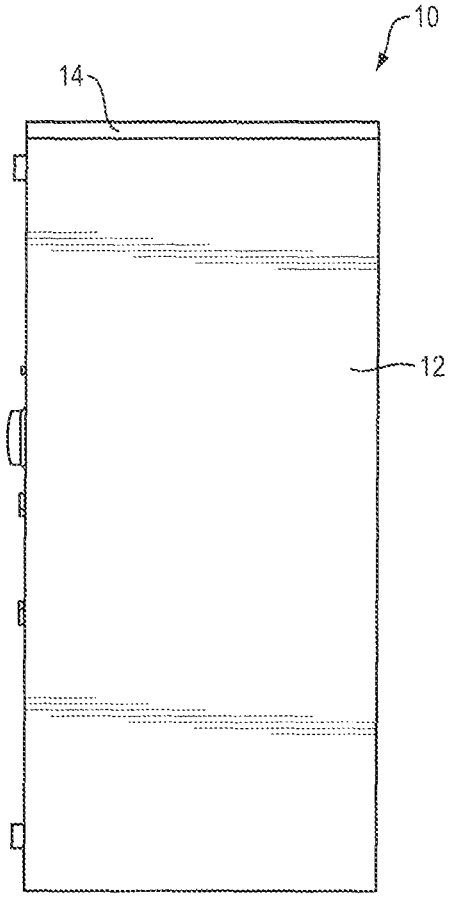
FIG. 30 is a side elevational view of the vending/return apparatus shown in FIG. 28.
Figure 31:
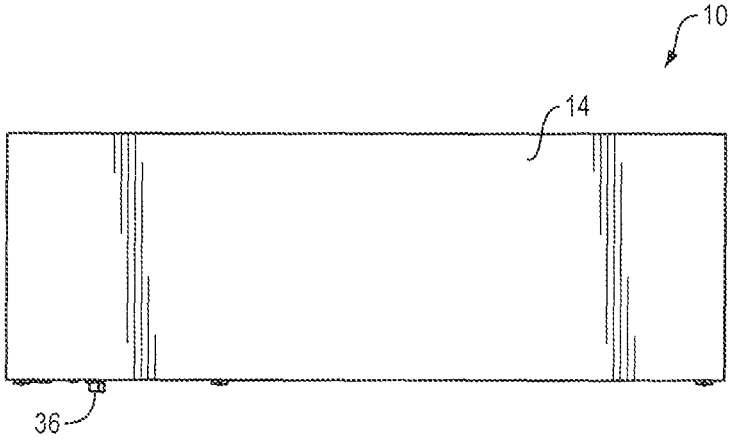
FIG. 31 is a top view of the vending/return apparatus shown in FIG. 28.
Figure 32:
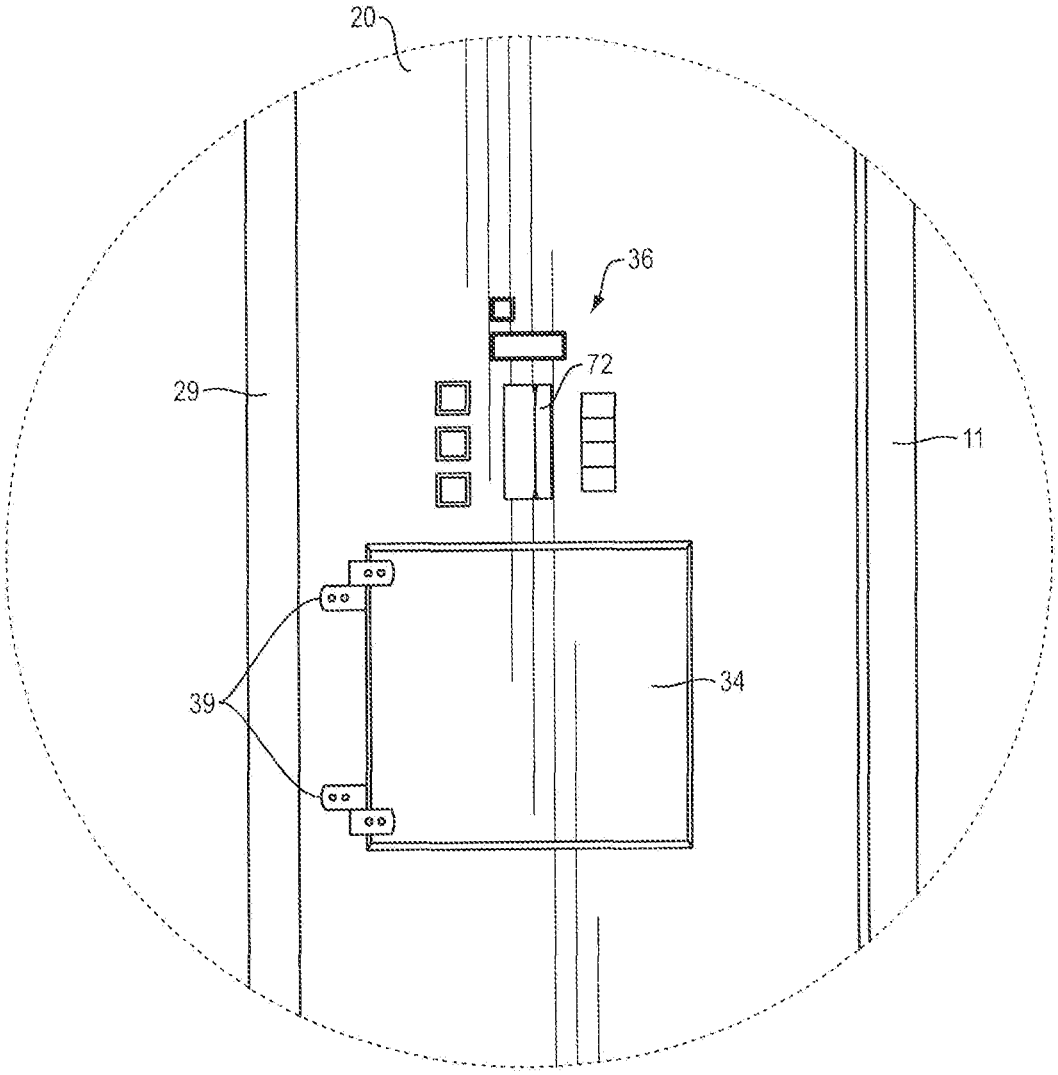
FIG. 32 is a partial front view of a vending/return door and transaction panel according to one embodiment of the disclosure shown in FIG. 29.
Figure 33:
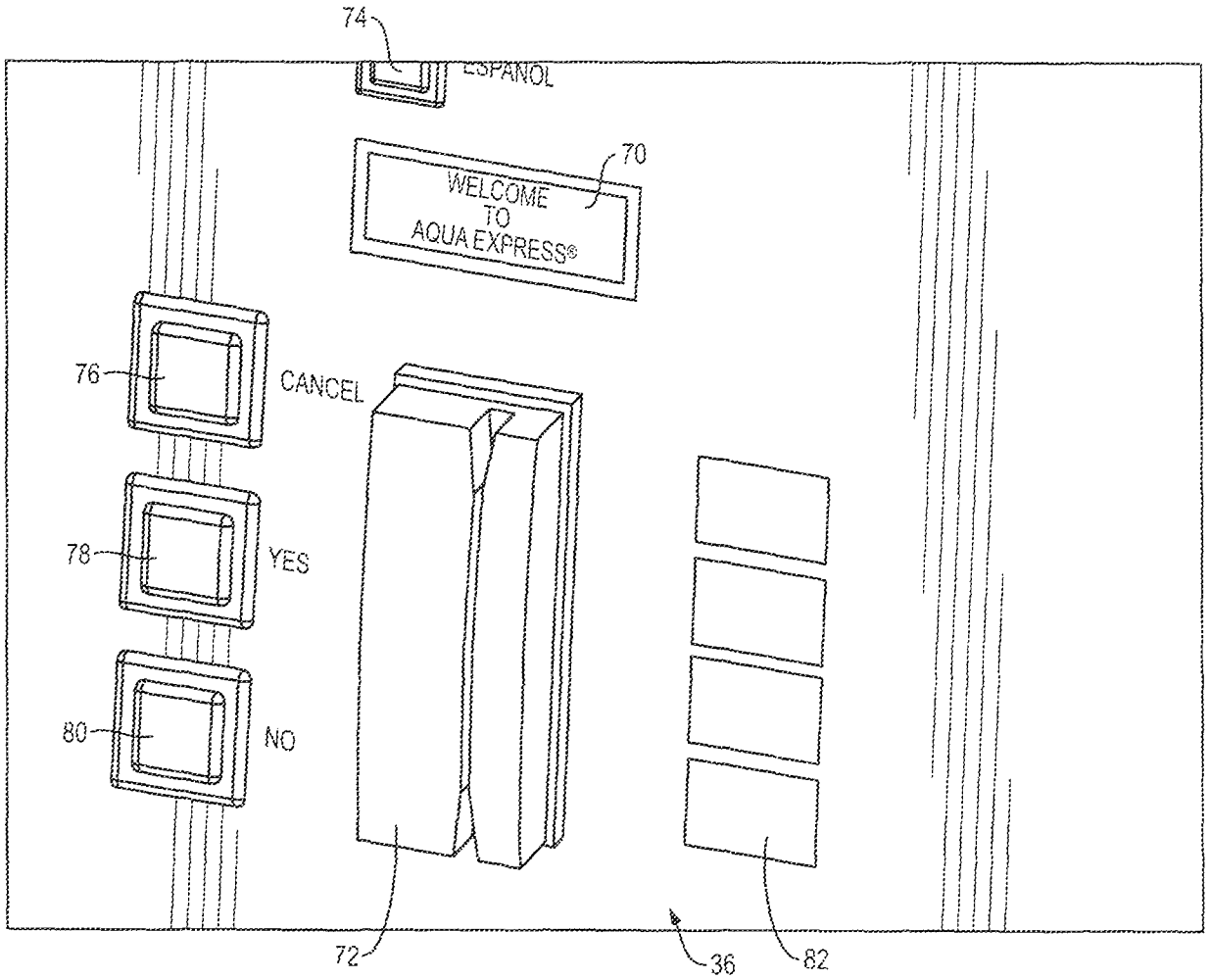
FIG. 33 is an enlarged view of the transaction panel shown in FIG. 32.

In one embodiment, an apparatus frame that may form the support structure for the apparatus includes vertical members 21 secured to cross members 15 and lateral members 13 that collectively form the frame. The exterior panels are secured to the frame with mechanical fasteners, adhesives, welding and the like. In another embodiment shown generally as 10" (elements bearing primed reference character numbers correspond to elements bearing unprimed numbers) in FIGS. 29-31, stiles 11 and 29 secured to the apparatus frame form a finished framework for the doors.

The interior surfaces of the exterior walls may be insulated with any of a variety of insulating materials such as fiberglass and rigid polymer materials to insulate apparatus 10. The apparatus is constructed to operate in temperature conditions from about −10° F. to about 132° F. The apparatus may be climate controlled with the application of air conditioners and/or heaters (depending on the local climate in which apparatus 10 is situated). Suitable heaters include heating appliances such as the PTC fan heaters from STEGO (Marietta Ga.). The heating and/or air conditioning units may have self-contained thermostats or standalone units connected to the processor/controller that can control air conditioning and/or heater operation. Units with self-contained thermostats can be self-controlled independent of the central processor/controller.

Figure 47:
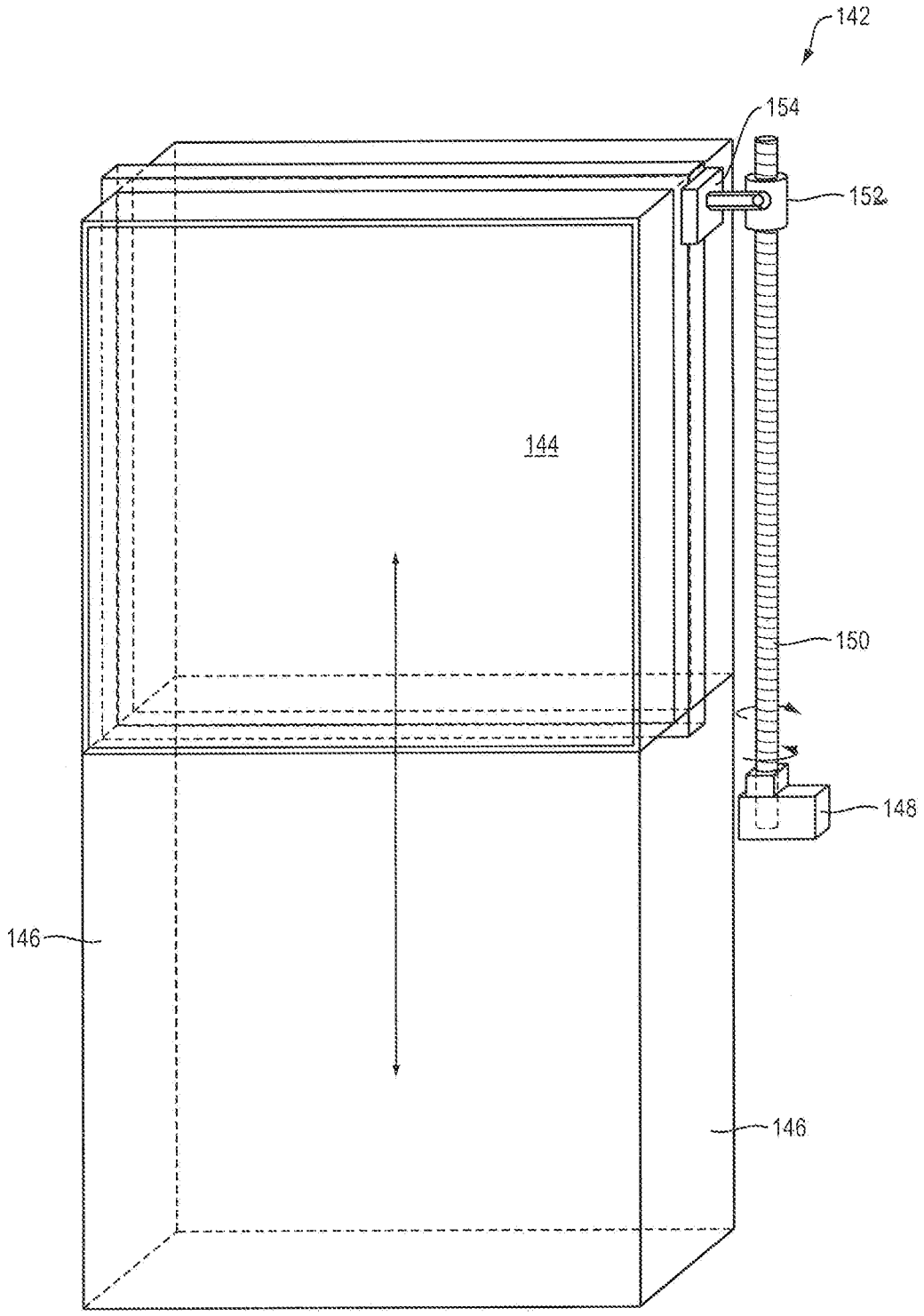
FIG. 47 is a front perspective view of a retractable vending/return door according to the embodiment of the disclosure shown in FIG. 45.
Figure 75:
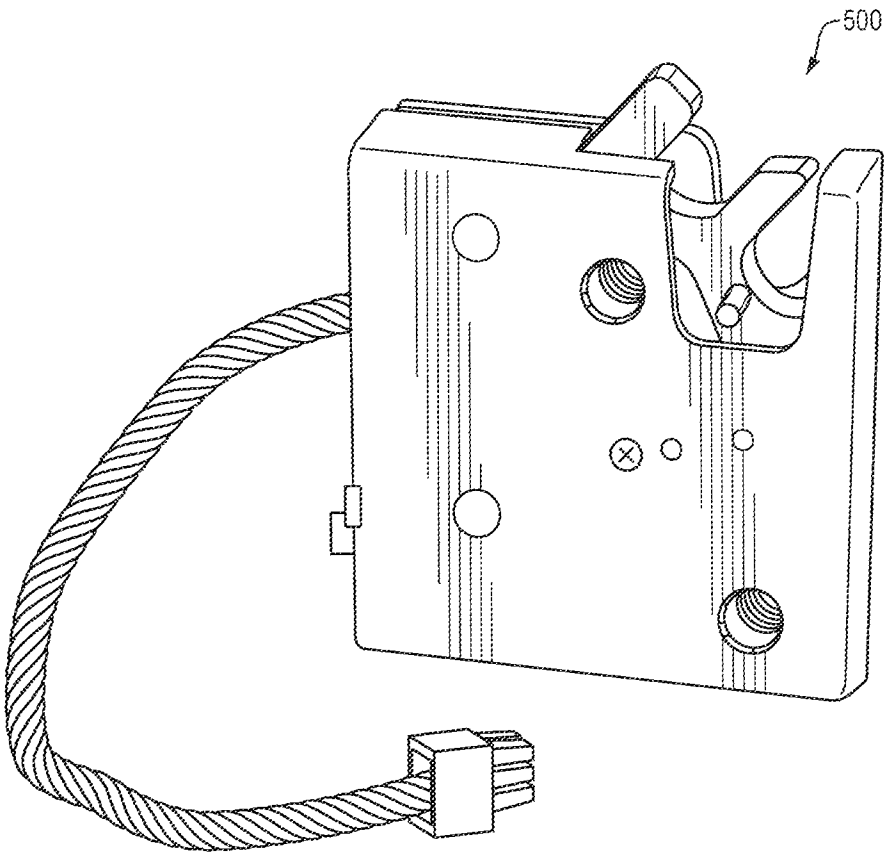
FIG. 75 is a top side perspective view of an electronic door lock according to one embodiment of the disclosure.

As shown in FIGS. 32, 49-53, and 56, in one embodiment, door 34 is a hinged vending/return door secured to a door frame 160 with hinges 39. Hinges 39 may be spring loaded and biased to close the door without customer assistance. A lock shown generally as 500 in FIG. 75 is electronically controlled by the central processor to maintain the door in a locked condition in between vending/return transactions. In an alternative embodiment shown in FIG. 47, a door assembly shown generally as 142 includes an insulated door panel 144 secured in a track 146. A linear actuator motor 148 having a lead screw 150 is secured to apparatus 10 proximate door assembly 142. A threaded lead screw block 152 is threaded onto lead screw 150 and secured to door panel 144 via flange 154. Motor 146 is controlled and operated by the apparatus' central processor/controller. Rotation of lead screw 150 in one direction will urge the slide-type door into a closed position. Rotation of the lead screw in the opposite direction will urge the door into an open position as is well understood in the art.

To permit customer interaction with the vending apparatus, as shown particularly in FIGS. 32, 33, 50 and 65, an apparatus control panel, shown generally as 36, includes a card swipe slot 72 configured to read a magnetic strip on a commercial credit/debit card, or any other magnetic-strip-bearing card such as a prepaid water card. An optional label 82 that depicts vendor accepted credit card types, e.g., VISA®, MasterCard®, etc., may be secured to apparatus 10 proximate to slot 72 to provide customer guidance as to what cards are accepted by the apparatus. A Spanish language selection button 74 is included to provide a second language option for transaction events. It should be understood additional language buttons can be incorporated into the apparatus and different languages can be programmed into the transaction application as more fully disclosed in my co-pending regular utility application Ser. No. 13/407,452 ("the '452 application"), the contents of which are incorporated herein by reference.

An optional "Welcome to Aqua Express" LED display 70 may also be incorporated into the apparatus proximate swipe slot 72 to indicate vendor identification. The LED display may also be configured to provide customers with visual prompts as disclosed more fully hereinbelow. Additional control buttons for transaction cancellation 76, yes responses 78 (to vend/return application initiated customer queries), and no responses 80 (for the same customer queries) are also included to provide user interface functionality. An application suitable to operate apparatus 10 with the disclosed control buttons is also disclosed in the '452 application and incorporated herein by reference.

Referring now to FIGS. 2-6 and 15-32, a multi-track assembly shown collectively as 40 includes a plurality of sloped track assemblies 42. Each track assembly 42 is sloped from about 1° to about 10° from one side to the other. Slopes from about 6° to about 8° have proven to be particularly advantageous to promote desired gravity-driven bottle movement that does not result in too much inertia buildup that could compromise bottle integrity due to bumping and movement cessation at the end of the bottom-most track assembly, or when contact is made with the next downslope bottle. As should be understood, each bottle will eventually register against the bottle at the immediate down slope position unless the bottle is the last remaining bottle on the lowest track assembly. The noted track assembly slope angle ranges balance desired bottle movement with minimized bottle inertia buildup so as not to compromise the bottles.

The orientation of the slopes alternates by row with the topmost row, in one embodiment, sloped downwardly from left to right and the next row, or penultimate row to the top row, sloped downwardly from right to left. The alternating slope pattern is repeated for each successive row. As should be understood, the slope orientation for each row can be reversed to provide a vending apparatus with a topmost row sloping downwardly from right to left with a load and unload door on the right side of the apparatus.

Each track assembly may have a secondary slope and be sloped downwardly from front to back from about 2° to about 12°. Secondary slopes from about 4° to about 6° have proven to be particularly advantageous to maintain the bottles rolling about a center axis that remains substantially perpendicular to the longitudinal axes of each track assembly as the bottles roll down the track assemblies. FIGS. 15-18 show an apparatus shown generally as 10° with track assemblies with an 8° secondary slope. FIGS. 19-22 show an apparatus shown generally as 10° with track assemblies with a 6° secondary slope.

Each track assembly 42 is formed from track sheets 46 secured to a track framework comprised of rails and cross bars. The track assemblies may also be structurally rigid and take the place of the rails and cross bars in one embodiment wherein the assemblies are attached directly to vertical frame elements of the apparatus. Alternatively, each track assembly may comprise a pair of substantially parallel rails. Each track assembly further includes a bottle bottom rail 48 and an optional neck rail 58, each positioned above the plane occupied by the track sheets or track assembly bottle supporting surface to guide and maintain the bottles on the track assemblies. The bottom rail is configured to contact the bottom surfaces of resident bottles. The neck rails are configured to contact the neck portions of resident bottles. The combination of the rails promotes bottle alignment as the bottles roll down the track assemblies and prevents bottle deviation and wracking on the track assemblies. Bottom rail 48 and neck rails 58 may be constructed from material with good lubricious characteristics, (e.g., polypropylene), to minimize friction when bottles roll along the track assembly.

Figure 14:
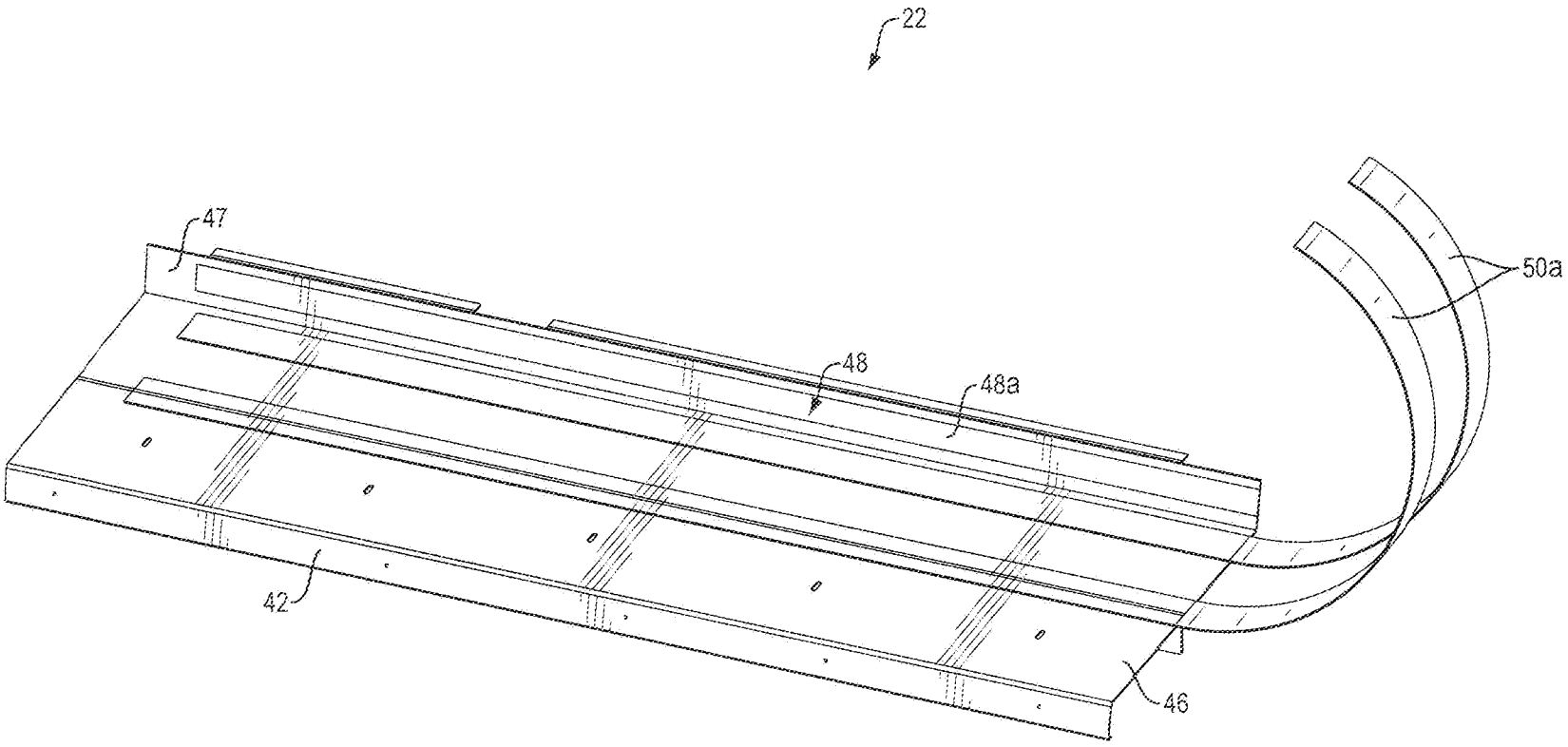
FIG. 14 is a top perspective view of a track assembly and curve according to one embodiment of the disclosure.
Figure 15:
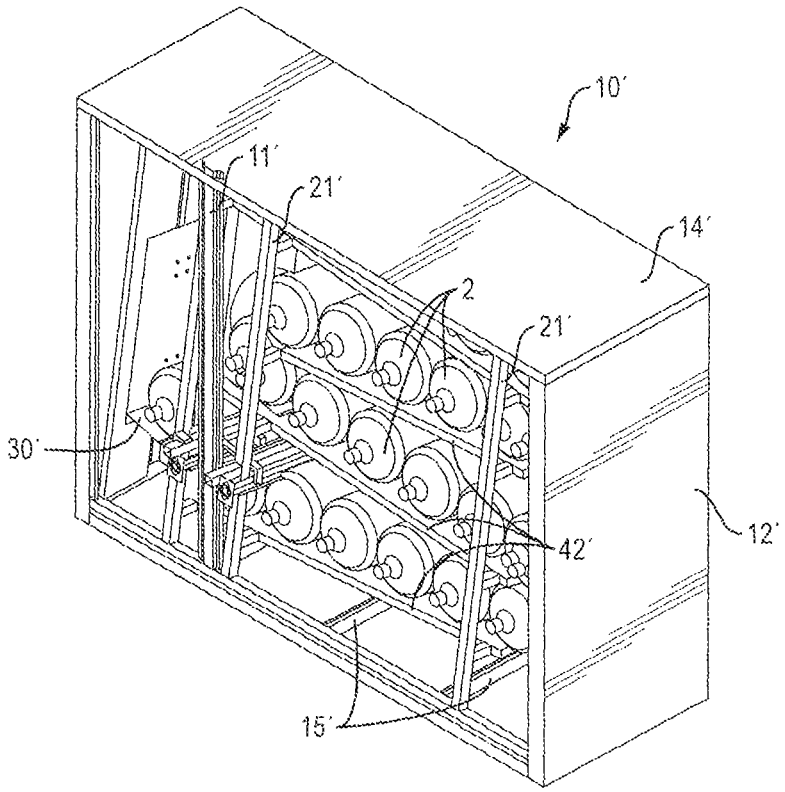
FIG. 15 is a top front perspective view of the vending/return apparatus shown in FIG. 1 with an 8° front-to-back slope.
Figure 16:
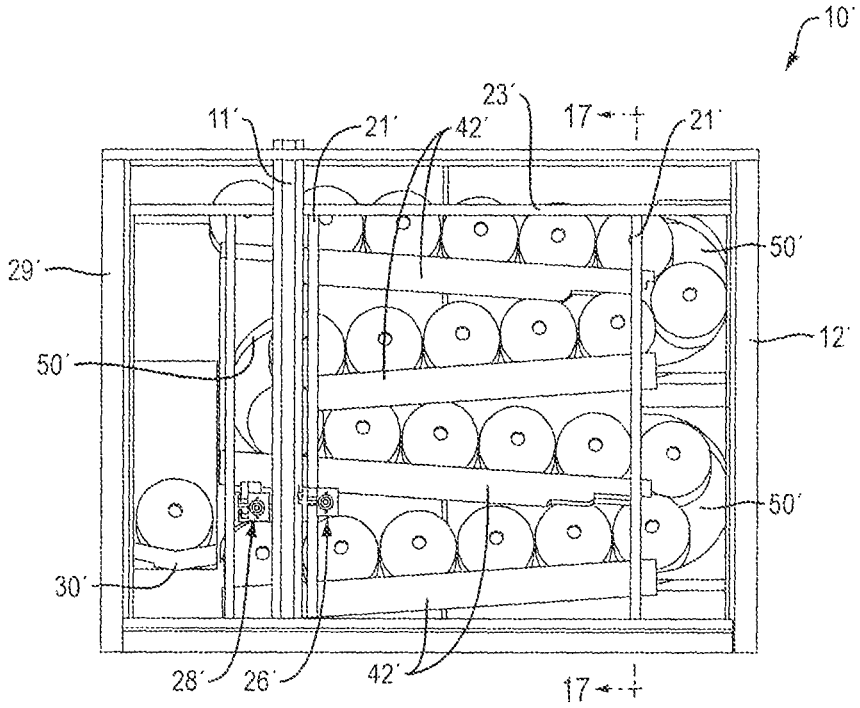
FIG. 16 is a front elevational view of the vending/return apparatus shown in FIG. 15.
Figure 17:
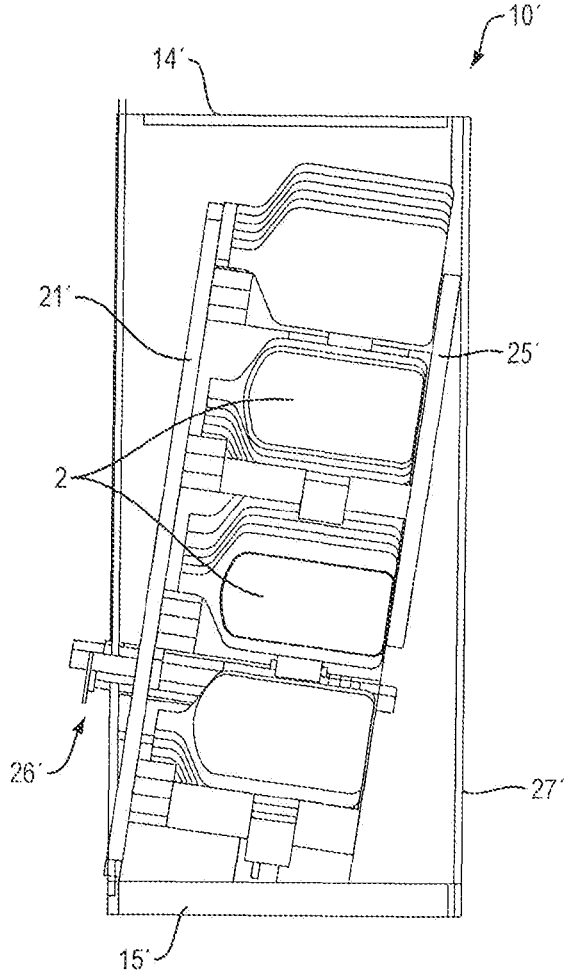
FIG. 17 is a side sectional view of the vending/return apparatus shown in FIG. 15.
Figure 18:
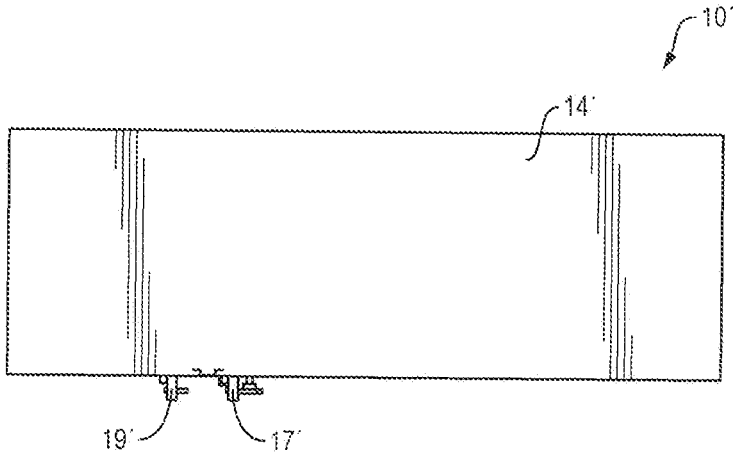
FIG. 18 is a top view of the vending/return apparatus shown in FIG. 15.
Figure 19:
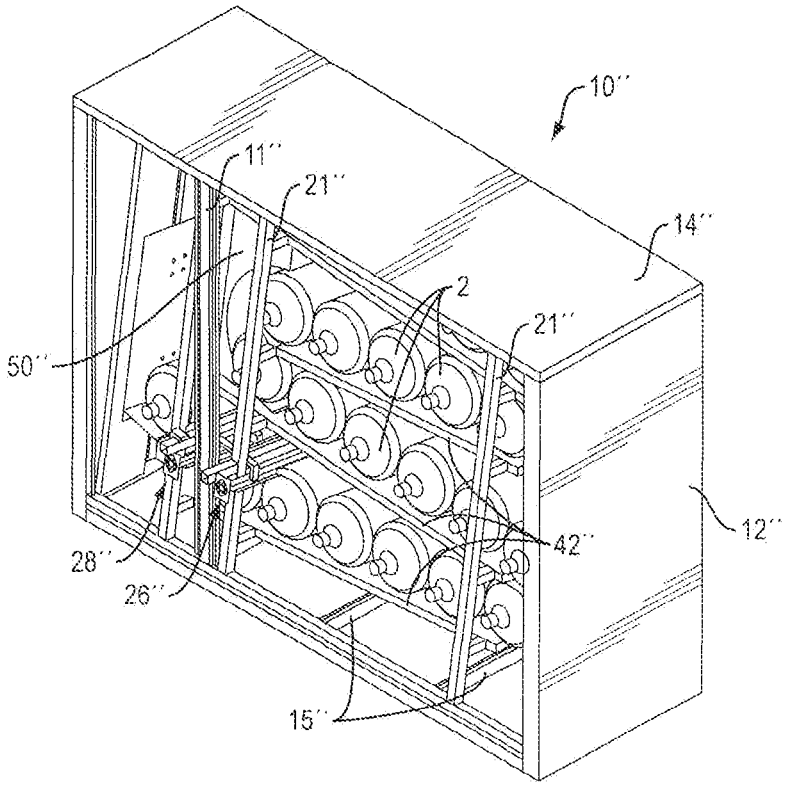
FIG. 19 is a top front perspective view of the vending/return apparatus shown in FIG. 1 with a 6° front-to-back pitch or slope.
Figure 20:
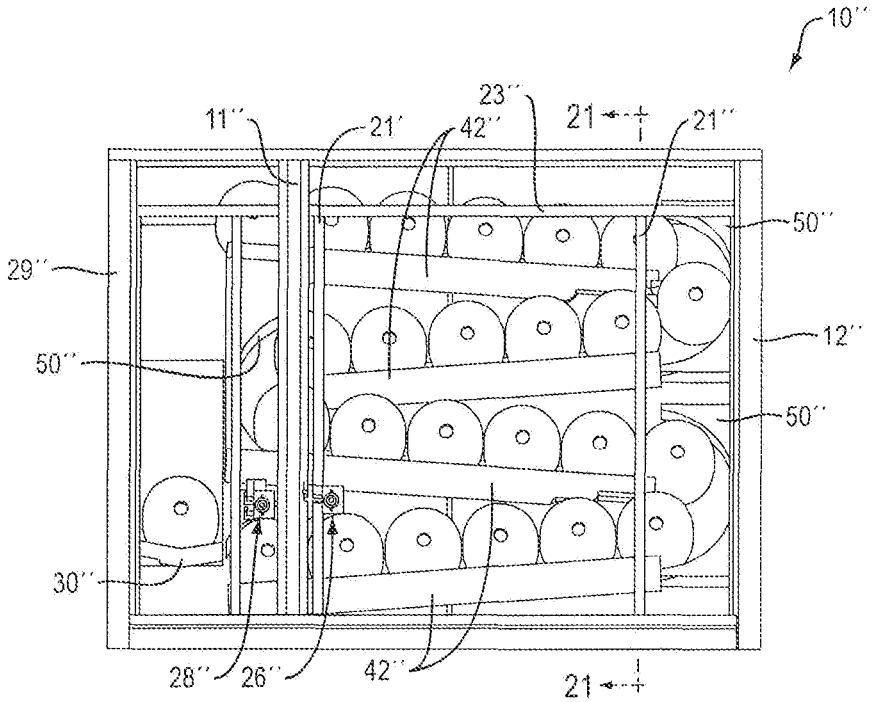
FIG. 20 is a front elevational view of the vending/return apparatus shown in FIG. 19.
Figure 21:
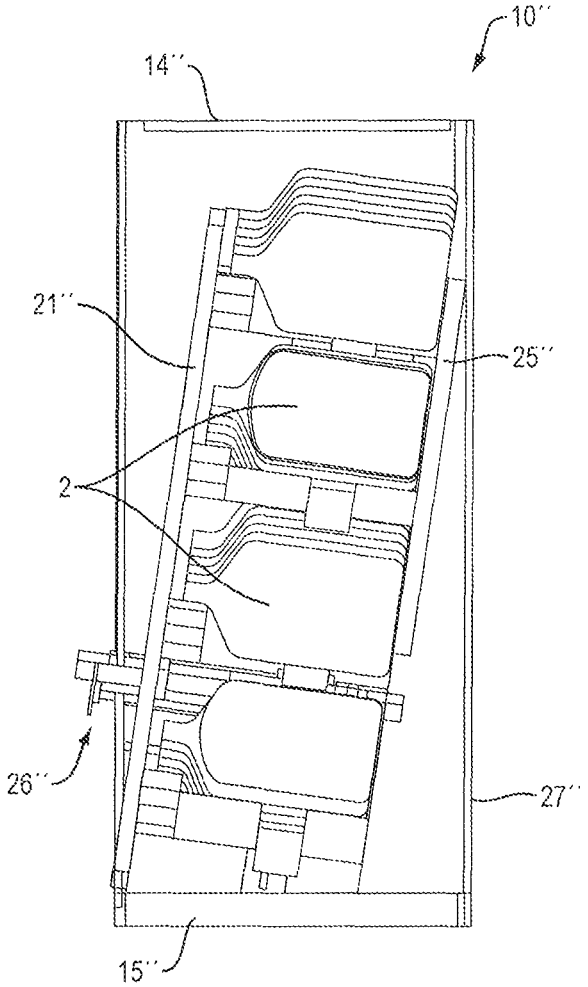
FIG. 21 is a side sectional view of the vending/return apparatus shown in FIG. 19.
Figure 22:
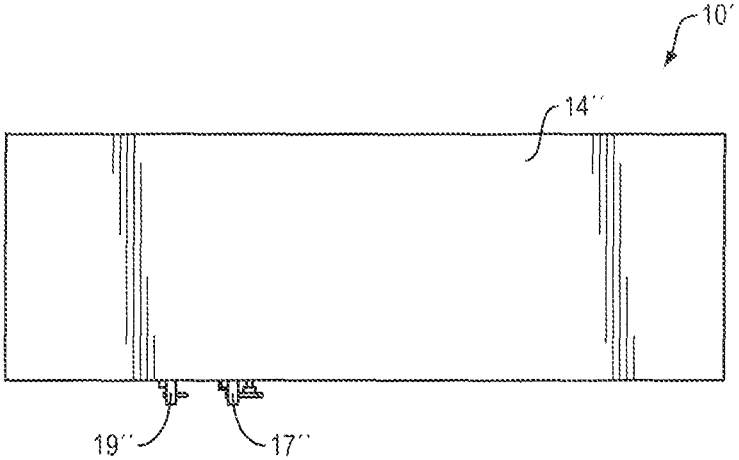
FIG. 22 is a top view of the vending/return apparatus shown in FIG. 15.
Figure 25:
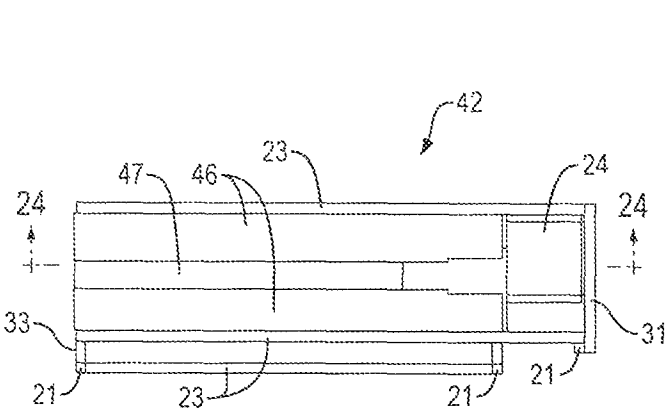
FIG. 25 is a top view of the joined track assemblies shown in FIG. 23.
Figure 26:
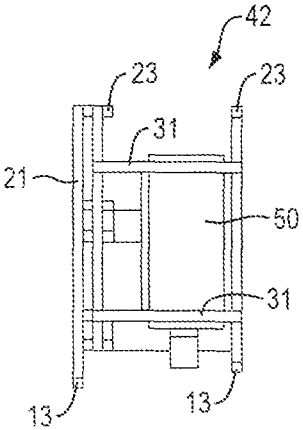
FIG. 26 is a side elevational view of the track assemblies in FIG. 23.
Figure 23:
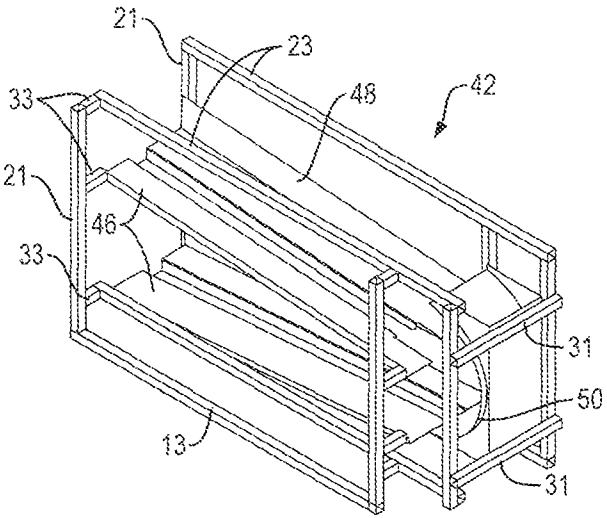
FIG. 23 is a top front perspective view in partial phantom of two joined track subassemblies according to the embodiment of the disclosure shown in FIG. 1.
Figure 24:
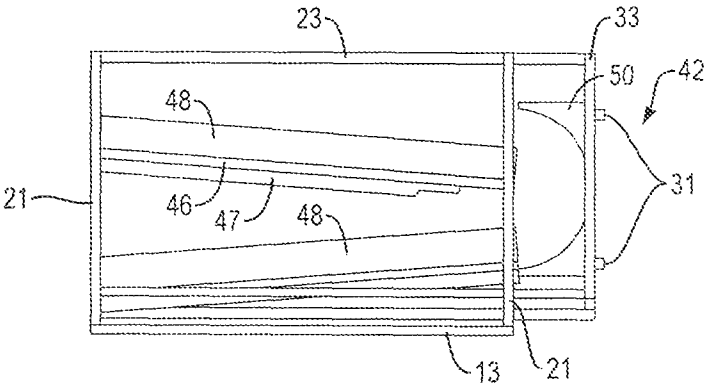
FIG. 24 is a front elevational view of the joined track assemblies shown in FIG. 23.
Figure 27:
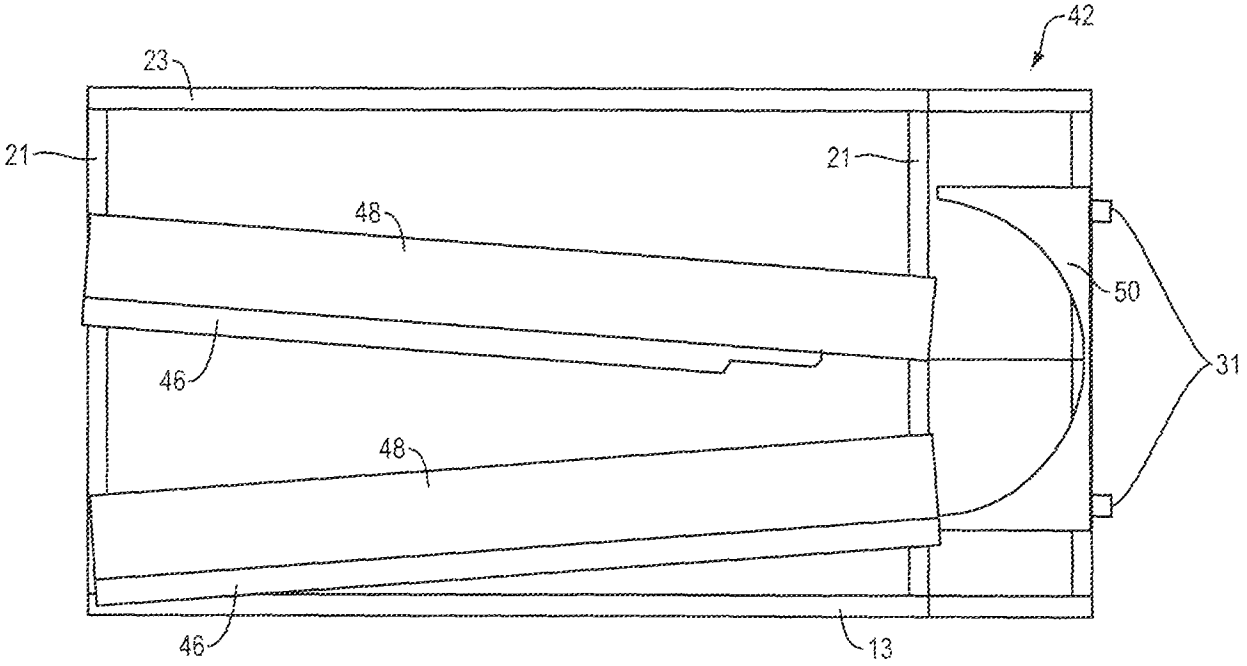
FIG. 27 is an enlarged front elevational of the joined track assemblies shown in FIG. 23.
Figure 28:
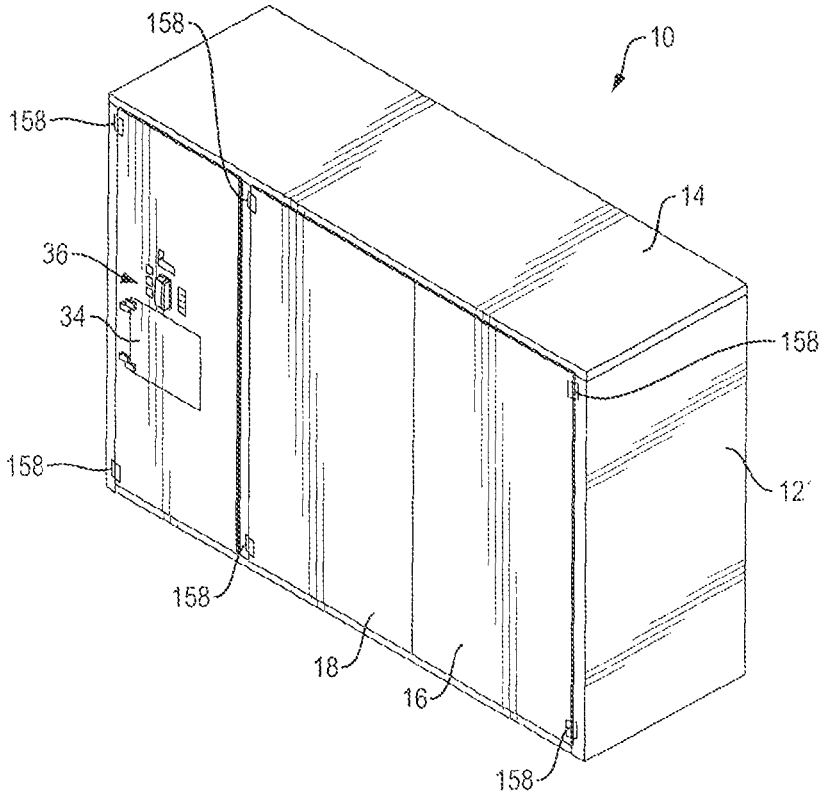
FIG. 28 is a top front perspective view of the exterior of the vending/return apparatus shown in FIG. 1.
Figure 67:
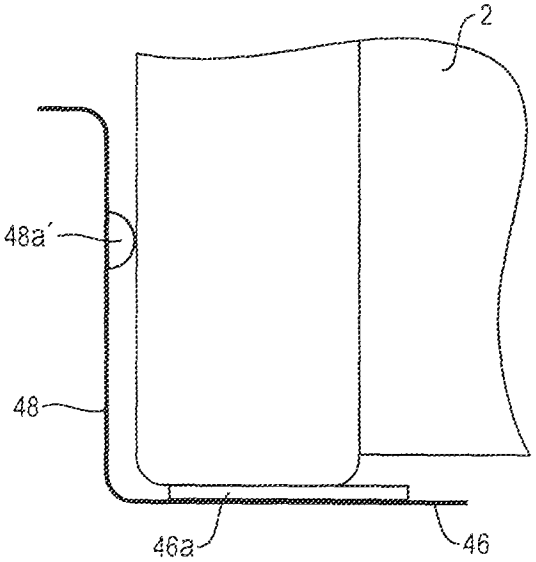
FIG. 67 is a cross-sectional view of a track assembly according to another embodiment of the disclosure.
Figure 66:
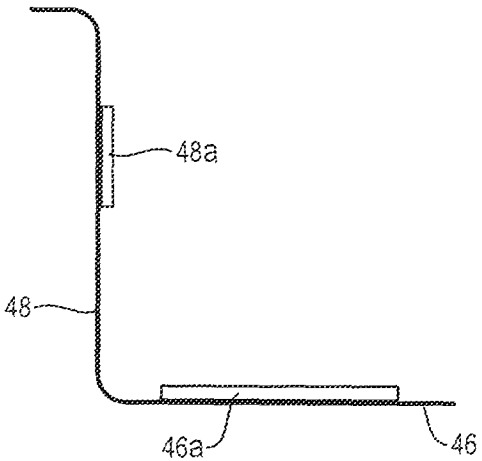
FIG. 66 is a cross-sectional view of a track assembly according to an embodiment of the disclosure.

Alternatively, rail 48 may be formed from steel (as shown in FIG. 14 as a vertical extension 47 of the horizontal track sheet 46), or plastic materials with a surface treatment or strip of material (e.g., strips 48*a* and 48*a*' in FIGS. 66 and 67), secured to the rail to impart the desired lubricious characteristics. As a further alternative as shown in FIGS. 66 and 67, the rail profiles may be straight 48*a* (FIG. 66) or semi-circular in cross-section 48*a*' (FIG. 67) the latter of which reduces the contact points with the resident bottles so as to further reduce frictional forces from impeding bottle migration down the track assemblies. Semi-circular rail 48*a*' may be constructed from Starboard® or like material due to its advantageous lubricious characteristics that reduce sticking.

A terminal end of each track assembly may be secured to an attachment rod 60. The ends of rod 60 are secured to vertical frame members on the front and back ends of the frame assembly. The round surface of rod 60 facilitates bottle advancement off the track assembly and onto the next lower track assembly or elevator as more fully disclosed below. Alternatively, the track assemblies may be secured directly to the vertical posts or the horizontal rails that comprise the frame assembly of the apparatus.

To transition bottles from the topmost row to the second row, a track assembly transition turn 50 is formed on, or secured to, an upper sloped end of the second track assembly 42. A top end of turn 50 extends above the downward sloped end of topmost track assembly 42 so as to receive bottles rolling off the lower end of the topmost track assembly. The radius of turn 50 is dimensioned to permit one to four bottles to fit within the turn at a given time. Turn 50 may also be formed with lubricous strips 50*a* (shown in FIG. 14) to further reduce frictional resistance to bottle movement along the track assemblies and through the turns. An optional empty bottle inertia retarder assembly 51 may be provided to slow the velocity of empty bottles that travel down the topmost track assembly and enter turn 50. The need for assembly 51 is due to the tendency of empty bottles to bounce off a string of motionless bottles lower on the track assemblies when the empty bottle travels down the track assemblies from the return elevator disclosed more fully below.

Figure 60:
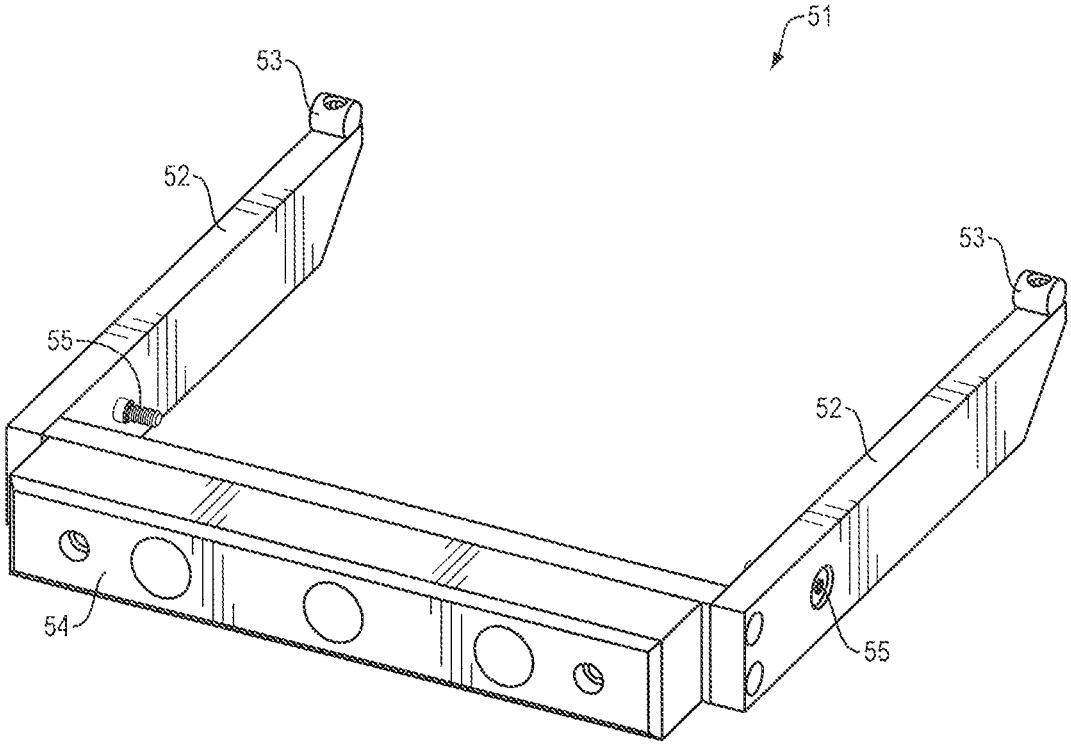
FIG. 60 is a top front perspective view of an empty bottle inertia restrictor according to an embodiment of the disclosure.

As shown more specifically in FIG. 60, assembly 51 may be configured with two extension arms 52 as shown to displace the inertia retarding effect along the length of an empty bottle registered against assembly 51. Optional bottle reception knobs 53 having rounded profiles and made from materials having lubricious qualities may be attached to the ends of arms 52 to facilitate passage of the bottles and to reduce the chance of marring or scarring the bottle surfaces. This use of two spaced arms ensures a substantially uniform application of an inertia restrictive force along the substantial length of the empty bottle to minimize or prevent bottle deviation from its line of travel when it comes into contact with assembly 51. It should be understood the amount of force applied by assembly 51 has no appreciable effect on the travel of relatively heavy filled bottles and is not implemented to assist filled bottle movement.

Assembly 51 is secured to transition turn frame 56 via mounting pins 55 (secured in pin bores formed in the track assembly frame) that permit assembly 51 to rotate about the pins that collectively function as an axle and to permit the lever action of the arms. Back ends of the extension arms are secured to a cross bar 54 that may function as a counterweight to bring the extension arms back to a start position. Assembly 51 may also include a compression spring (not shown) to assist return of assembly 51 to a start position. Each extension arm freely rotates within a dedicated slot in turn 50. When the apparatus is filled with bottles-filled and/or empty-assembly 51 will be pushed down into the slots (so as not to prevent bottle advancement down the track assemblies) by a resident bottle until enough bottles are vended to disengage assembly 51 from any resident bottles and to permit assembly 51 to return to its start position.

The same sequence of components, upper track assembly, transition turn, lower track assembly is used for each successive set of adjacent track assemblies except the lower sloped end of the lowermost track assembly that transitions to an elevator assembly without a transition turn as disclosed below. It should be noted, however, that empty bottle inertia retarder assembly 51 does not have to be incorporated into each transition turn and may only be incorporated into the first transition turn secured to, or extending from, the second topmost track assembly 42.

Referring now to FIGS. 7-13, a double gate assembly comprising a primary gate 28 and a secondary gate 26 provides a means to control the systematic and serial release of a single bottle from a plurality of filled bottles stored on track assemblies 42. The gates include bottle restrictor plates that register against the bottles to arrest movement toward a double elevator disclosed below. The gates function as a primary bottle movement restriction system as the secondary support used to arrest bottle movement is the interaction of the bottles registered against one another. The lead-most bottle held by primary gate 28 is permitted to advance beyond the gates to be secured in and restrained by the elevator. The penultimate bottle, previously registered against secondary gate 26, once released, registers against the elevator based bottle in one embodiment and is prevented from movement into the elevator before primary gate 28 engages the bottle. The third bottle is registered against the second, penultimate bottle and is prevented from movement by the first and second bottles. The same sequence of support exists for each successive bottle. In an alternative embodiment, the penultimate bottle does not reach the lead-most bottle on the elevator and instead is restrained by the primary gate as disclosed for fully herein.

Figure 11:
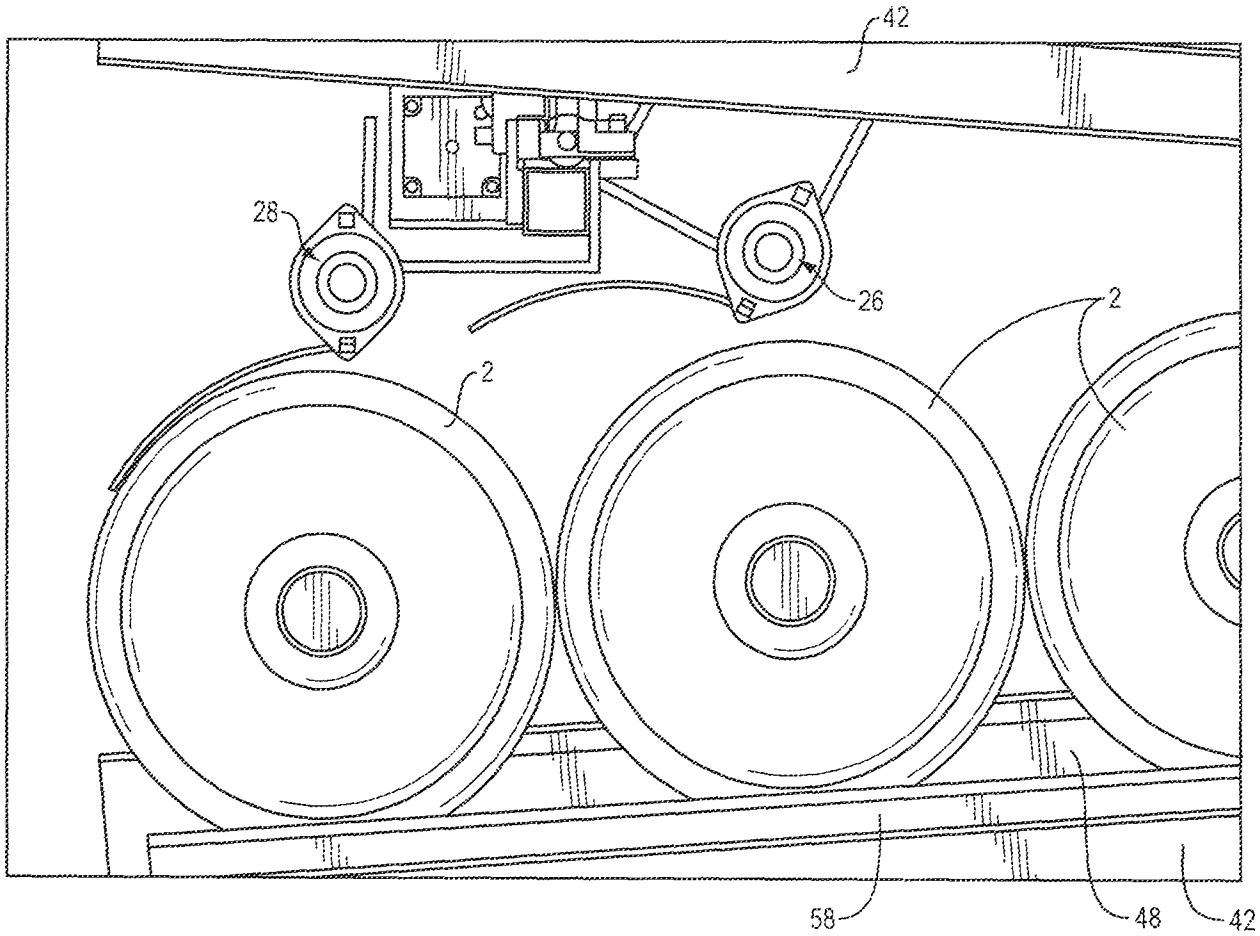
FIG. 11 is a side view of the double gate assembly shown in FIG. 8 with the trailing gate in an open position.

Primary gate 28 in a closed position registers against a leading surface of the second bottle (when the elevator is loaded with the first filled bottle) and prevents the bottle from moving into the elevator position when the elevator is operated and positioned out of the bottle-load, down position. Secondary gate 26 registers against a leading surface of the third bottle and prevents the bottle from moving into the staging position occupied by the current second bottle. As shown in FIG. 11, the sequence of gate operation begins with the substantially simultaneous release of gates 26 and 28 to allow the current third bottle to register freely against the second bottle and the second bottle to register freely against the first bottle. This ensures constant bottle registration once primary gate 28 is opened to permit the current second bottle to roll forward into the elevator. The succeeding bottles are free to roll at the same time as the second bottle, which now occupies the front-most position in the elevator.

Once the elevator is loaded, the gates are lowered into bottle restriction positions in any order or substantially simultaneously. Once properly locked in the closed positions, the elevator can be operated safely to raise the filled bottle to the vend position disclosed below. In this embodiment, the elevator is spaced from primary gate 28 to permit the lead-most bottle and the second bottle to register against one another before the primary gate is lowered between the lead-most bottle and the second bottle to register against the leading edge of the second bottle.

Figure 12:
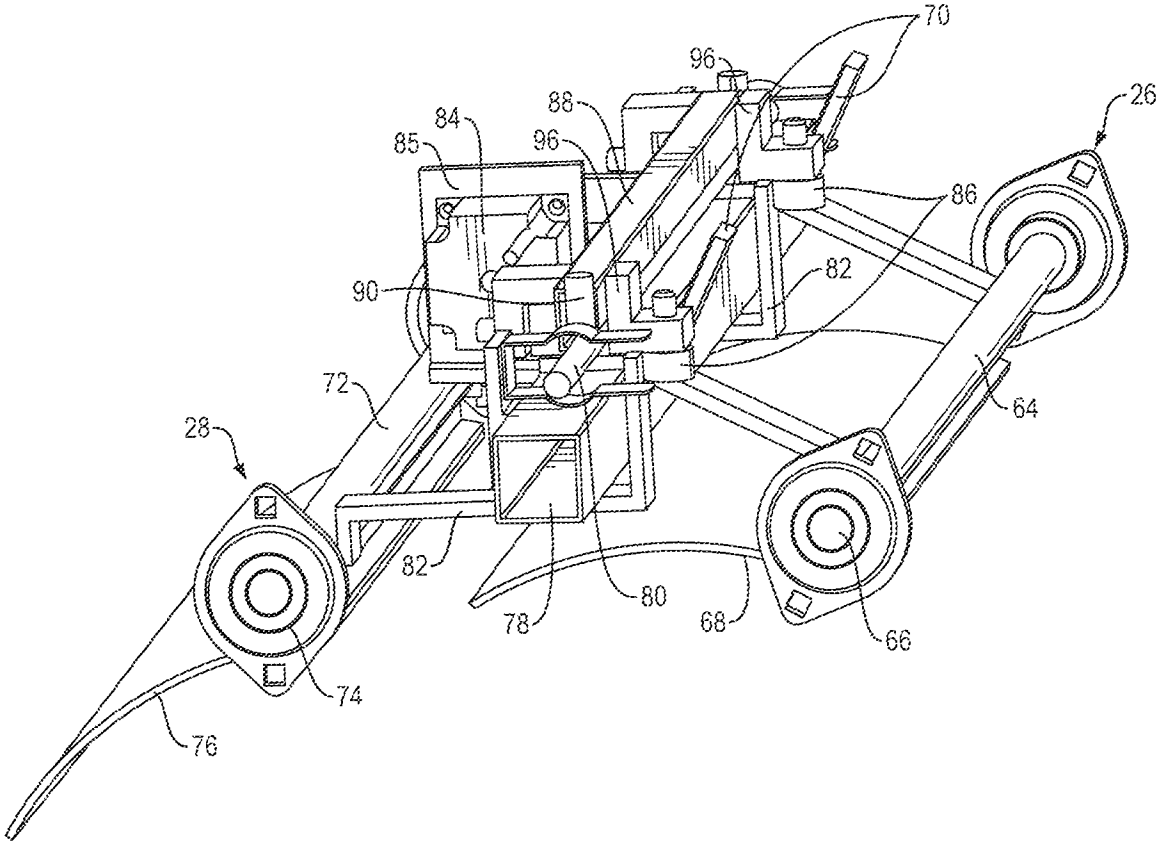
FIG. 12 is a top front perspective view of the double gate assembly shown in FIG. 8.
Figure 13:
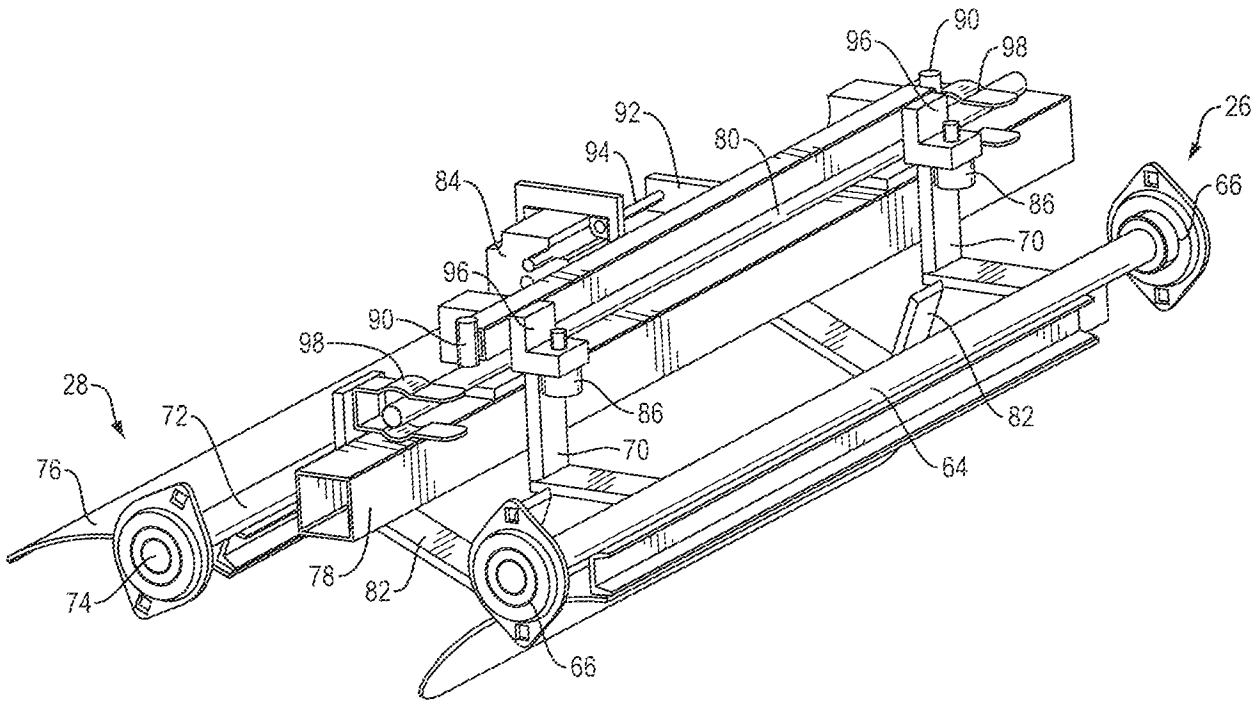
FIG. 13 is a front side perspective view of the double gate assembly shown in FIG. 8.

Referring to FIGS. 12 and 13, secondary gate 26 includes second rod 64 secured between second flanged bearing supports 68. A second flapper 68 is secured to second rod 64 and may be configured to conform to the general circular cross-sectional shape of the bottles. A pair of second angled cam drivers 70 are secured to second rod 64, each proximal to an end of rod 64. When second flapper 68 is in a closed, down position, portions of cam drivers 70 are align with a tube brace 78. A pair of cam holders 96 secured to a slide rail 88 each includes a rotating cam follower 86. Cam followers 86 are spaced from tube brace 78 to receive ends of cam drivers 70 between the brace and the cam followers.

A motor 84 is secured to tube brace 78 via a motor frame 85. A threaded lead screw 94 is secured to the rotor of motor 84 at one end, and to a lead screw block 92 at an opposite end. Lead screw block 92 has a threaded bore to receive lead screw 94. Block 92 is affixed to slide rail 88 via adhesive, welding, mechanical fasteners and/or the like. Operation of motor 84 causes translation of lead screw block 92 along lead screw 94, which causes attached slide rail 88 to translate laterally along tube brace 78. Movement of rail 88 in turn causes lateral movement of cam followers 86. With second came drivers 70 in a down position in alignment with brace 78, lateral movement of cam followers 86 over drivers 70 locks secondary gate 26 in a closed down position.

An alignment rod 80 is secured to a bottom of slide rail 88 and has two slide rail stops 90 extending upwardly, each at an end of slide rail 88. A pair of alignment clips 98 secured proximate to opposing lateral ends of tube brace 78 have opposing radiused portions that form a partial circle that substantially conforms to the cross-sectional shape of rod 80. Rod 80 is dimensioned to slide freely within the raduised portions that function to keep the rod 80/slide rail 88 subassembly aligned with the longitudinal axis of tube brace 78. Stops 90 register against clips 98 to limit the lateral displacement of slide rail 88. In one embodiment, in one extreme lateral position in which one of the stops is engaged to one of the clips, cam followers 86 roll over and register against secondary cam drivers 70 to lock secondary gate 26 in a down, bottle registration position. In an opposite extreme lateral position, cam followers 86 are separated from drivers 70, which permit free rotation of secondary flapper 68.

Primary gate 28 includes primary rod 72 secured between primary flanged bearing supports 74. A primary flapper 76 is secured to primary rod 72 and may be configured to conform to the general circular cross-sectional shape of the bottles. A pair of primary angled cam drivers 82 are secured to primary rod 72, each proximal to an end of rod 72. When primary flapper 76 is in a closed, down position, portions of primary cam drivers 82 are align with tube brace 78. Cam followers 86 receive ends of primary cam drivers 82 between the brace and the cam followers.

In one embodiment, in one extreme lateral position in which one of the stops is engaged to one of the clips, cam followers 86 roll over and register against primary cam drivers 82 to lock primary gate 26 in a down, bottle registration position as shown in FIG. 12. In an opposite extreme lateral position, cam followers 86 are separated from drivers 82, which permit free rotation of primary flapper 76. The orientation of the primary and secondary cam drivers are set to provide alternating lock positions. When one gate is locked in a down position, the other gate is unlocked to allow unfettered rotation caused by bottle movement down toward the elevator.

Referring now to FIGS. 43, 44, 57, 58, 61 and 62, a dual purpose, double elevator assembly shown generally as 190 functions to bring empty bottles to the top track assembly 42 and to retrieve and deliver filled bottles from the lowest track assembly to customers at a common door. More particularly, a bottom elevator 30 is configured to receive filled bottles from the bottom track assembly 42 and to deliver the bottle to the common vending door. A top elevator 192, secured to the same housing as bottom elevator 30, is configured to receive empty bottles deposited on the elevator by customers through the common vending door and to deliver the empty bottles to the top track assembly 42 for storage until removed by the vendor.

As shown in the referenced figures, elevators 30 and 192 are secured to elevator housing 191. Housing 191 is essentially a two-sided structure with walls joined in a substantially 90° orientation. The walls may be formed from a single sheet of—illustratively—aluminum, steel, plastic or polymer material creased to form the noted angle, or may be formed from two sheets joined together to form a corner. Lower elevator 30 is secured to a lower end of housing 191 via welding, mechanical fasteners, adhesives and the like. The bottle support surface of elevator 30 is formed with two sloped surfaces 256 and 258 converging downwardly in the substantial center of the elevator to urge a resident bottle to the center of the support surface. This ensures the bottle will remain centered and stable during elevator operation to minimize torsional forces from developing, which may happen if the bottle locus in the elevator is not stabilized. The support surface configuration also assists a customer with bottle removal as the bottle will remain centered while being extracted from the elevator and vending apparatus.

Figure 72:
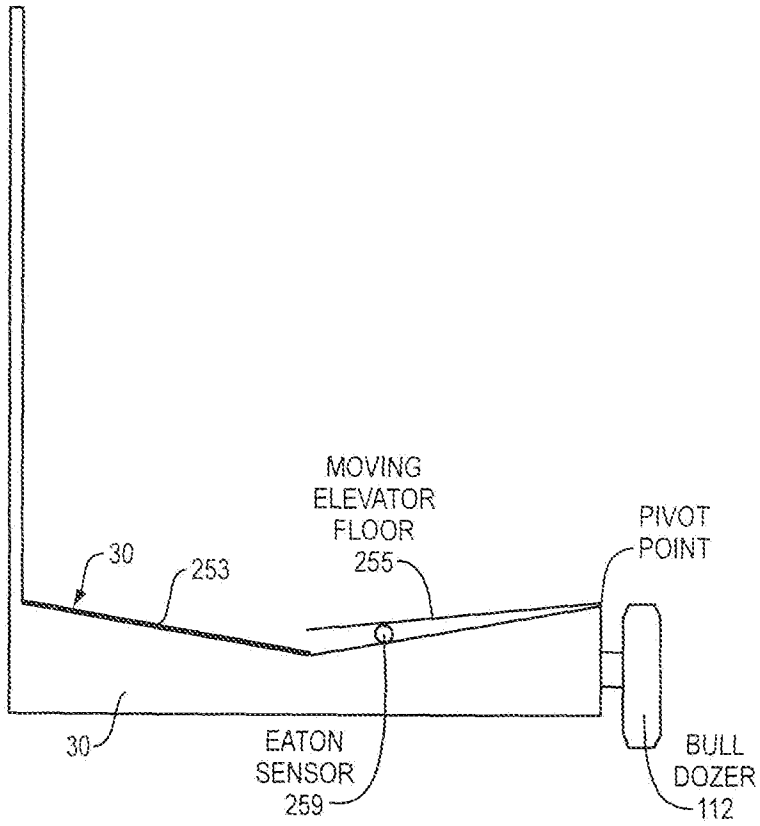
FIG. 72 is a side elevational view of a bottom elevator with a pressure sensor according to a further embodiment of the disclosure.

A bore 254 may be formed in one of the two sloped surfaces to receive components of a photosensor, infrared sensor, or mechanical pressure actuated sensor (the latter as shown in FIG. 72). A corresponding component of the photosensor or infrared sensor is positioned on a bottom surface of upper elevator 192. The sensor detects the presence of a filled bottle 2 when the bottle is present on elevator 30, which causes a beam created between the sensor components to be broken the activation of which causes an electronic impulse signal to be sent to the controller for processing.

Figure 71:
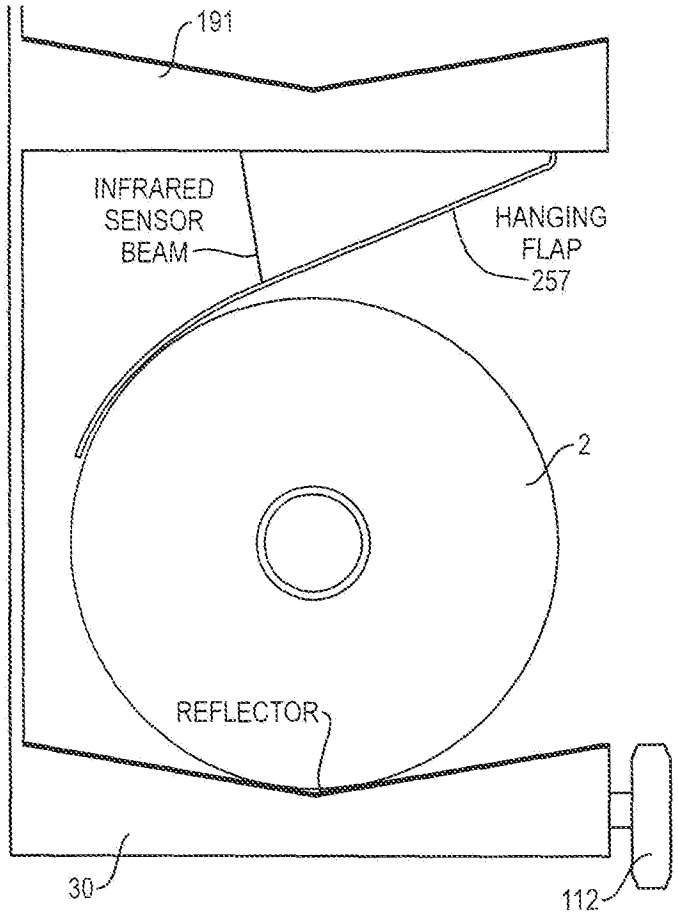
FIG. 71 is a side elevational view of the dual elevator shown in FIG. 71 with the flap rotated by a filled bottle.
Figure 70:
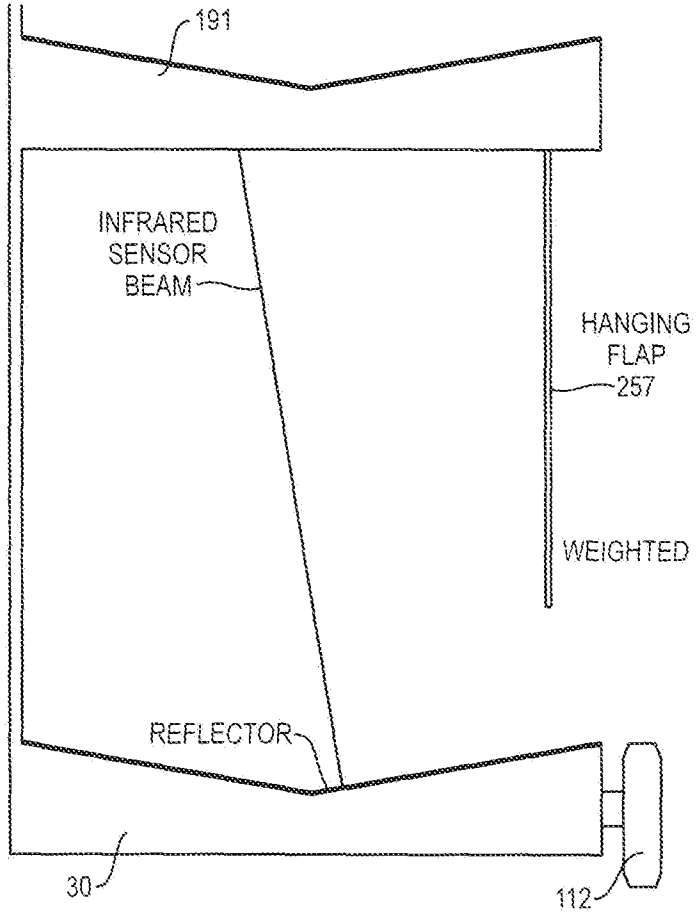
FIG. 70 is a side elevational view of a dual elevator with a sensor flap according to one embodiment of the disclosure.

In an alternative embodiment, a sensor flap 257 (shown in FIGS. 70 and 71), is secured to the bottom of top elevator 192 and hangs down above lower elevator 30. Flap 257 is made from a flexible, opaque material to ensure the sensor beam is broken in the event a new transparent bottle does not break the beam when a photosensor is used. When a bottle rolls onto the elevator, the bottle registers against flap 257 and flexes it so that the flap intersects and breaks the light beam emitted from the photosensor. This ensures a positive, accurate sensing of the presence of a bottle on the bottom elevator.

Figure 73:
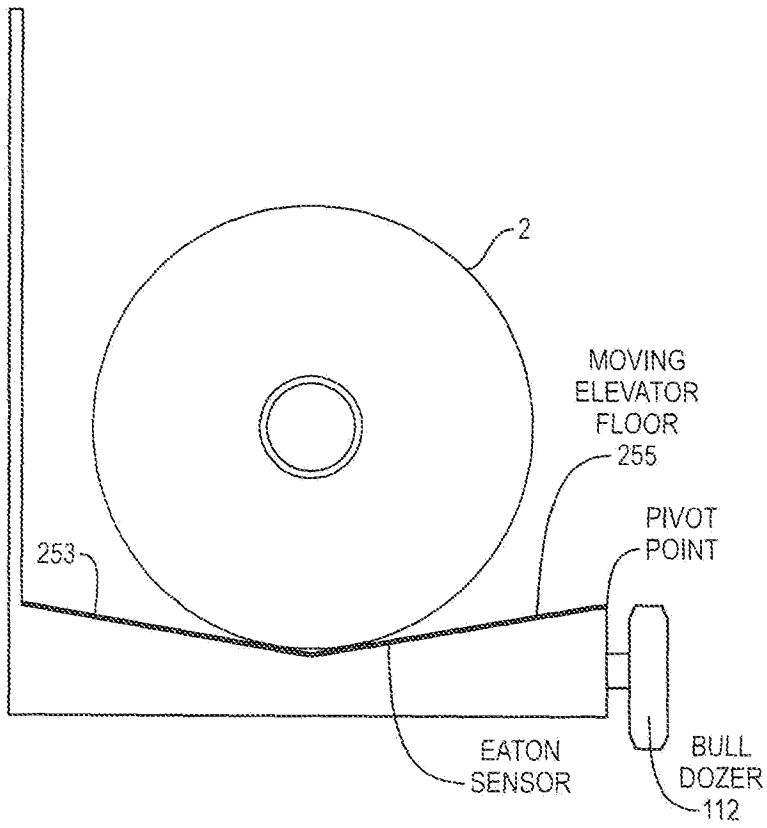
FIG. 73 is a side elevational view of the bottom elevator shown in FIG. 72 with the sensor depressed by a filled bottle.

In an alternative embodiment, as shown in FIGS. 72 and 73, a mechanical pressure sensor 259 is used in conjunction with a hinged elevator base segment 255 to detect the presence of a filled bottle. Sensor 259 is placed under an inward edge of base segment 255 and configured to remain in an extended position when segment 255 registers against the sensor's plunger absent the presence of a filled bottle 2. A bottle receiving end of segment 255 is hinged at a bottle receiving end of elevator 30 to permit rotation onto sensor 259. Once a bottle rolls onto segment 30, the weight of the bottle overcomes the resistive force of sensor 259 that is triggered as a result. This leads to the sending of a signal to the processor that a bottle is resident on elevator 30 so as to proceed with the vend sequence. It should be understood that any combination of photosensors, infrared sensors and/or mechanical sensors (e.g., trip sensors) including the orientation of the sensors may be used to detect the presence or absence of bottles on either elevator, and that any combination is within the contemplation of the disclosure.

Upper elevator 192 has a dimensional profile similar to lower elevator 30. Like lower elevator 30, upper elevator 192 includes a bottle support surface formed from two converging sloped surfaces, fixed segment 220 and rotating segment 194 that form a "v" shape in cross section to form a trough. Unlike the sloped support surface of lower elevator 30, support surface 194 has a hinged joint 224 located at the converging point of the two sloped surfaces. A support surface leverage plate 193 is secured under support surface 194 and attached to surface 294 with springs and rotatable about an axis, which may be offset from the center of plate 193. One end of plate 193 is positioned below the hinged joint. A second end extends beyond the right side edge of elevator 192. Alternatively, extension trip tabs 226 may be formed on, or extend from the right side edge of elevator 192.

Figure 62:
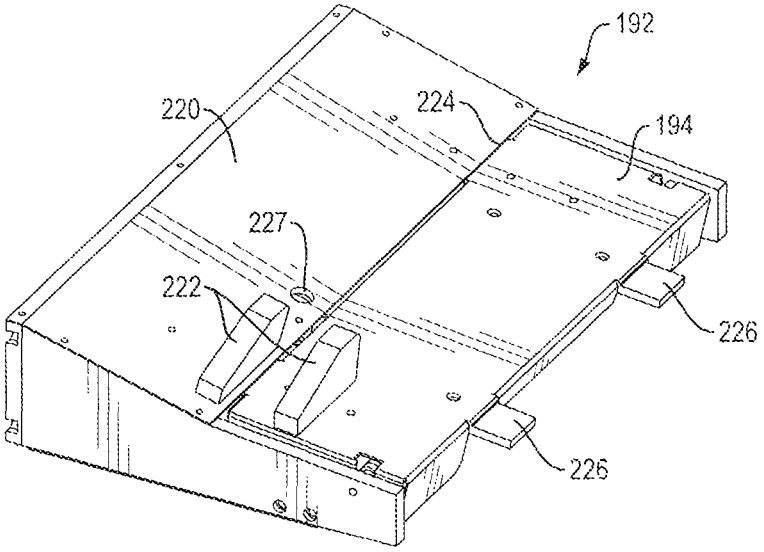
FIG. 62 is a top front perspective view of a return bottle upper elevator with the release gate in an down position according to the embodiment shown in FIG. 61

When elevator 192 is elevated toward the upper track assembly 42, the top surface of the second end, or trip tabs 226 contacts a bottom surface of a leading edge of upper track assembly 42. This compresses the underlying springs and causes leverage plate 193 to rotate about its hinged anchor which causes the right end of the plate to lower into a ramp formation with the fixed slop segment 220 that slopes downwardly from left to right as shown in FIG. 62. The slope urges a resident bottle to roll by gravity to the right and onto the topmost track assembly 42. When the elevator is returned to the bottle-receiving position behind a vend door (disclosed more fully below), the spring-loaded plate 193 returns to a standby position, which allows the sloped joint of support surface 194 to re-form and await the next bottle return.

Figure 57:
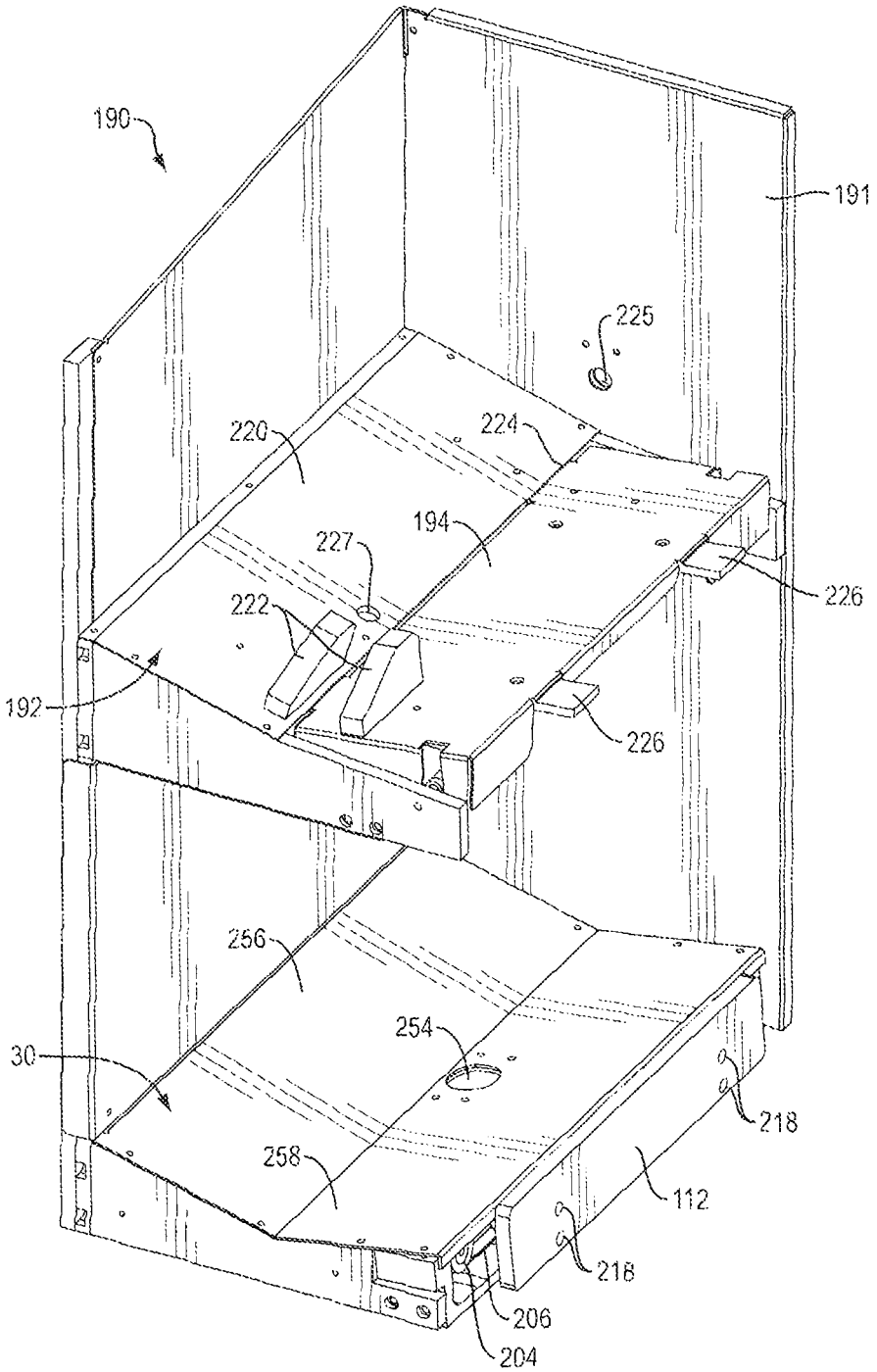
FIG. 57 is a top front perspective view of a double elevator according to an embodiment of the disclosure.
Figure 61:
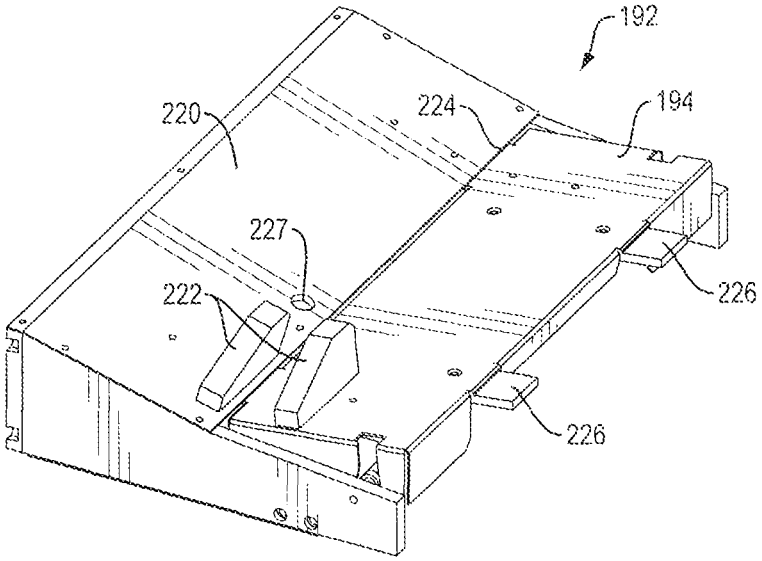
FIG. 61 is a top front perspective view of a return bottle upper elevator with a release gate in an up position according to an embodiment of the disclosure.

As shown in FIGS. 57, 61 and 62, one or more bottle stop blocks 222 may be secured to a front edge of top elevator 192 to prevent bottles placed on the elevator from migrating forward into the apparatus front wall when the elevator is being operated, and also to facilitate proper bottle alignment in the elevator for delivery to the topmost track assembly 42. An optional top elevator bore 227 may be formed on the stationary segment of the elevator to provide a mount for a photosensor and/or an infrared sensor to detect the presence of an empty bottle 3. It should be understood other sensors, e.g., pressure sensors may be used in place of, or along with, the photosensors. A second top elevator sensor bore 225 may be formed in a wall of housing 191 to receive an additional sensor to detect the presence of an empty bottle. The combined sensors may be used to not only detect the presence of a bottle, but to detect the size of the bottle as well based on the location of the sensors. Different sized bottles will or will not trigger the sensors as one means to determine if a vendor approved bottle has been deposited on the elevator. The vendor can adjust the sensors to identify specific sized bottles as vendor approved.

Figure 74:
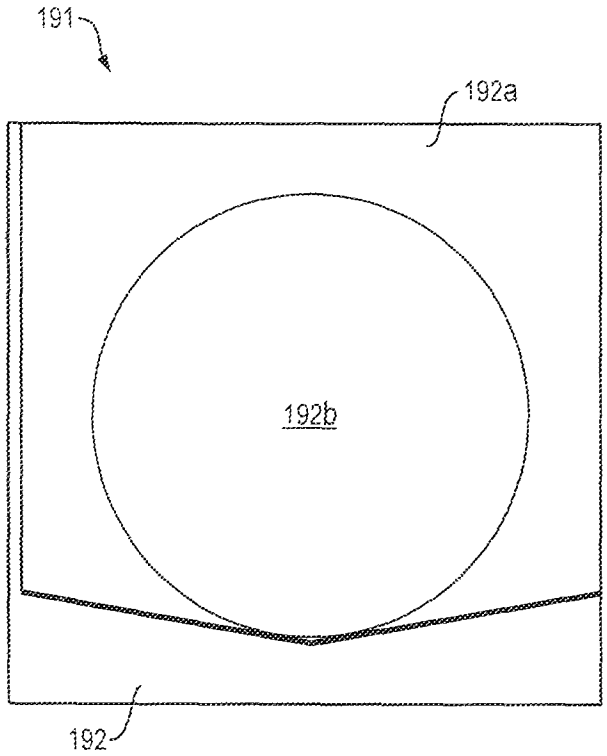
FIG. 74 is a side elevational view of a top elevator with a bottle size insert according to one embodiment of the disclosure.

It is within the contemplation of the disclosure for different types of sensors to be used, illustratively, photosensors, infrared sensors, mechanical pressure sensors, trigger sensors and the like. The configuration of the elevator and other associated components of the apparatus are configured to receive 3 and 5 gallon bottles and may also receive 4 gallon bottles without credit as a means to recycle 4 gallon bottles should such bottles not be vendor approved. Other sized bottles may also be received in the apparatus by reconfiguring the dimensions of the sensor locations and track assembly components as should be understood by one of ordinary skill in the vending art. An optional bottle size insert 192*a* (shown in FIG. 74), may be secured to a front edge of upper elevator 192 to provide a mechanical means to restrict the size of bottles to be returned. Insert 192*a* has portions defining a cutout 192*b* dimensioned to represent the cross-sectional dimensions of an approved bottle so as to permit the insertion of vendor approved bottle sizes. Different inserts with different cutout sizes may be used to accommodate different return bottle size preferences.

Figure 42:
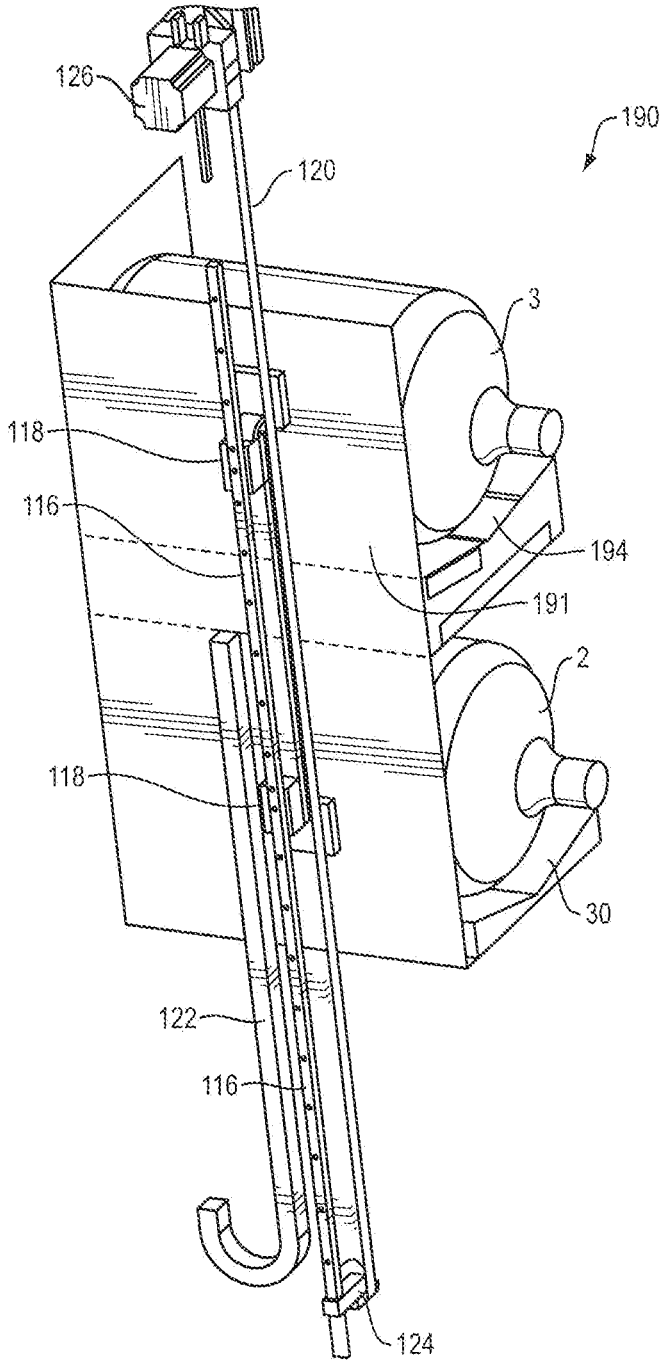
FIG. 42 is a back side perspective view of a double elevator with an empty bottle in a top elevator and a filled bottle in a bottom elevator according to the embodiment of the disclosure shown in FIG. 34.
Figure 43:
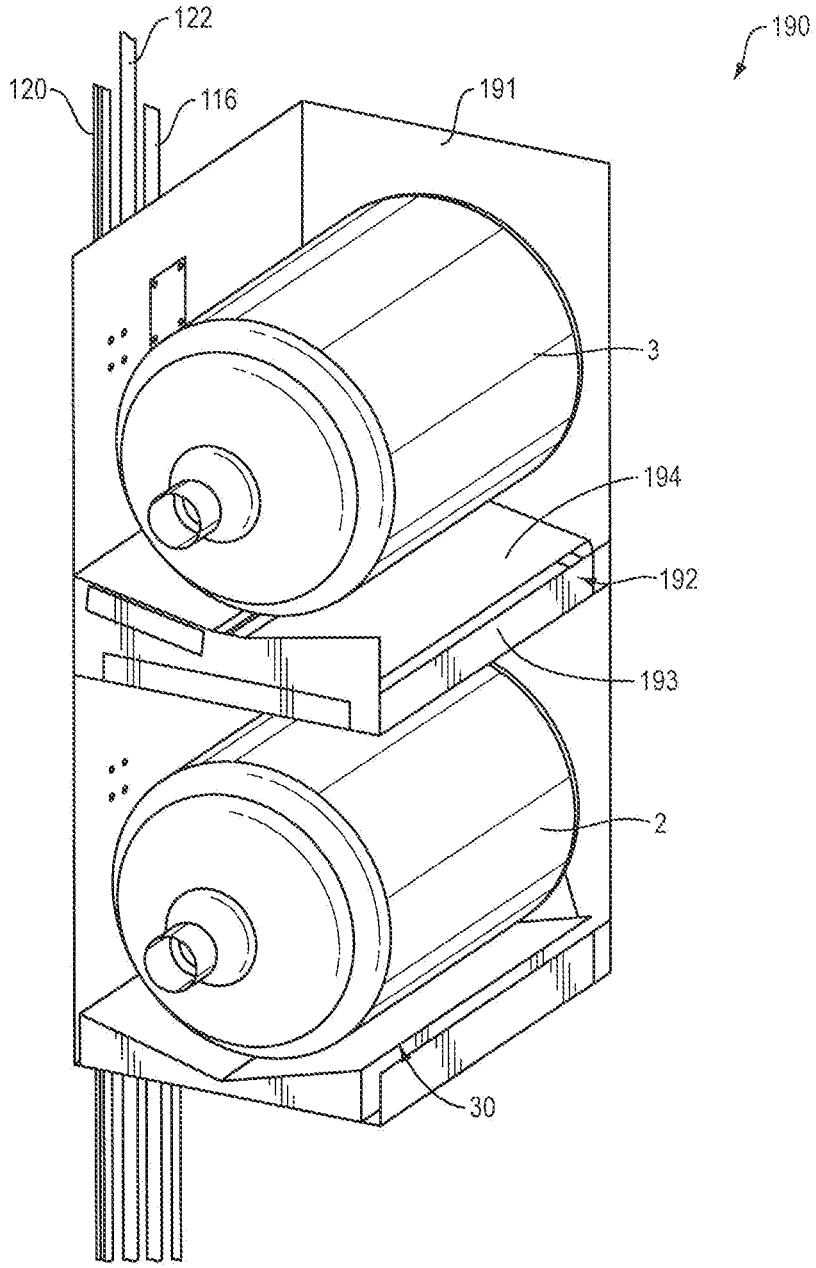
FIG. 43 is a side front perspective view of a double elevator with an empty bottle in a top elevator and a filled bottle in a bottom elevator according to the embodiment of the disclosure shown in FIG. 34.
Figure 44:
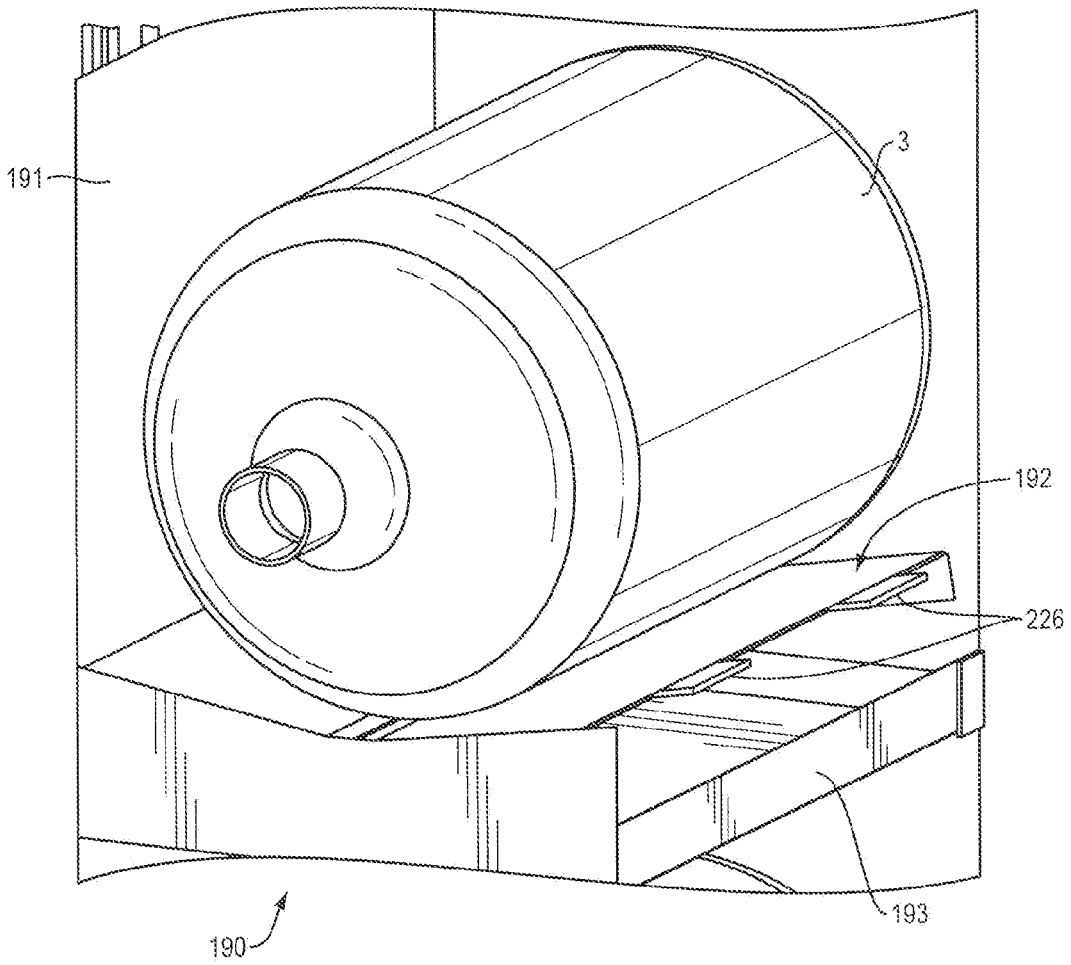
FIG. 44 is a front side perspective view of a top elevator of a double elevator according to the embodiment of the disclosure shown in FIG. 34.

As shown in FIG. 42, elevator assembly 190 is secured to a vertical elevator track assembly including a support shaft 116. A pair of slide bearings 118 secured to a back of elevator housing 191 has portions defining slots that secure to shaft 116 in sliding engagement. A belt or chain 120 is secured to housing 191 at one end and a second end is placed over or within a geared or smooth pulley secured to the shaft of an elevator motor 126. A flexible cable cover 122 (that may be comprised of articulating chain links) protects the wire components of the apparatus from damage due to movement of the elevator. Activation of motor 126 moves elevator assembly 190 upwardly or downwardly depending upon the rotational movement of the motor shaft. Motor 126 is controlled by the apparatus' central processor.

Figure 59:
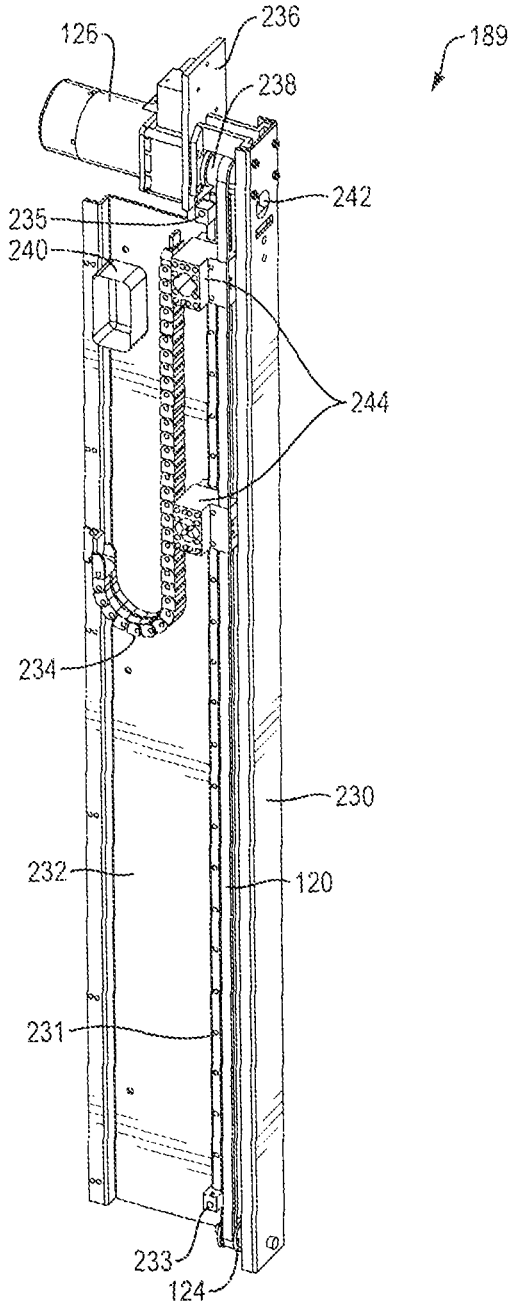
FIG. 59 is a top back perspective view of a dual elevator motor and lift assembly according to an embodiment of the disclosure.

In an alternate embodiment shown in FIG. 59, a vertical elevator track assembly shown generally as 189 includes a lift plate 232 that supports the components of the lift assembly. The lift plate is secured to the frame of the apparatus via mechanical fasteners, welding and the like. An end plate 230 is secured to a side of plate 232 to provide an attachment surface for additional elements of the assembly. Elevator motor 126 is secured to a motor frame mount plate 236 formed or attached to the top end of plate 232. A top belt gear 238 is secured to an end of the motor shaft via key, friction fit and the like. Gear 238 transfers the motor torque to move elevator assembly 190. Gear 238 may be formed with gear teeth to provide a mechanical enhancement to maximize transfer of the motor torque.

A bottom belt gear 124 is secured about an axle, which in turn is secured to end plate 230 proximal to, or at a bottom end of the plate. Gear 124 may also be formed with teeth that correspond in size to the teeth of gear 238. Belt 120 may include ribs or teeth that correspond to the teeth of gears 238 and 124 to improve torque transfer and to minimize belt slippage. Belt 120 is secured about the two gears to provide the means to move elevator assembly 190 along plate 232.

To secure elevator assembly 190 to belt 120, a pair of mounting blocks 244 have portions defining belt receiving slots. The slots may be formed with ribs that correspond to the dimensions of the belt ribs to provide mechanical engagement to the belt so as to arrest the position of the blocks on the belt. Belt 120 is positioned within the block slots and mechanical fasteners and/or the like are used to compress portions of the blocks onto belt 120. This secures the blocks to the belt so as to maintain the relative spacing of the blocks on the belt as the belt moves along the path defined by the positioning of gears 238 and 124.

A guide track 231 is secured to plate 232 in a substantially parallel orientation to belt 120. Portions of blocks 244 are dimensioned and configured to slidingly engage track 231 and to ride on the track as belt 120 moves elevator assembly 190. A bottom stop 233 acts as a mechanical stop for the downward most position of the elevator assembly. A top stop 235 provides a mechanical stop for the upward most position of the elevator assembly. Selective positioning including stop positions of elevator assembly 190 may also be controlled via light sensors (e.g., via sensor port 242), mechanical trip sensors, processor-controlled motor activation and deactivation and the like.

Appended to plate 232 is wire housing 234 that houses the wire components of the elevator assembly. Housing 234 may include a series of interconnected links as shown, or may be formed from flexible material to permit movement with the elevator. Housing 234 protects the wire elements from damage as the elevator assembly moves along it predetermined course. An outlet box 240 may also be formed on, or secured to, plate 232 to receive an outlet receptacle and the like to provide electricity for the electrical components.

It should be understood that other means of moving the elevator are within the contemplation of the disclosure. As an illustrative example, linear actuators may be used to move the dual elevator to the necessary positions to receive empty bottles and move them for deposit on the track assemblies, and to receive filled bottles and move them to a vend position. Any actuator used should be controllable by the apparatus' processor and controller.

In a yet further alternate embodiment of the apparatus, as shown in FIG. 1, a return bottle cradle 32 is substituted for upper elevator 192. Cradle 32 is secured to a rotatable shaft. The shaft is secured to elevator assembly 190 via a pair of flanged bearings that permit rotation of cradle 32. A dedicated motor, (not shown) rotates cradle 32 from a start bottle support position (the position used to deposit a bottle in the vending apparatus), to an upwardly position that results in a resident empty bottle being urged onto the uppermost track assembly 42 when the elevator is raised to the bottle deposit position.

In a yet further embodiment as shown in FIGS. 34-41 and 54, a vending apparatus shown generally as 10''' includes a single gate assembly 26' (shown in FIGS. 63 and 64) and a dual purpose, double elevator shown generally as 190' that includes a filled bottle inertia restrictor, shown generally as 110, to control movement of a filled bottle onto the bottom elevator. Gate assembly 26' is constructed essentially the same as gate 26 disclosed herein. The gate's function is also similar to the function of primary gate 26 of the embodiment shown in FIG. 2. Unlike the other embodiment, gate assembly 26' is coordinated with the function of restrictor 110 to control the final stage of bottle delivery to lower elevator 30'''.

Figure 64:
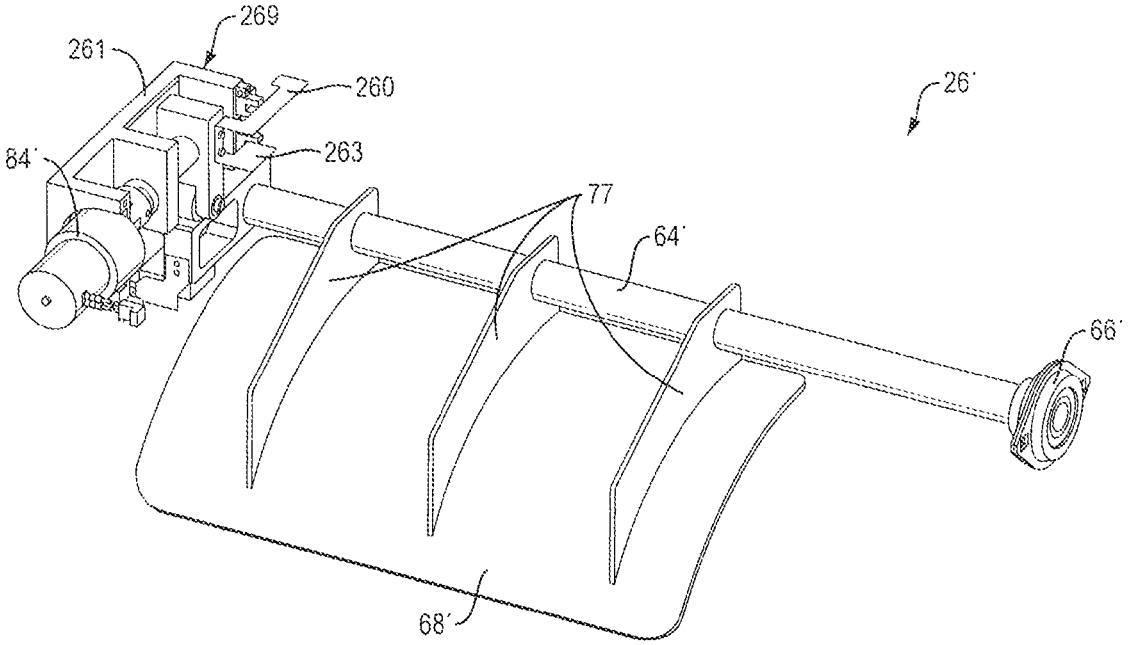
FIG. 64 is a top side perspective view of a gate and gate lock assembly according to an embodiment of the disclosure.
Figure 65:
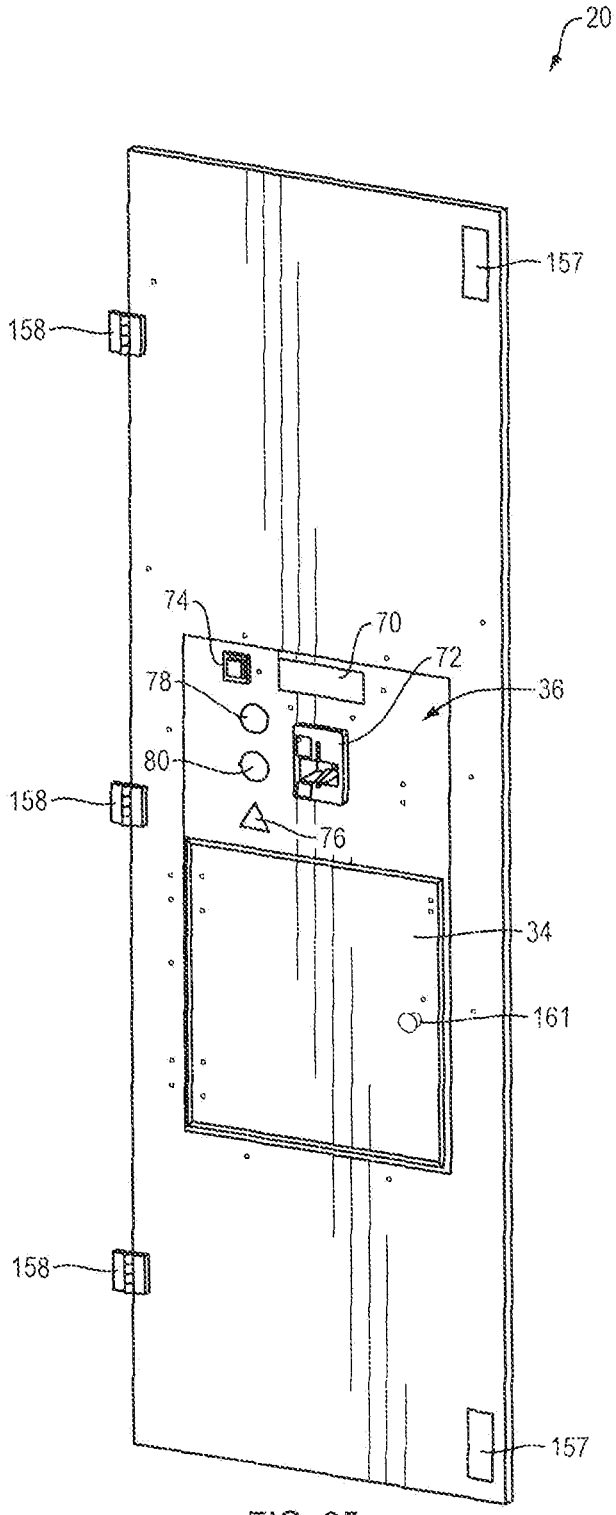
FIG. 65 is a front perspective view of a vending apparatus elevator access door with user interface and bottle return door according to an embodiment of the disclosure.

In this embodiment as shown in FIG. 64, single gate assembly 26' includes a flapper rod 64' one end of which is secured to a bearing assembly 66' that permits free rotation of rod 64'. Bearing 66' is secured to a mounting plate 38 secured to the apparatus frame. A flapper 68' having a curved profile that conforms to the general perimeter shape of a bottle 2, has an end secured to flapper rod 64'. At least one, and optionally a plurality of, flapper ribs 77 may be formed or secured to a back side of flapper 68' to provide added rigidity to better accommodate the forces applied to flapper 68' by a train of filled bottles 2.

A second end of flapper rod 64' is secured to a second bearing assembly (not shown) positioned below a flapper motor assembly shown generally as 269. The second bearing assembly permits free rotation of flapper rod 64' in similar fashion to bearing assembly 66'.

Figure 63:
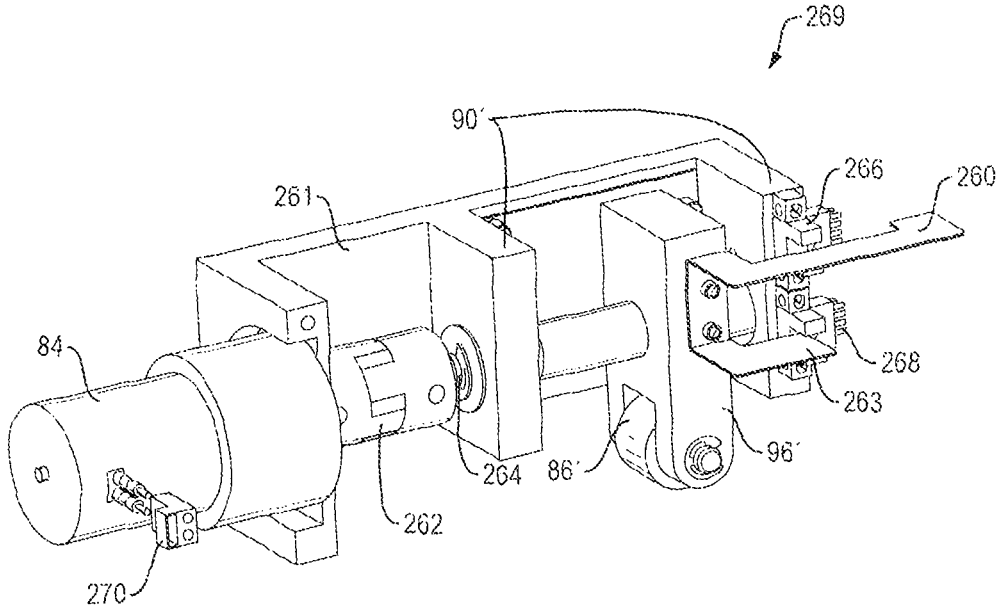
FIG. 63 is a top front perspective view of a motor and gate lock assembly according to an embodiment of the disclosure.

Referring now to FIG. 63, flapper motor assembly 269 includes a motor assembly frame 261 configured to secure the components of the motor assembly used to unlock and lock the rotational orientation of flapper 68. One portion is configured to receive and secure the body of flapper motor 84'. Other portions define bores to receive the motor shaft and shaft accessories. Connected to a portion of the motor shaft proximal to the motor housing is a coupler 262. Coupler 262 includes an inner rubber sheath segment that permits slight (about +/−5°) misalignment and angular deviation from the shaft linear axis of the distal components of the motor shaft assembly when moving between locked and unlocked positions.

Secured to a distal end of the motor shaft is a wheel block 96' that includes a shaft having a threaded bore that corresponds to the threads of the shaft. A flapper locking wheel 86' is secured to block 96' and is configured to roll onto and off an end of flapper rod 64' to lock flapper 68' in a down, bottle arresting position, when wheel 86' is positioned over rod 64'. The extreme positions are controlled electronically with sensors 266 and 263. A first sensor 266 is triggered when an end of a long tab 260 having an enlarged distal end engages sensor 266. The distal extension on tab 260 completes a circuit when it passes through a slot in sensor 266. In the illustrated configuration, tab 260 is configured to position the flapper stop assembly in the flapper unlocked position that permits bottles via gravity derived inertia, to pass the flapper by rotating the flapper up and away from the bottles path of travel towards elevator 30.

A second sensor 263 is triggered when a short tab 263 engages the sensor by completing a second circuit when it passes through a slot in the sensor. In the illustrated configuration, tab 263 is configured to position the flapper stop assembly in the flapper locked position that releasably locks the flapper in a down, bottom arrest position. It is within the contemplation of the disclosure for the stops to be defined by alternative mechanical stops, trip sensors, infra-red or other light sensors and the like.

Figure 34:
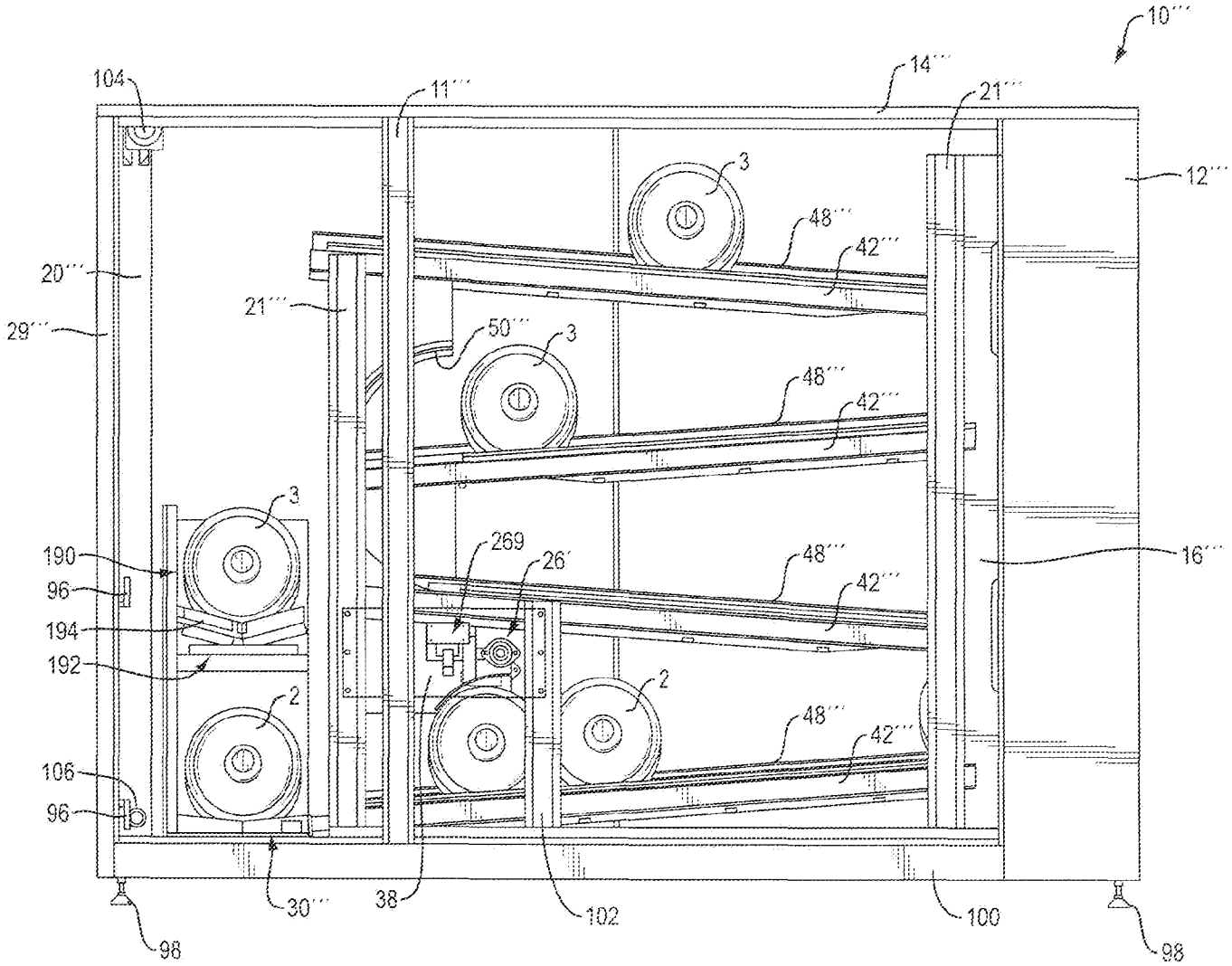
FIG. 34 is a front elevational view of a vending/return apparatus with a double elevator in a bottom position and loaded with an empty bottle in a top elevator and a full bottle in a bottom elevator according to a further embodiment of the disclosure.
Figure 35:
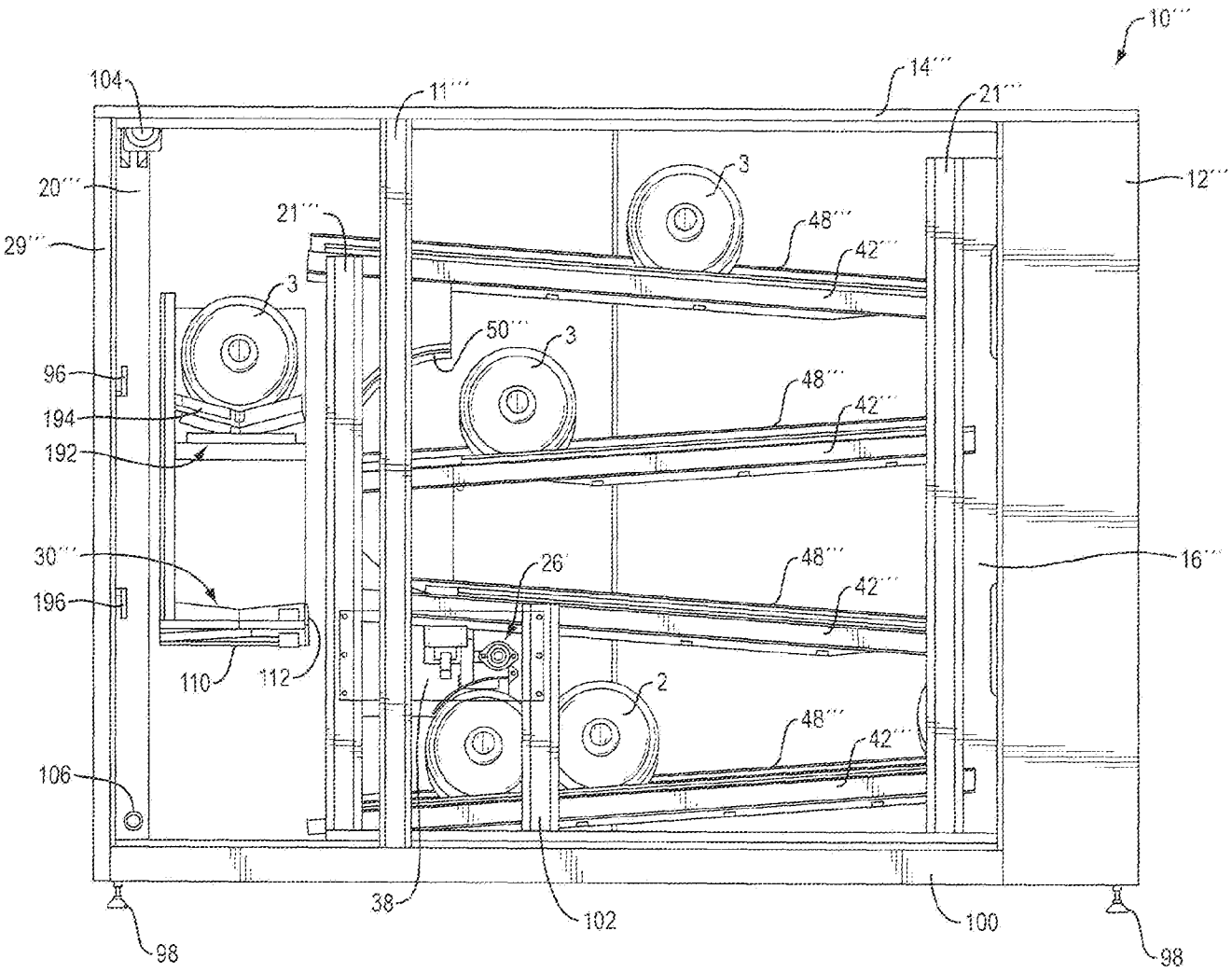
FIG. 35 is a front elevational view of the vending/return apparatus shown in FIG. 34 with the double elevator in a transitional position after removal of a full bottle from the bottom elevator.
Figure 36:
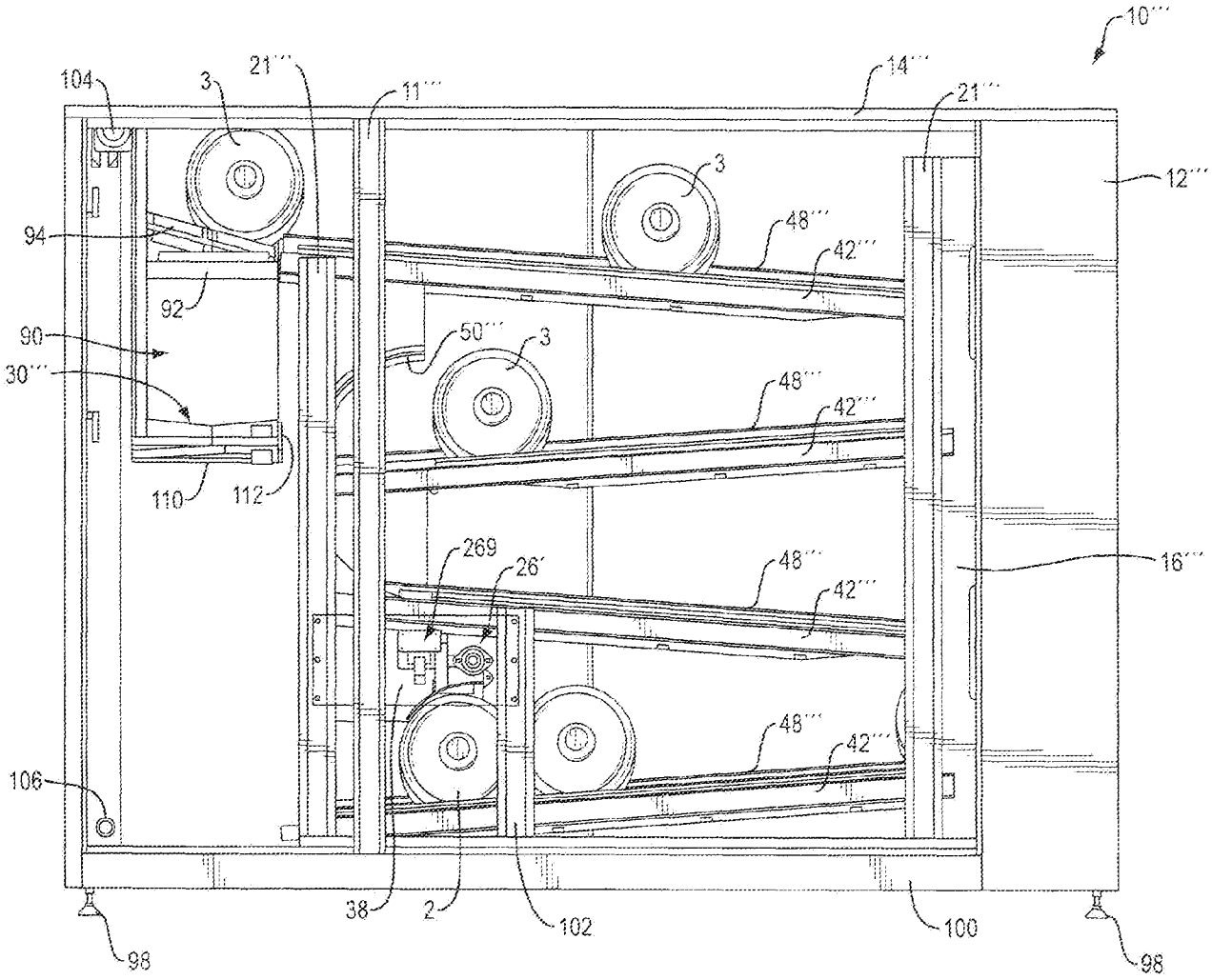
FIG. 36 is a front elevational view of the vending/return apparatus shown in FIG. 34 with the double elevator in a top position for delivery of an empty bottle to the top track assembly.
Figure 37:
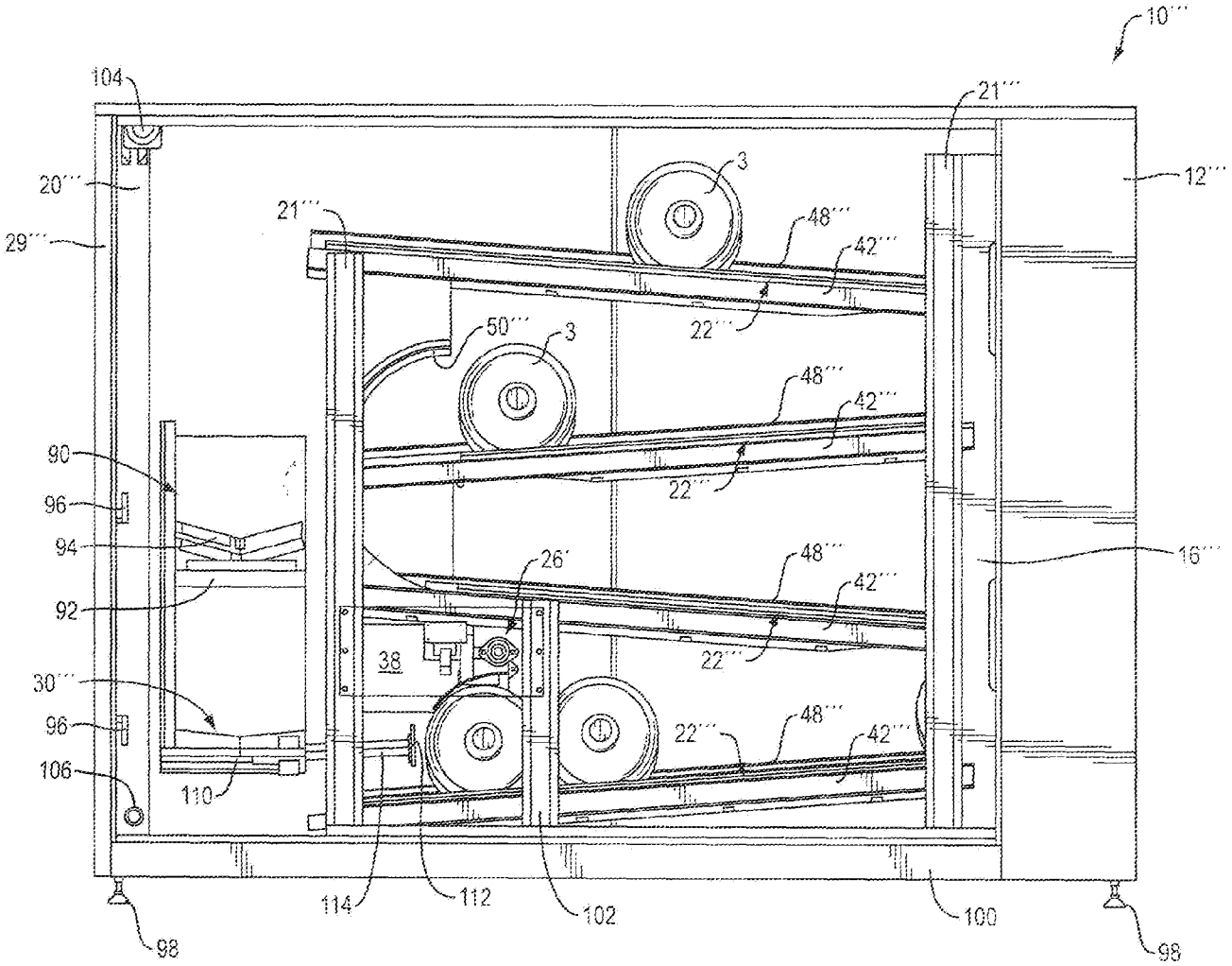
FIG. 37 is a front elevational view of the vending/return apparatus shown in FIG. 34 with the double elevator in a bottom stand-by transitional position with a bottle retrieval arm in an extended position to receive and control movement of a filled bottle onto the bottom elevator.

FIG. 34 shows vending apparatus 10''' with elevator assembly 190 supporting an empty bottle 3 and a filled bottle 2 in a down, empty bottle deposit position. The filled bottle will have been deposited on lower elevator 30''' prior to the empty bottle being deposited on upper elevator 192. Once an empty bottle has been placed on upper elevator 192, the central processor activates elevator motor 126 to raise elevator assembly 190 to a bottle deposit position as shown in FIG. 35. As elevator assembly 190 reaches the bottle deposit position, trip tabs 226 (shown in FIG. 58) secured to, or extending from, a right edge of leverage plate 193 register against a bottom edge of uppermost track assembly 42 and urge bottle support 194 in a downward direction to form a ramp so as to permit the resident empty bottle to roll via gravity onto track assembly 42 as shown in FIG. 36. Once the empty bottle has been released from the elevator, or if no return bottle is deposited on the elevator after a prior filled bottle vend transaction, the central processor activates elevator motor 126 to lower the elevator toward the filled bottle retrieval position as shown in FIG. 37.

Figure 38:
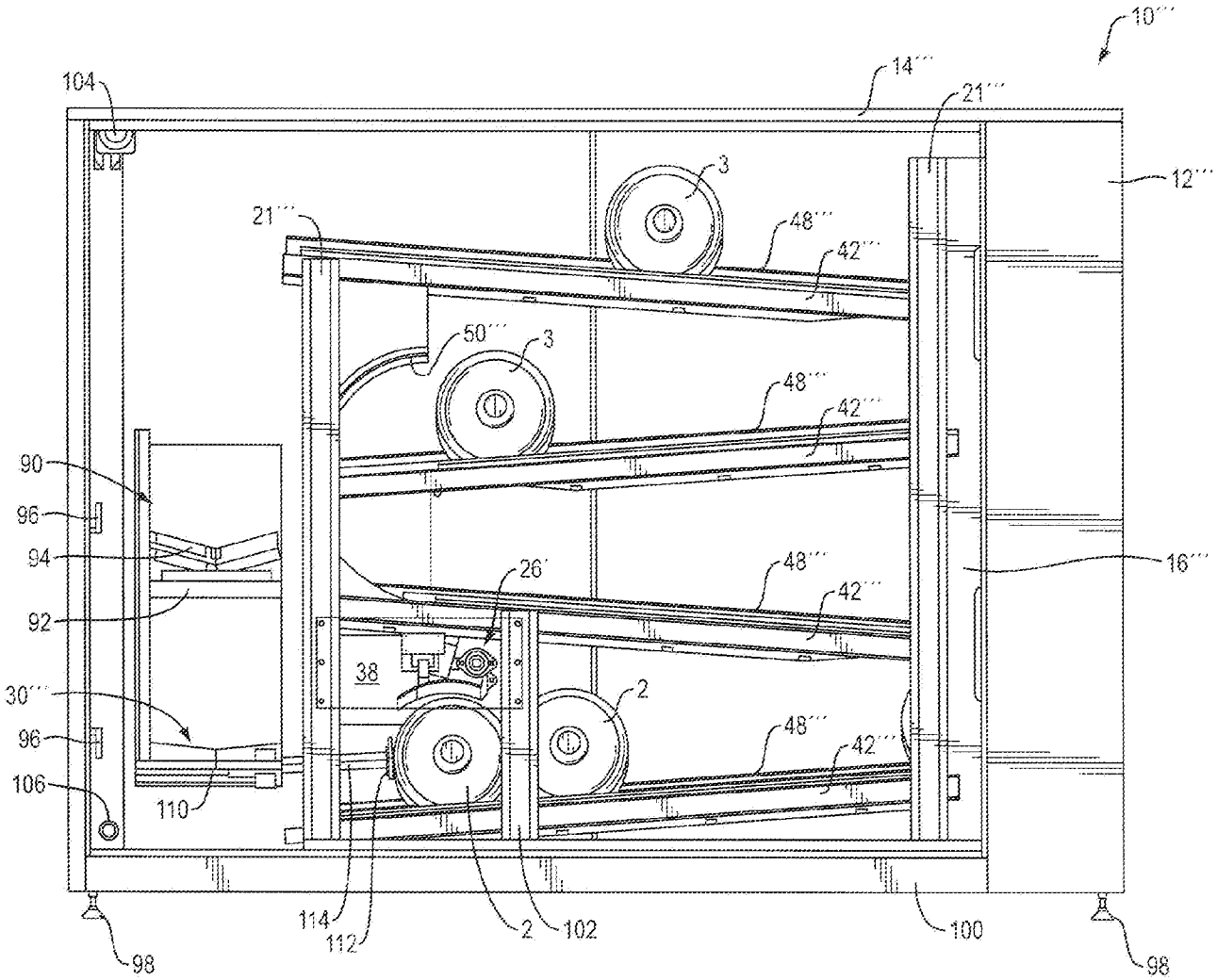
FIG. 38 is a front elevational view of the vending/return apparatus shown in FIG. 34 with the double elevator in a bottom stand-by transitional position with the bottle retrieval arm extended and registered against a filled bottle with a bottle retention gate in an open position.

As elevator assembly 190 approaches the filled bottle load position, it stops short of the lowest position to permit restrictor 110 operation via activation by the central processor. One or more restrictor arms 114 having a bottle registration plate 112, secured to arms 114 via mechanical fasteners or the like, extends from the restrictor as shown in FIG. 37. As arms 114 reach their full extension, the central processor activates motor 84 to unlock gate 38''' as shown in FIG. 38. This permits the lead most filled bottle 2 to roll toward plate 112. The remaining filled (and resident unfilled bottles) all roll the same incremental distance the lead most bottle rolls. Each bottle stays in substantial contact with the bottles on either side. This ensures the entire load of bottles roll down the track assemblies toward elevator assembly 190 in a controlled manner so as not to compromise the integrity of any of the bottles.

Figure 39:
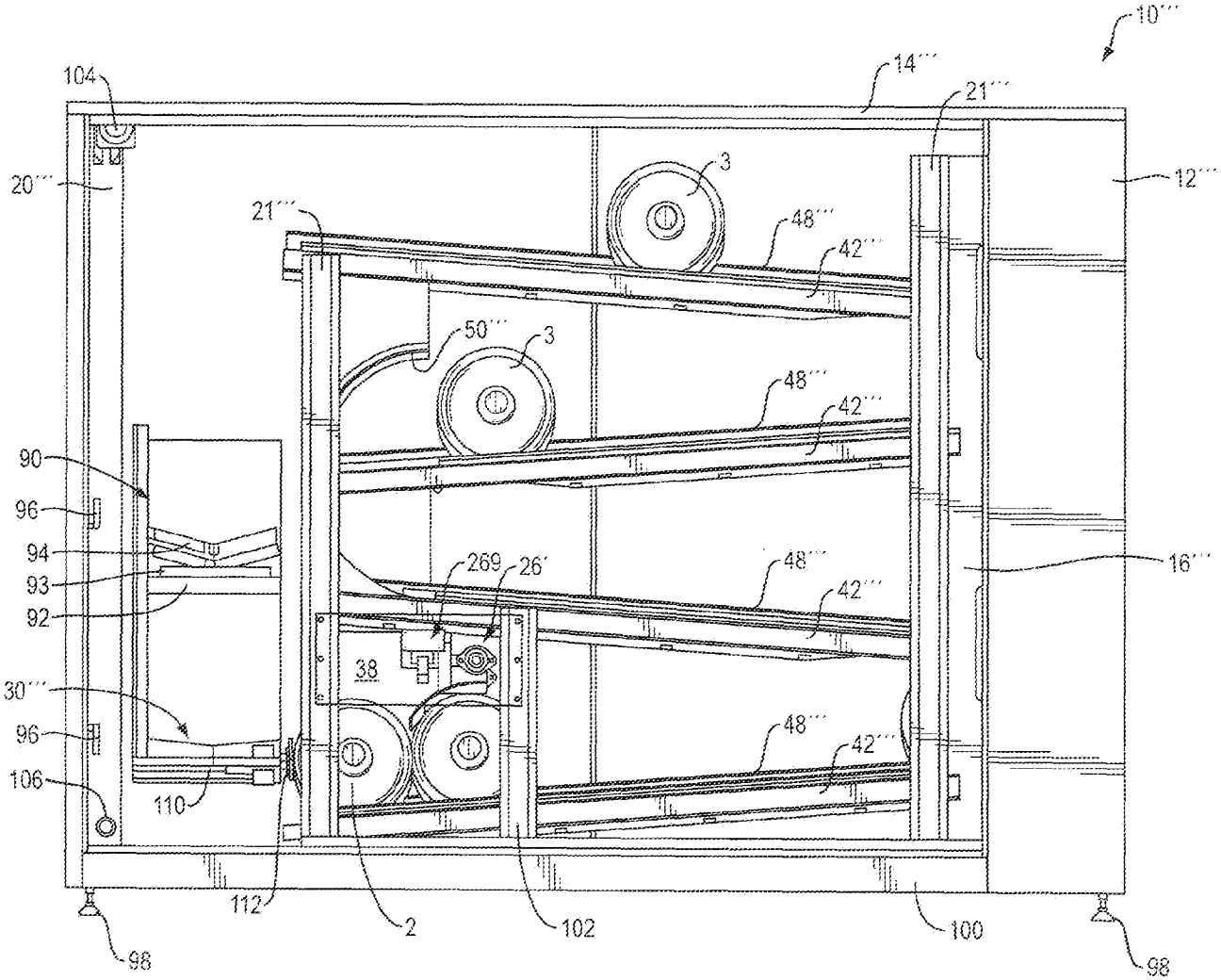
FIG. 39 is a front elevational view of the vending/return apparatus shown in FIG. 34 with the double elevator in a bottom stand-by transitional position with the bottle retrieval arm retracting and controlling bottle movement toward the bottom elevator and with the bottle retention gate in a closed, bottle retention position.
Figure 40:
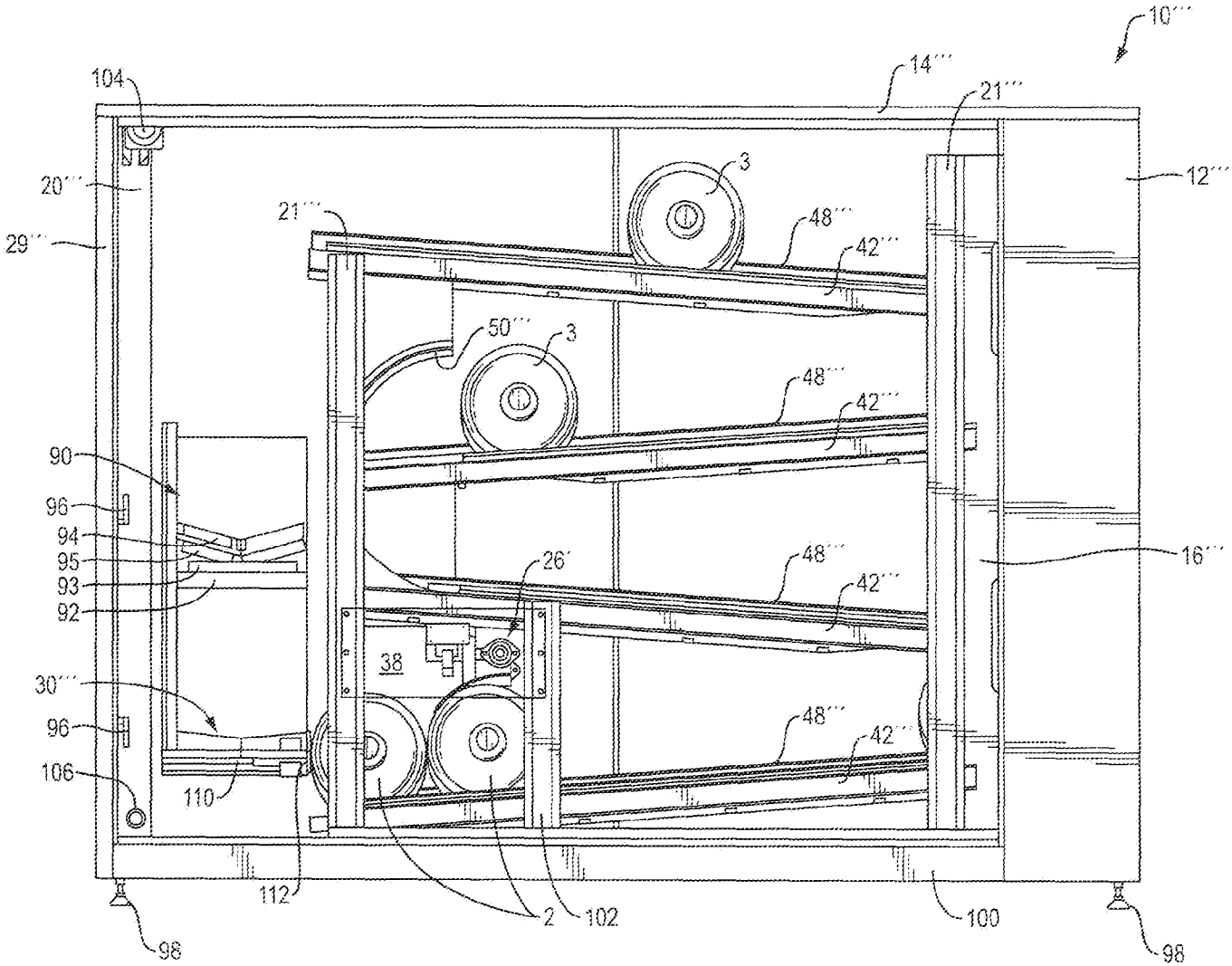
FIG. 40 is a front elevational view of the vending/return apparatus shown in FIG. 34 with the double elevator in a bottom stand-by transitional position with the bottle retrieval arm in a retracted position aligned with an open side edge of the bottom elevator and with the filled bottle registered against the retrieval arm.
Figure 41:
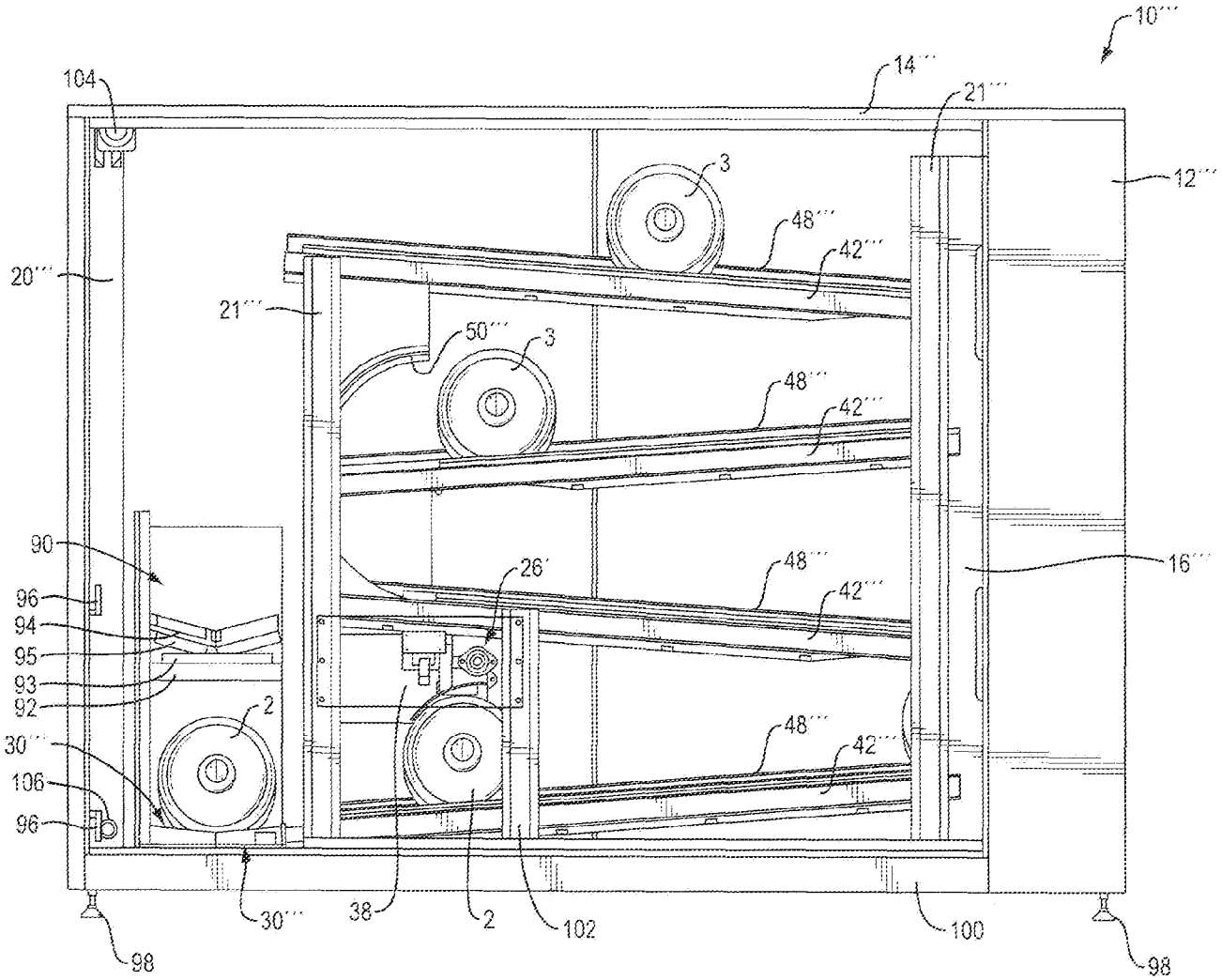
FIG. 41 is a front elevational view of the vending/return apparatus shown in FIG. 34 with the double elevator in a bottom position, the bottle retrieval arm in a fully retracted position and the filled bottle loaded onto the bottom elevator.

Before restrictor arm 114 is retracted, gate assembly 26', now in a down position as the gate's flapper 68' has rotated back down to its bottle restriction position against a leading surface of the new lead-most bottle via gravity or electromechanical assist, is re-locked by activation of motor 84' by the central processor as shown in FIG. 39. Once the new lead-most bottle is properly secured by gate assembly 38''', restrictor arm 114 is incrementally retracted back to its resting position to control the forward travel of the filled bottle 2 toward the elevator. Once registration plate 112 is retracted so as to be substantially in alignment with the vertical plane occupied by the right edge of lower elevator 30''', and while the bottle is still registered against plate 112, elevator assembly 190 is lowered to the lowest, bottle-loading position as shown in FIG. 40. As the elevator is lowered, plate 112 passes below the bottle leading edge, and the right edge of lower elevator 30''' also slides past the bottle leading edge until it passes under the leading edge. When elevator assembly 190 reaches its bottle load position, restrictor arm 114 is in its fully retracted position and filled bottle 2 rolls onto lower elevator 30''' as shown in FIG. 41. The bottle is now ready for elevation to the vend position.

Figure 55:
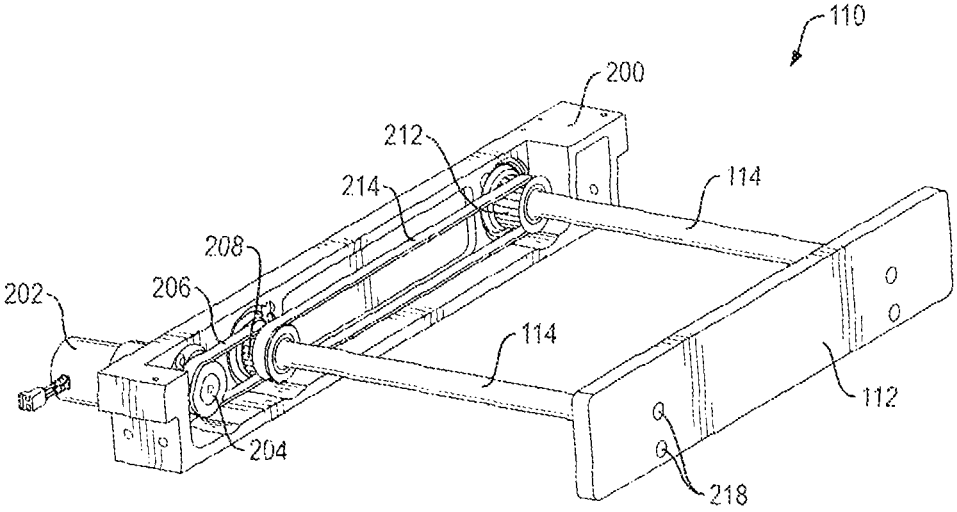
FIG. 55 is a top back perspective view of a bottle retrieval arm according to an embodiment of the disclosure.
Figure 58:
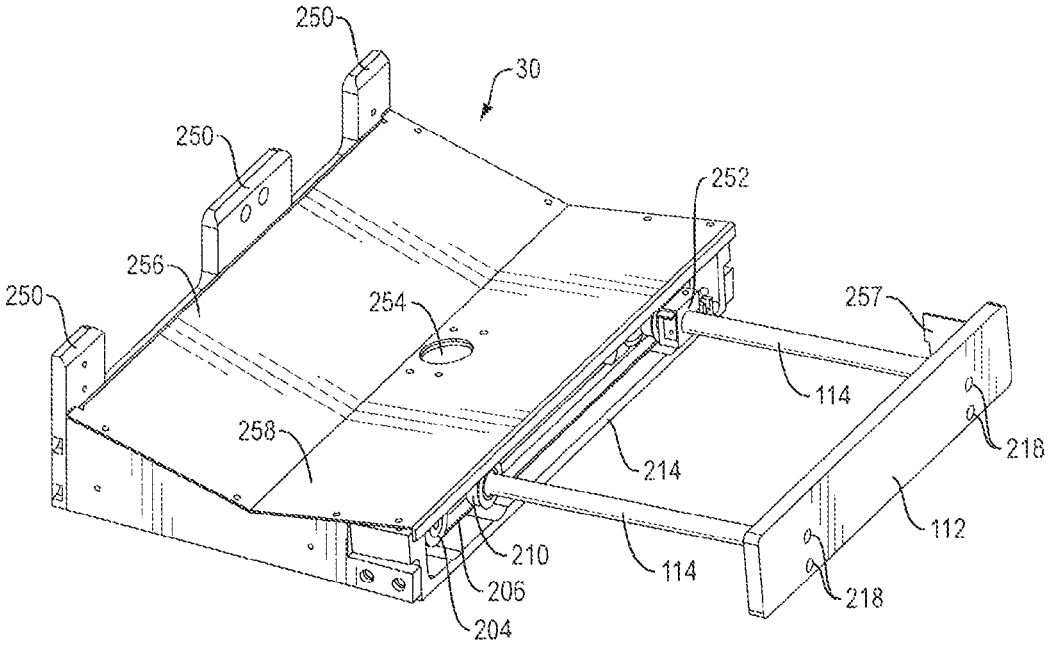
FIG. 58 is a top front perspective view of a vend bottom elevator shelf and bottle retrieval arm according to an embodiment of the disclosure.

As shown in FIG. 55, operation of inertia restrictor 110 is performed by restrictor motor 202. Motor 202 is secured to restrictor frame 200 dimensioned and configured to house the inertia restrictor components. Frame 200 has extensions 250 (as shown in FIG. 58), that provide a means to secure restrictor 110 to elevator housing 191 and/or to the bottom of bottom elevator 30 with mechanical fasteners and the like. A drive wheel 204 with optional gear teeth is secured to the rotating shaft of motor 202 and receives a first belt 206 that may be formed with optional ridges or ribs dimensioned to mechanically engage the optional gear teeth of drive wheel 204 to improve and maximize energy transfer from the motor. The belt is secured over a receiving gear 208 that may be formed with optional gear teeth dimensioned to be complimentary to the ribbed belt.

Receiving gear 208 has a threaded bore secured about a threaded portion of restrictor arm 114 so that rotation of gear 208 causes rotation of restrictor arm 114. A bore formed in frame 200 is configured and dimensioned to permit movement of restrictor arm 114 through the frame. Gear 208 is secured to frame 200 with a bearing assembly to permit free rotation of gear 208.

Second receiving gear 212 is secured to frame 200 in the same manner as gear 208 with the use of a bearing assembly and has a threaded bore to receive twin restrictor arm 114. Gear 212 also has optional gear teeth. A second belt 214 with optional ribs complimentary to the optional gear teeth of gears 208 and 212 causes simultaneous rotation of twin restrictor arms 114 in the same rotational direction. The rotational force received from first belt 206 is transferred to second belt 214 via gear 208 and transferred to gear 212 via belt 214.

The direction plate 112 moves is determined by the direction of rotation of motor 202. The central processor is programmed and configured to send signals to operate motor 202 in either clockwise or counter-clockwise directions to cause the retraction or extension of plate 112. It is within the contemplation of the disclosure to have either rotation direction to cause either a retraction or an extension event that depends upon the clock-wise or counter-clockwise orientation of the helical grooves on the shafts. Plate 112 is secured to arms 114 via mechanical fasteners 218.

It should be understood that other means of controlling the motion of the lead-most bottle are within the contemplation of the disclosure. As one illustrative example, hydraulically or pneumatically operated restrictor arms may be substituted for the belt driven arms disclosed. As a further illustrative example, linear actuators, such as those shown in FIG. 45 may be used in substitution of restrictor 110 with the lead screws oriented substantially parallel with the plane occupied by the bottom of apparatus 10'''. They hydraulic or linear actuator assemblies, and any like assembly, would also be attached to the bottom of dual elevator 190.

Figure 45:
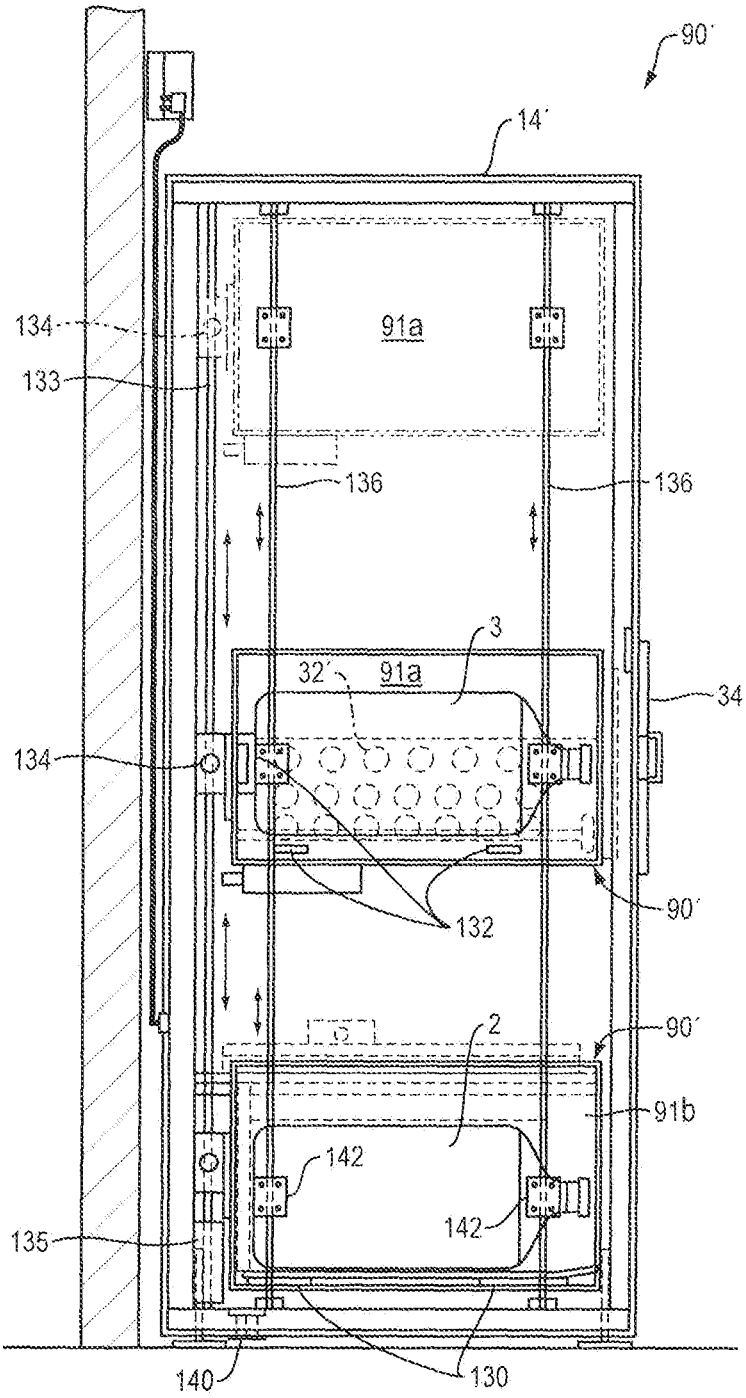
FIG. 45 is a side elevational view in partial phantom of a double elevator according to a yet further embodiment of the disclosure.
Figure 46:
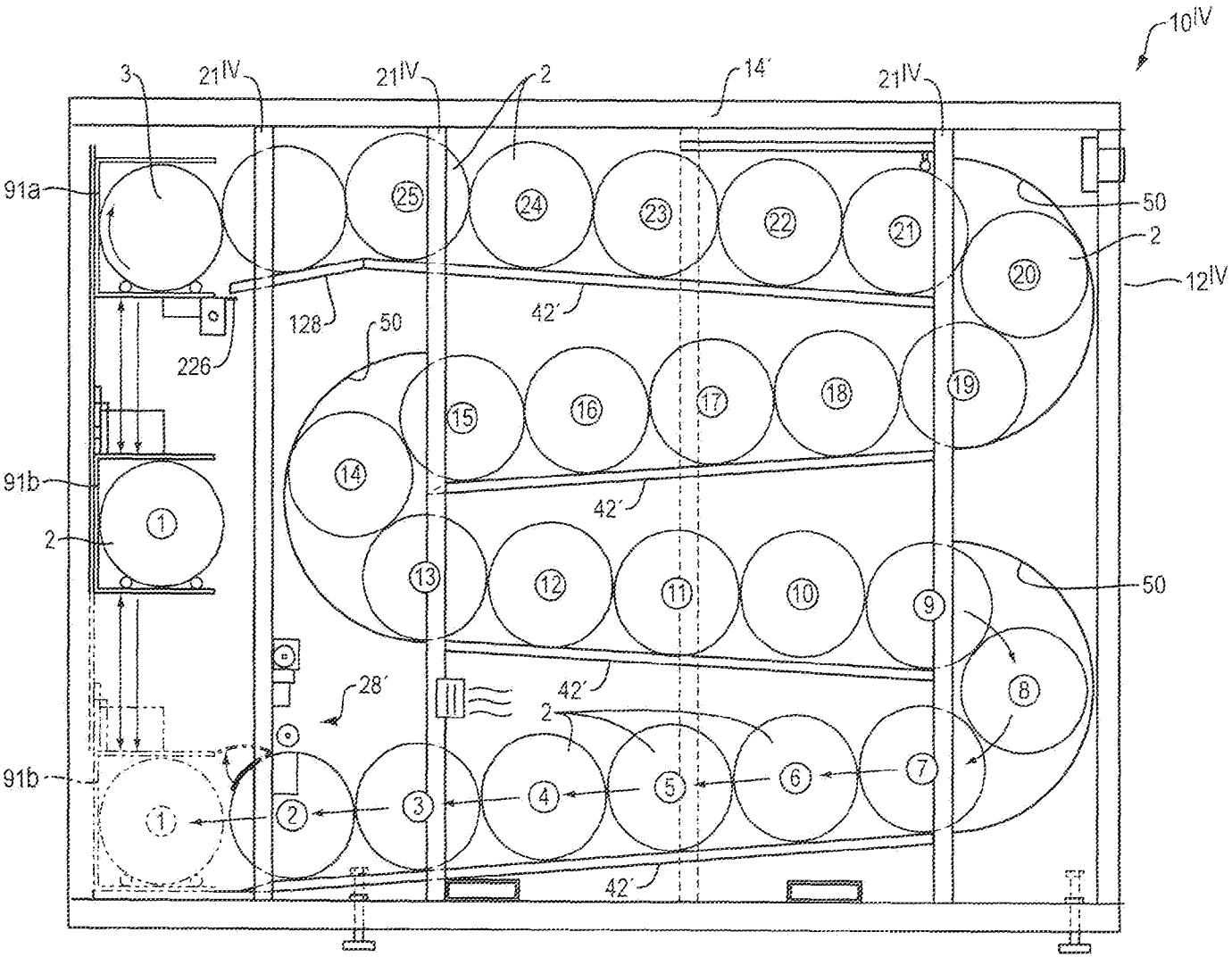
FIG. 46 is a front elevational view in partial phantom of a vending/return apparatus with a double elevator according to the embodiment of the disclosure shown in FIG. 45.

Referring now to FIGS. 45 and 46, in a yet further aspect of the disclosure, a vending apparatus shown generally as 10$^{iv}$ includes a dual elevator 90' with a modified topmost track assembly 42'. In this embodiment, upper elevator 91*a* and lower elevator 91*b* are secured to substantially parallel support guide rails 136 via anchors 142. The anchors are configured and dimensioned to allow elevator movement along rails 136. Bottle cradle 32' is secured in top elevator 91*a* and functions to rotate upwardly and deposit resident empty bottle 2 onto topmost track assembly ramp 128.

An actuator motor 135 is secured to elevator lead screw 133. Double plate slide assemblies 134 secure the elevators to lead screw 133. Operation of motor 135 turns lead screw 133 to cause elevator translation along the lead screw. Sensors 130 and 132 detect the presence of filled bottles and empty bottles, respectively. A sensor commonly known as a sniffer sensor, e.g., a VOC (volatile organic compound) gas detector, may also be incorporated into the top elevator to sense the presence of volatiles or other unwanted substances on return bottles. The VOC gas detector by Spectrex (Redwood City, Calif.) is an example of a suitable sniffer sensor. The system prompts the customer to remove the bottle from the top elevator if an unwanted substance is detected.

The apparatus also includes an optional video screen configured to display vendor-specific and/or third-party advertisements on the vending apparatus as well as a voice instruction system operating from the instructions from the processor. The video screen can display pre-recorded messages stored on a resident or remote server, or may display live feeds from a remote source. The apparatus may be configured to permit wireless updates to the advertisement messages. The video screen may be secured in a dedicated frame, or secured topically to the apparatus exterior. The machine can also be configured to receive new 2D smartphone technology connection with third party vendors for special cross-promotion.

Figure 68A:
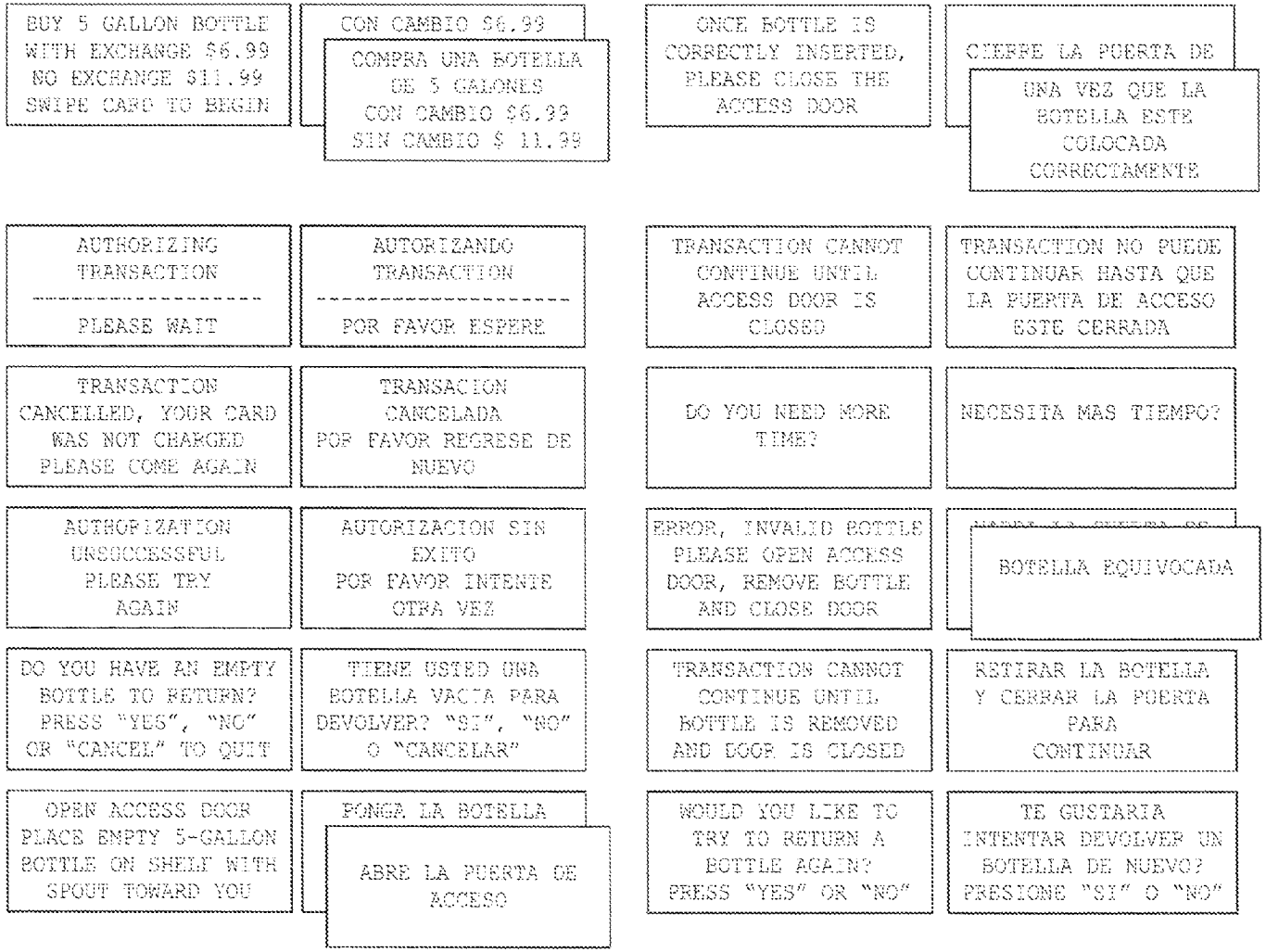
FIG. 68 A shows a series of vending apparatus screen displays in English and Spanish according to an embodiment of the disclosure.
Figure 68B:
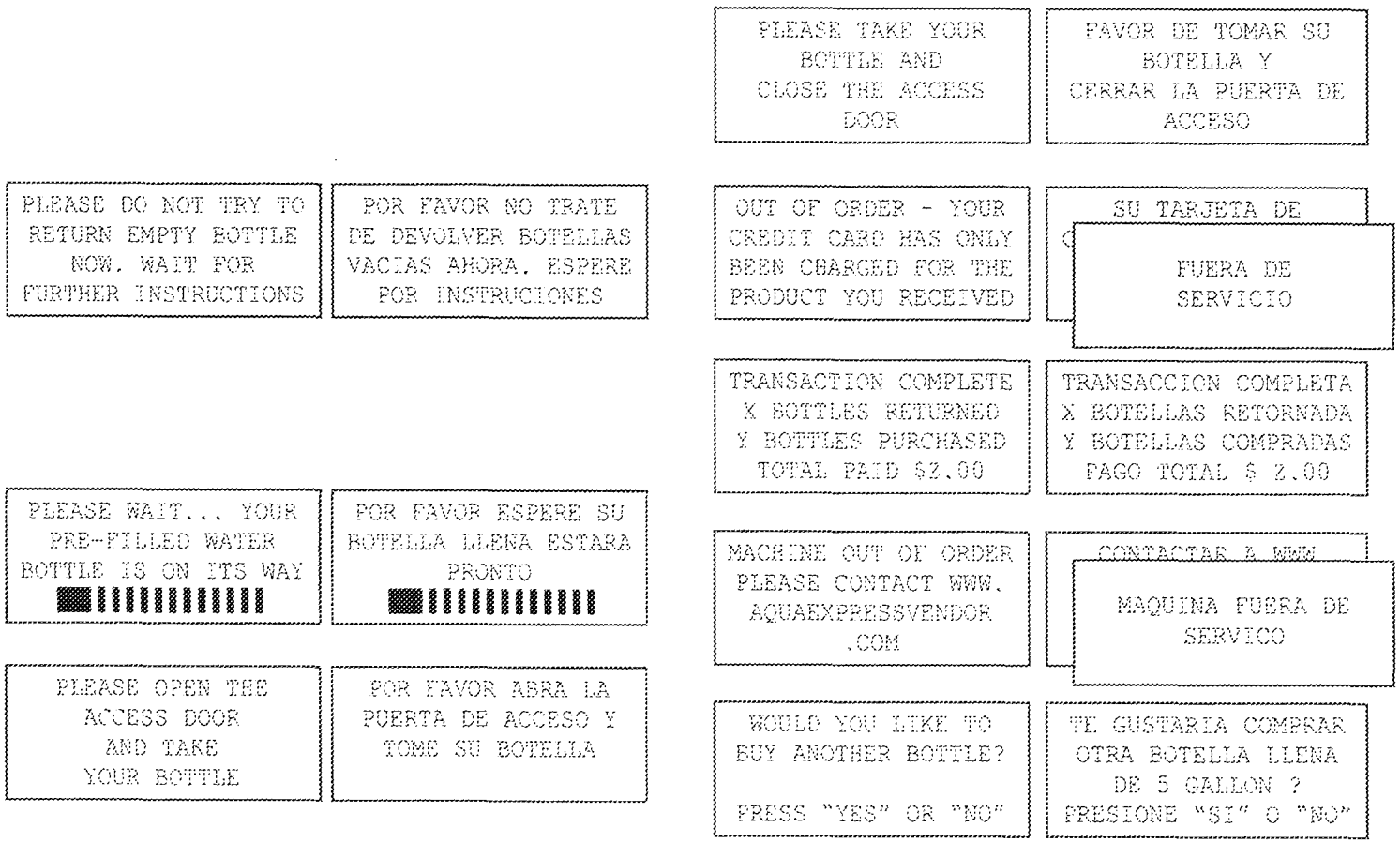
Figure 68C:
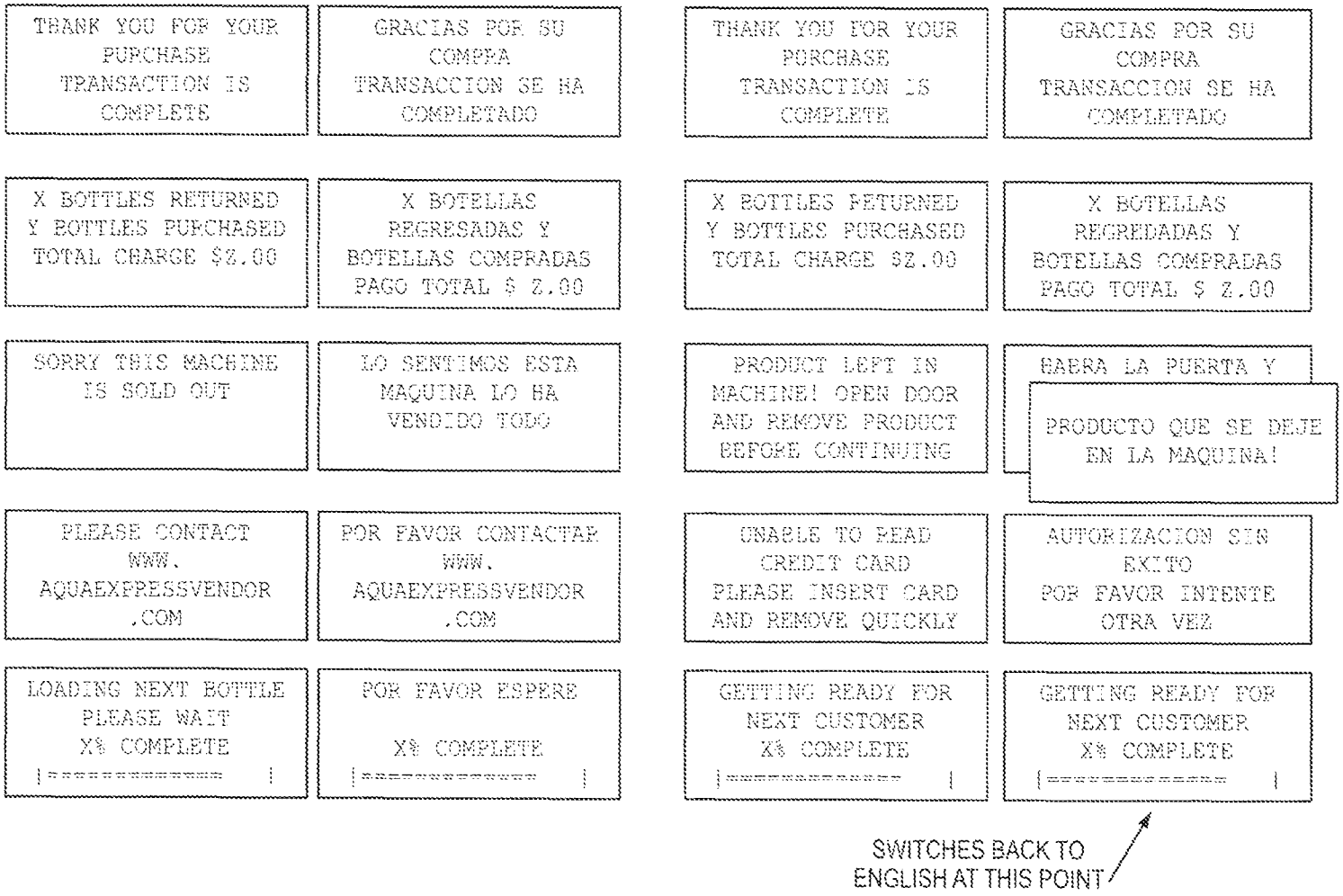
Figure 69A:
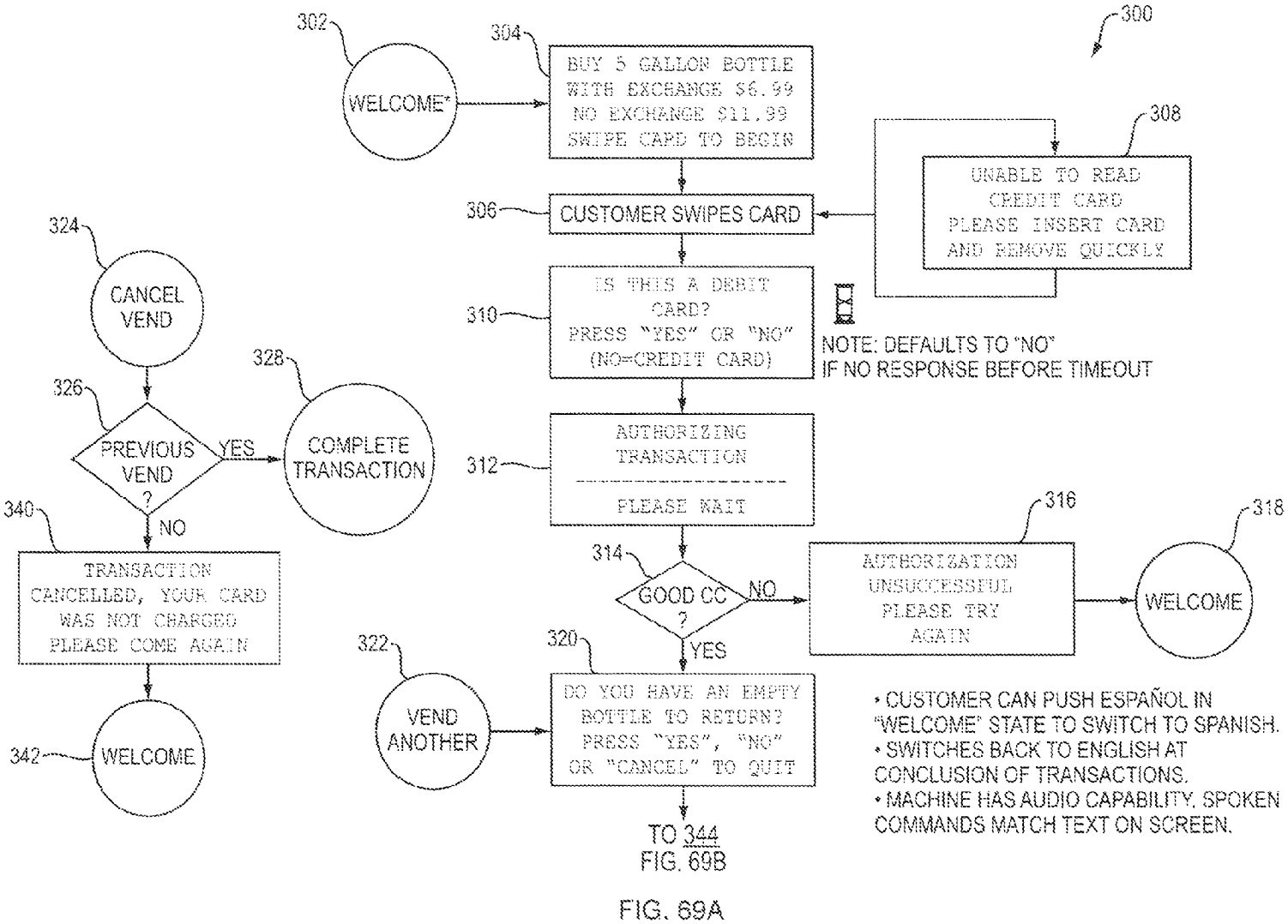
FIG. 69 A is a vending apparatus bottle vend and return bottle system flow chart according to an embodiment of the disclosure.
FIG. 69E is a continuation of the flow chart shown in FIG. 69 D.
Figure 69B:
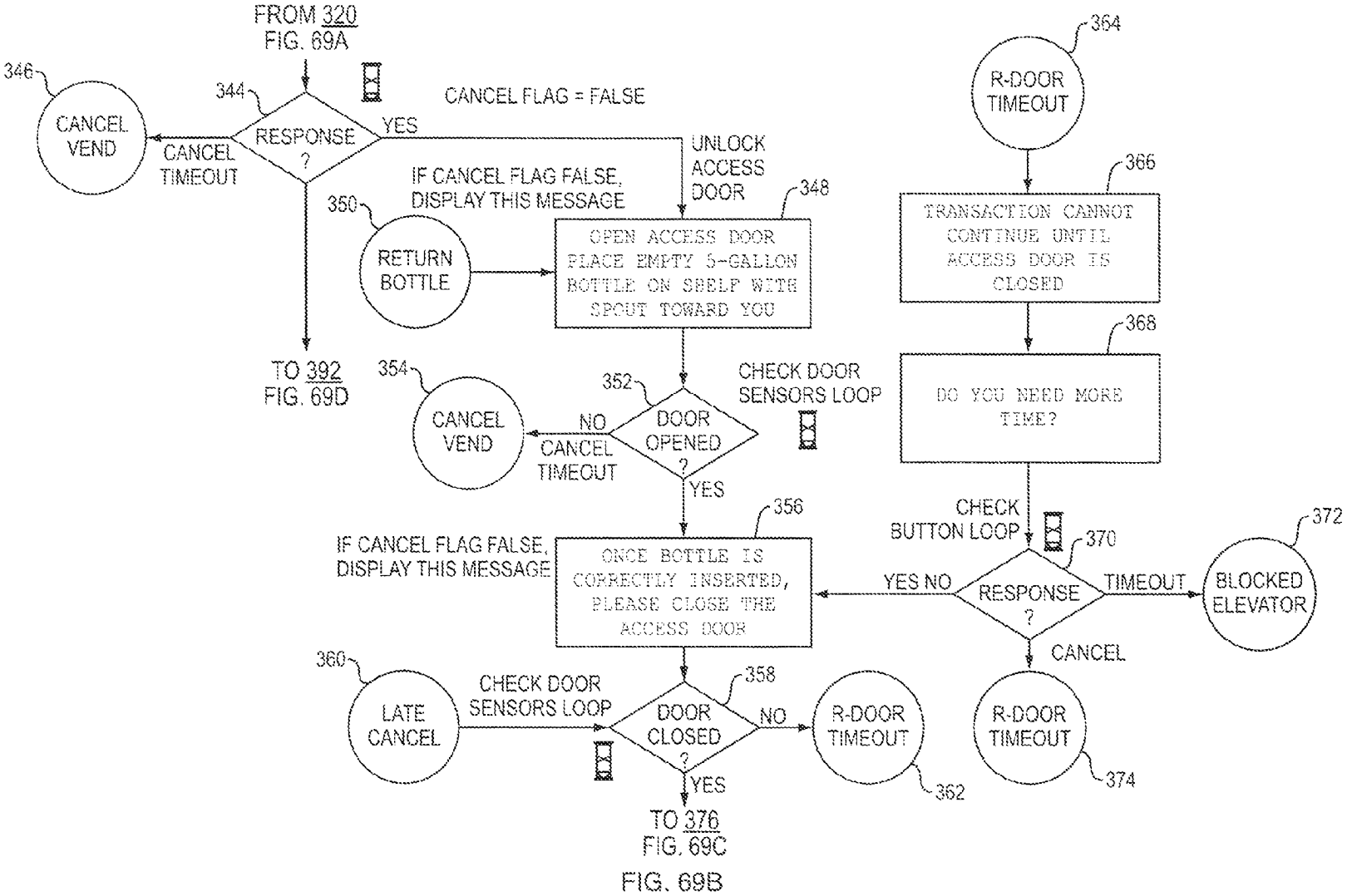
Figure 69C:
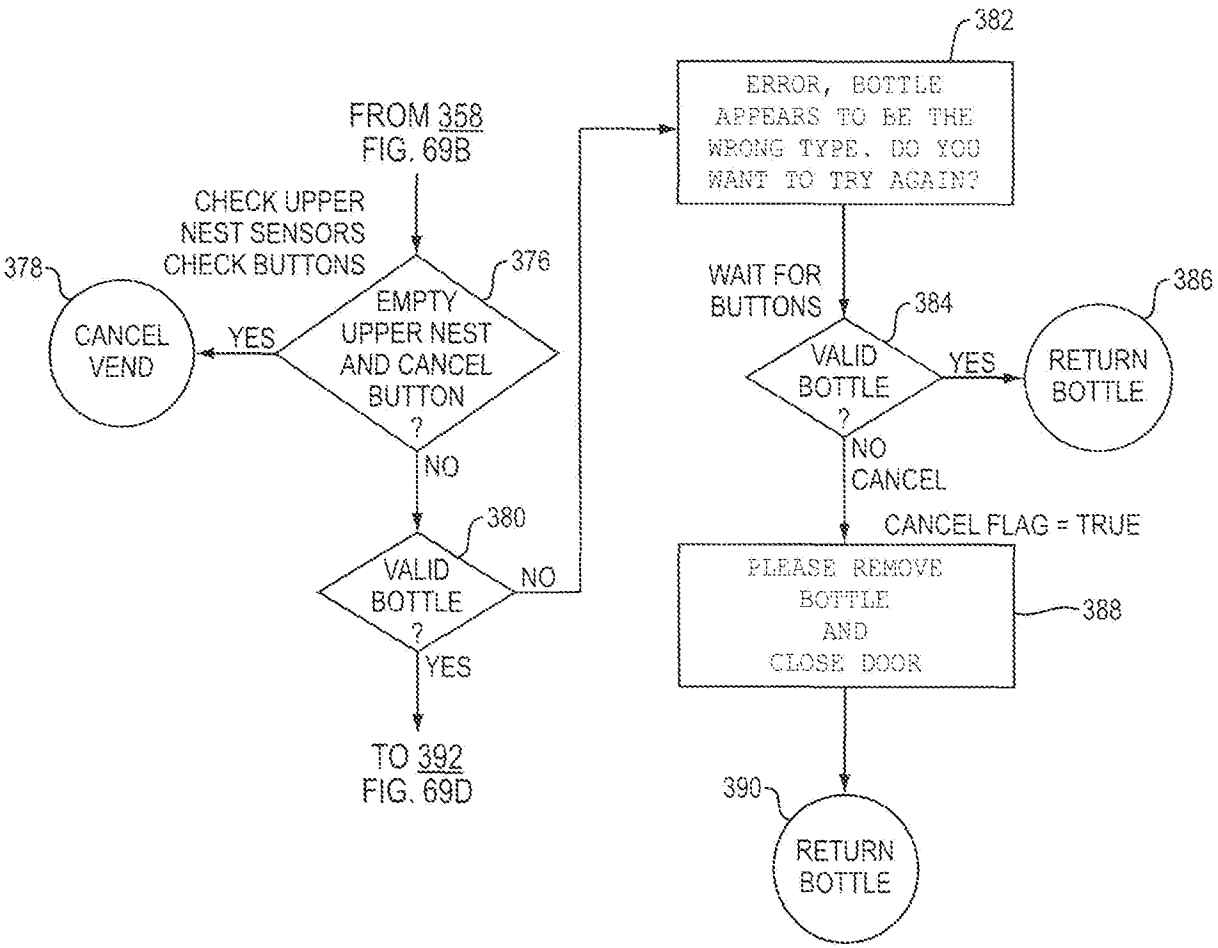
Figure 69D:
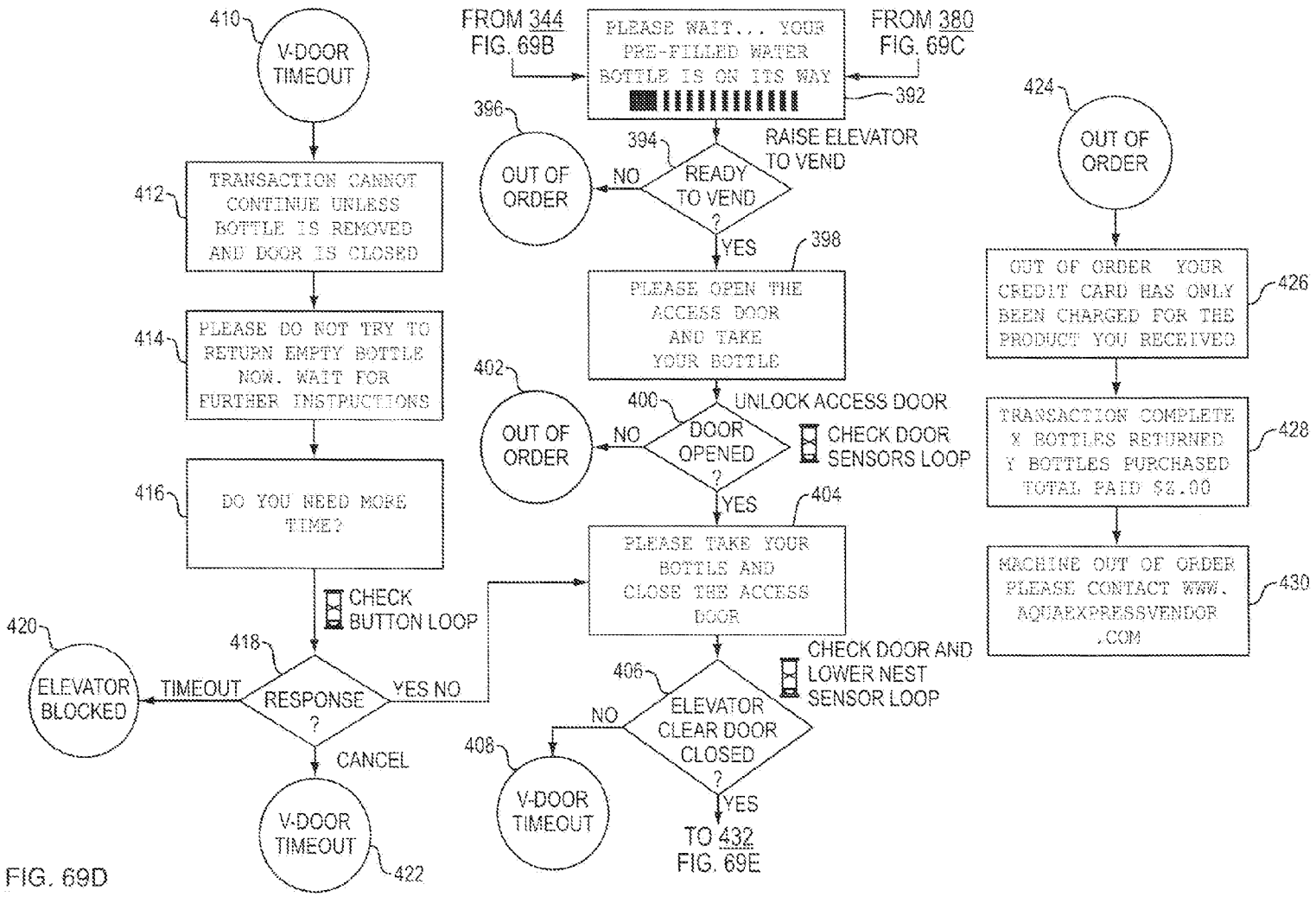
Figure 69E:
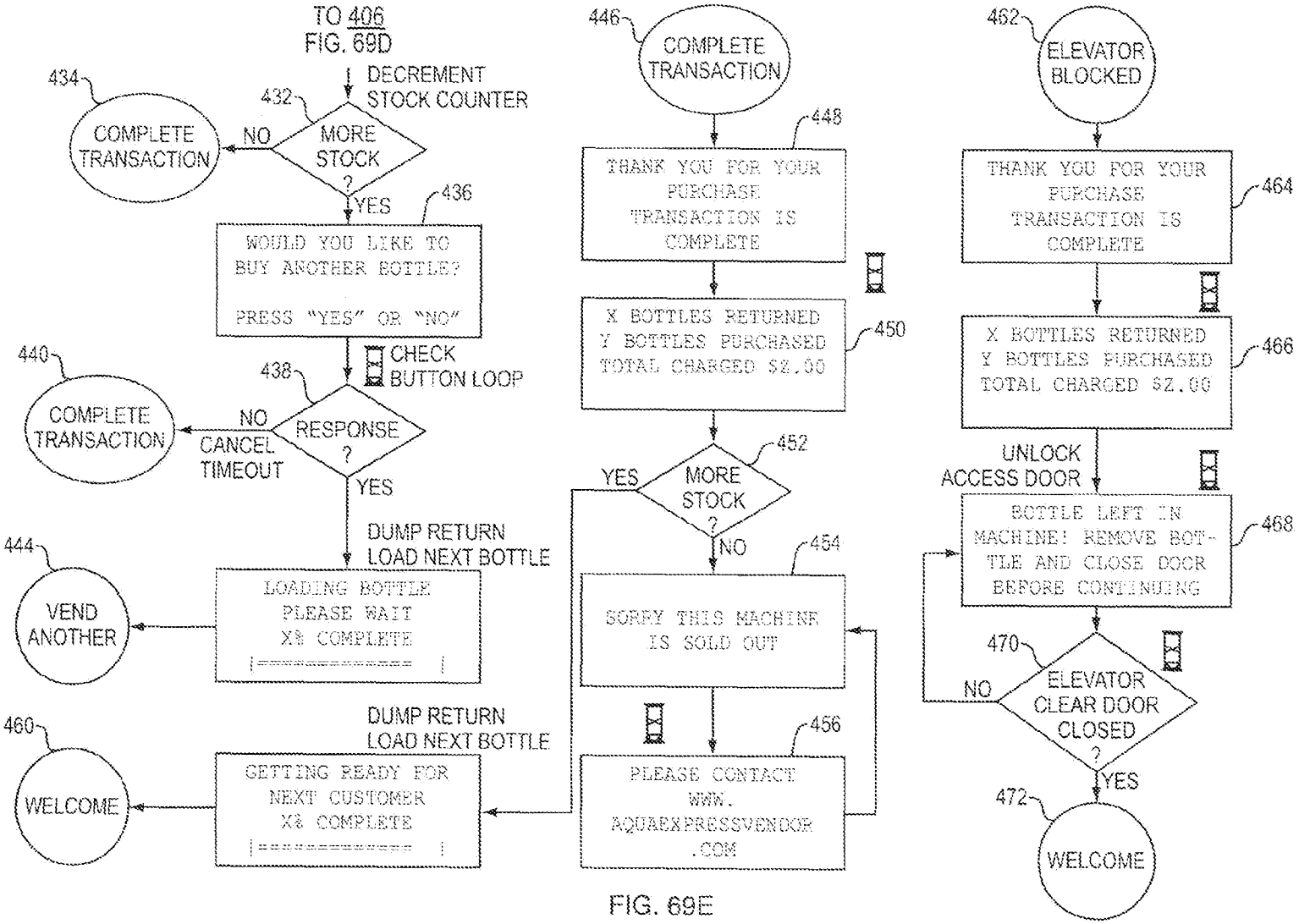

In another aspect of the disclosure as shown in FIGS. 69A-69E, a bottle vending application is shown generally as 300. The application begins with the customer messages displayed on apparatus control panel 36. FIGS. 68A and 68B show screen shots of typical messages that may be displayed on screen 70. The customer is greeted with an optional "Welcome" message 302 and a message informing the customer about the costs of a bottle transaction and how to initiate a transaction at step 304. The message may be displayed in a fixed sign secured to the apparatus, or may be displayed on screen 70. A transaction begins with the customer swiping a credit, debit and/or pre-paid water card through card reader 72 at step 306. If the reader cannot read the card due to improper alignment of the card, worn magnetic strip, etc., the customer is informed and requested to try again at step 308. The system may be configured to allow for a predetermined number of tries to have the card read before the system declines to read the card and carry out a transaction.

The application may then prompt the customer to identify whether the card being used is a debit card at step 310. The "yes" 78 and "no" 80 controls are used to make the requested selection. If no answer is given, a predetermined timeout may be implemented with a "no" default position. With or without an answer to the debit card request, the application implements a transaction authorizing step 312 with an optional "please wait" prompt on screen 70. As one of the initial steps, the application requests data about whether the credit card/debit card is good at step 314. If the credit card information comes back as being bad, the application prompts the customer that the authorization was unsuccessful and prompts the customer to try again at step 316. The customer may be prompted with another "welcome" message at step 318. It should be noted the customer can activate the "Espanol" key at the welcome screen. The application may be set to default back to English at the conclusion of a transaction. It should be further noted the apparatus may be constructed with audio commands that correspond in content and timing with the visual commands and instructions shown on screen 70.

If the transaction authorization returns a positive result for the credit card, the application prompts the customer to indicate if he or she has a return bottle at step 320 along with an optional prompt to cancel the transaction. If the customer has one or more additional return bottles, the customer can have a return transaction performed for the additional return bottles by selecting vend another (bottle) at step 322. If the customer wishes to cancel a transaction, the customer may initiate a cancel transaction function by pressing cancel button 76 at step 324. The application then may cancel the transaction, or prompt the customer to indicate if the cancel request is related to the previous vend at step 326. If the customer selects "yes" the transaction is completed at step 328. If "no" is selected, a transaction cancel prompt is displayed on screen 70 at step 340. Thereafter, the application returns to the "welcome" screen at step 342.

If the customer fails to make any selection, the application may be programmed with a preselected cancel timeout time period that results in the transaction being canceled at step 346. If the customer answers "no," the application proceeds to step 392 as disclosed more fully below. If the customer responds with "yes" at step 344 before the cancel timeout period expires, the application sends a signal to electronically controlled lock 500 (shown in FIG. 75) to unlock door 34. The customer is prompted to open door 34 and to place the return bottle on upper elevator 192 at step 348, the placement of the bottle taking place at step 350. If the customer fails to open the door (determined by the application by checking a door sensors loop) within a predetermined cancel timeout time frame at step 352, the application cancels the transaction at step 354.

If the customer opens the door at step 352 and places a bottle in the correct orientation on elevator 192, the application next prompts the customer to close the door at step 356. The application checks for door closure by checking the door sensors loop again at step 358. If the door is not closed within a predetermined door close time frame, the application initiates a return door timeout at step 362. The application may also inform the customer that the transaction cannot be continued without the door closed at step 366. The customer may also be asked if more time is needed at step 368. If the customer answers yes or no at step 370, the customer is again prompted to close the door. If the door is not closed after a predetermined time, the transaction is canceled at step 360. If the door is closed, the application proceeds to step 376. If the customer does not respond to the request for more time at step 370, the application blocks the elevator operation at step 372.

At step 376, the application checks the upper elevator sensors to ascertain if the upper elevator is empty. If the upper elevator is empty, the application cancels the vend transaction as step 378. If a bottle is present and the query answer is no, the application analyzes the sensor input to determine if the bottle meets the vendor's criteria for being a valid bottle at step 380. If yes, the application proceeds to step 392 disclosed below. If the bottle is not valid, the application prompts the customer that the bottle is not valid at step 382 and queries the customer if another try is desired. If the customer replies "yes" at step 384, the return bottle is sensed and characterized again at step 386. If the customer responds "no," the customer is prompted to remove the bottle and close the door at step 388. The bottle is removed at step 390.

With or without a vendor-approved return bottle, the application via the processor/controller sends a signal to the elevator motor to move the elevator from a down position to a vend position. The customer may be prompted with a notice that the filled bottle is on the way at step 392. Once the elevator reaches its vend position, the application determines if the elevator is in the proper vend position at step 394. If the elevator is not in the proper position, an "out of order" notice is displayed on screen 70 at step 396. If the elevator is in the proper vend position, the customer is notified to open the door and take the filled bottle at step 398. Substantially simultaneously, or shortly after the customer notice, the processor sends a signal to the door lock to unlock the door. The application monitors via sensors the door open position at step 400. If the door does not open, an "out of order" indication is made on screen 70 at step 402.

In an out-of-order condition, the customer is informed about the condition and that any credit card transaction has been limited to any product received at step 426. The application then will display on screen 70 a message that the transaction is complete along with information about the number of bottles returned, bottles purchased and the total purchase price at step 428. The application may then re-indicate the out-of-order condition and instruct the customer to contact the vendor at step 430.

If the door does open at step 400, a notice is displayed on screen 70 to take the bottle and close door 34 at step 404. The application then determines if lower elevator 30 is clear and the door closed at step 406. If the elevator is not cleared or the door not closed, the application enters a vendor door timeout sequence at step 408. If either or both conditions occur, the application prompts the customer with a screen display that the transaction cannot continue unless the bottle is removed and the door is closed at step 412. The application further instructs the customer to not attempt to return a bottle at this point and to wait for further instructions at step 414. An additional time needed prompt may also be given visually via screen 70 and/or audibly with a sound emitting device at step 416. If no response is given at step 418 within a predetermined time period, the transaction is timed out and an elevator block condition is set at step 420.

If the block condition is set, the customer is prompted with a thank you and a notification the transaction is complete at step 464. The application may next inform the customer of the number of bottles returned and the number of bottles purchased along with a total charge via a screen display at step 466. If a bottle is still detected on the vending, lower elevator 30, the customer is again instructed that a bottle is left in the machine and to remove the bottle and close the door before continuing at step 468. The application next determines via sensing if the elevator is clear and the door is closed at step 470. If either condition is in the negative, the application loops back and instructs the customer to remove the resident bottle and/or close the door. If the bottle is removed and the door is properly closed, the application loops back to the welcome screen at step 472 to prepare for the next transaction. Substantially simultaneously or shortly after the door is closed, the processor sends a signal to activate motor 126 to return the elevator assembly to the start position to receive the next filled bottle for vending. A signal is also sent to engage lock 500.

Returning to step 418, if the customer selects either the "yes" or "no" responses, the customer is instructed to take the filled bottle and close the access door at step 404. If the customer selects the cancel option, the vend door timeout condition is reset at step 422. If a bottle is removed and the door is closed at step 404, the application determines if the elevator is clear and the door is closed via the door and elevator sensors. If either condition is not met, the application returns to the vend door timeout loop at step 408. If both conditions are met, the application advances to step 432. In moving to step 432, the application receives stock supply information from a decrement stock counter. If no, or a predetermined insufficient number of, bottles are present, the application sends a message to the vendor to refill the apparatus. If no additional filled bottles are present, the application completes the transaction at step 434. If more stock is present, the customer is asked if another bottle purchase is desired at step 436. If the customer chooses "no" at step 436, the transaction is completed at step 440. If the customer fails to answer within a predetermined time-out period, the application also goes to the complete transaction step 440.

If the customer answers "yes," the controller sends a signal to activate motor 126 to raise the next filled bottle and to deliver any resident empty bottle to the top track assembly. The application may inform the customer of the filled bottle's progress with a screen display of the percentage of completion at step 442. Once complete, the application may query the customer if another bottle is desired at step 444.

In a transaction complete status at either steps 434 or 440, the application displays a message on screen 70 thanking the customer and indicates the transaction is complete at step 448. The application next displays a message confirming the number of bottles returned and purchased and the total charge at step 450.

The application next runs a stock check at step 452. If no stock is left, the application informs the customer the apparatus is sold out at step 454. The customer may next be prompted to contact the vendor due to the sold out condition at step 456. The application may loop back and re-display the sold out notice at step 454.

If additional stock is present at step 452, the controller sends a signal to motor 126 to move the elevator to unload any empty resident bottle and to return to the start position to receive the next filled bottle to prepare for the next transaction at step 458. Once the apparatus is ready for the next vend transaction, the application returns to the welcome screen at step 460.

While the present disclosure has been described in connection with one or more embodiments thereof, it will be apparent to those skilled in the art that many changes and modifications may be made without departing from the true spirit and scope of the disclosure. Accordingly, it is intended by the appended claims to cover all such changes and modifications as come within the true spirit and scope of the disclosure.

We claim:

1. A combination bottle vending/return apparatus comprising:

an enclosure with at least one access door or panel;

at least two stacked counter-sloped track assemblies secured in the enclosure and configured to support and deliver fluid-filled bottles;

a dual elevator subassembly comprising a lower elevator configured to receive filled bottles from a lower track assembly of the at least two track assemblies and an upper elevator configured to receive empty bottles returned by customers and to deposit the empty bottles on an upper track assembly of the at least two track assemblies;

a customer transaction panel configured to permit customer-initiated bottle vend and/or return transactions; and, a processor connected to the interface panel to send and receive signals to and from the interface panel and connected to a credit/debit/pre-paid card processor.

2. The apparatus of claim 1 wherein the at least one of the at least two track assemblies is oriented in the enclosure to slope downwardly from one side of the apparatus to a opposite side and to slope downwardly from a front to a back of the apparatus.

3. The apparatus of claim 2 wherein the slopes are from about 1° to about 20°.

4. The apparatus of claim 1 wherein the slopes are from about 6° to about 8°.

5. The apparatus of claim 4 wherein the lower elevator further comprises a filled bottle inertia restrictor configured to ease filled bottles onto the lower elevator.

6. The apparatus of claim 5 wherein the inertia restrictor comprises a bottle registration plate configured to register against filled bottles and further comprising at least one restrictor arm a first end of which is secured a restrictor plate.

7. The apparatus of claim 6 wherein the inertia restrictor further comprises an inertia restrictor motor and belt assembly secured to the lower elevator wherein the belt assembly engages a second end of the at least one restrictor arm to extend and retract the registration plate.

8. The apparatus of claim 7 further comprising a gate assembly secured to the apparatus at an end of the lower track assembly and proximal to the dual elevator wherein the gate assembly is configured to arrest movement of filled bottles on the lower track assembly.

9. The apparatus of claim 8 wherein the gate assembly comprises a flapper secured to a flapper rod wherein the flapper engages a lead-most filled water bottle on the lower track assembly.

10. The apparatus of claim 9 wherein the gate assembly further comprises a flapper motor and a flapper locking wheel assembly wherein the flapper locking wheel assembly is secured to a shaft of the flapper motor wherein operation of the flapper motor moves the flapper locking wheel assembly along the motor shaft to arrest rotational movement of the flapper when the flapper locking wheel assembly is in one position on the motor shaft and to permit rotational movement of the flapper when the flapper locking wheel assembly is in a second position on the motor shaft.

11. The apparatus of claim 10 wherein the upper elevator comprises a return bottle support surface comprising a fixed segment and a hinged ramp segment secured to the fixed segment via a hinge, wherein the ramp hinged segment forms a "v" shape in cross-section in combination with the fixed segment to provide a nesting surface for an empty bottle.

12. The apparatus of claim 11 wherein the upper elevator further comprises at least one spring loaded trip tab wherein the trip tab is configured to engage a leading edge of the at least one track assembly when the elevator is moved to an upward, empty bottle delivery position, and wherein engagement of the trip tab permits the hinged ramp segment to pivot downwardly so as to form a ramp with the fixed segment to facilitate empty bottle movement off the elevator.

13. A combination bottle vending/return apparatus comprising:

an enclosure with at least one access door or panel;

a plurality of stacked and counter-sloped track assemblies secured in the enclosure and configured to support and deliver fluid-filled bottles, wherein each track assembly of the plurality of track assemblies has a first end and a second end;

at least one bottle direction transition curve secured to the track assemblies wherein a first end of the transition curve is secured to a second end of an upper track assembly of the plurality of track assemblies and a second end of the transition curve is secured to a first end of a track assembly positioned below the upper track assembly;

a dual elevator subassembly comprising a lower elevator configured to receive filled bottles from the at least one track assembly and an upper elevator configured to receive empty bottles returned by customers and deposit the empty bottles on at least one of the plurality of track assemblies;

a customer transaction panel configured to permit customer-initiated bottle vend and/or return transactions; and, a processor connected to the interface panel to send and receive signals to and from the interface panel and connected to a credit/debit/pre-paid card processor.

14. The apparatus of claim 13 wherein the plurality of stacked track assemblies are sloped in alternating directions with an upper track assembly sloped downwardly from one side of the apparatus to a second side of the apparatus, a second track assembly of the plurality of track assemblies positioned under the upper track assembly and sloped in a direction opposite the direction of slope of the upper track assembly and wherein any additional track assemblies of the plurality of track assemblies continue to be sloped in an alternating pattern.

15. The apparatus of claim 14 wherein each track assembly of the plurality of track assembly has a secondary slope from a front to a back of the apparatus.

16. The apparatus of claim 15 wherein the secondary slope is from about 1° to about 20°.

17. The apparatus of claim 15 wherein the secondary slope is from about 6° to about 8°.

18. The apparatus of claim 17 wherein the lower elevator further comprises a filled bottle inertia restrictor configured to ease filled bottles onto the lower elevator.

19. The apparatus of claim 18 wherein the inertia restrictor comprises a bottle registration plate configured to register against filled bottles and further comprising at least one restrictor arm a first end of which is secured to a restrictor plate.

20. The apparatus of claim 19 wherein the inertia restrictor further comprises an inertia restrictor motor and belt assembly secured to the lower elevator wherein the belt assembly engages a second end of the at least one restrictor arm to extend and retract the registration plate.

21. The apparatus of claim 20 further comprising a gate assembly secured to the apparatus at the end of the at least one track assembly and proximal to the dual elevator wherein the gate assembly is configured to arrest movement of filled bottles on the plurality of track assemblies.

22. The apparatus of claim 21 wherein the gate assembly comprises a flapper secured to a flapper rod wherein the flapper engages a lead-most filled water bottle on lowest track assembly of the plurality of track assemblies.

23. The apparatus of claim 22 wherein the gate assembly further comprises a flapper motor and a flapper locking wheel assembly wherein the flapper locking wheel assembly is secured to a shaft of the flapper motor wherein operation of the flapper motor moves the flapper locking wheel assembly along the motor shaft to arrest rotational movement of the flapper when the flapper locking wheel assembly is in one position on the motor shaft and to permit rotational movement of the flapper when the flapper locking wheel assembly is in a second position on the motor shaft.

24. The apparatus of claim 23 wherein the upper elevator comprises a return bottle support surface comprising a fixed segment and a hinged ramp segment secured to the fixed segment via a hinge, wherein the hinged ramp segment forms a "v" shape in cross-section in combination with the fixed segment to provide a nesting surface for an empty bottle.

25. The apparatus of claim 24 wherein the upper elevator further comprises at least one spring loaded trip tab wherein the trip tab is configured to engage a leading edge of the at least one track assembly when the elevator is moved to an upward, empty bottle delivery position, and wherein engagement of the trip tab permits the hinged ramp segment to pivot downwardly so as to form a ramp with the fixed segment to facilitate empty bottle movement off the elevator.

26. The apparatus of claim 25 further comprising a dual gate assembly secured to the apparatus at the end of the a lowest track assembly and proximal to the dual elevator wherein the dual gate assembly is configured to arrest movement of filled bottles on the lowest track assembly and to control release of a lead-most bottle onto the bottom elevator.

27. The apparatus of claim 21 wherein a dual gate assembly comprises a first gate assembly configured to arrest movement of a lead-most filled bottle and a second gate assembly configured to arrest movement of the remaining filled bottles, wherein the second gate assembly controls movement of a second gate position filled bottle to the first gate assembly.

28. The apparatus of claim 27 wherein the first gate assembly has a first flapper secured to a first flapper rod wherein the first flapper engages a lead-most filled water bottle on the plurality of track assemblies.

29. The apparatus of claim 28 wherein the second gate assembly has a second flapper secured to a second flapper rod wherein the second flapper engages the filled bottle proximal to the lead-most filled water bottle on the plurality of track assemblies.

30. The apparatus of claim 28 wherein the dual gate assembly further comprises a flapper motor and a flapper locking wheel assembly wherein the flapper locking wheel assembly is secured to a shaft of the flapper motor wherein operation of the flapper motor moves the flapper locking wheel assembly along the motor shaft to arrest rotational movement of the flapper when the flapper locking wheel assembly is in one position on the motor shaft and to permit rotational movement of the flapper when the flapper locking wheel assembly is in a second position on the shaft.

31. The apparatus of claim 23 wherein the upper elevator comprises a return bottle support surface comprising a fixed segment and a hinged ramp segment secured to the fixed segment via a hinge, wherein the hinged ramp segment forms a "v" shape in cross-section in combination with the fixed segment to provide a nesting surface for an empty bottle.

32. The apparatus of claim 24 wherein the upper elevator further comprises at least one spring loaded trip tab wherein the trip tab is configured to engage a leading edge of the at least one track assembly when the elevator is moved to an upward, empty bottle delivery position, and wherein engagement of the trip tab permits the hinged ramp segment to pivot downwardly so as to form a ramp with the fixed segment to facilitate empty bottle movement off the elevator.

33. The apparatus of claim 5 further comprising a vend door secured to a front wall so as to align with either elevator in bottle return or bottle vend positions.

34. The apparatus of claim 13 further comprising a vend door secured to a front wall so as to align with either elevator in bottle return or bottle vend positions.

35. The apparatus of claim 34 further comprising at least two sensors secured in the enclosure in proximity to a return conveyor, wherein the sensors are configured to detect the presence of a valid return bottle, and wherein the sensors are connected to the processor wherein the sensor(s) sends signals to, and receives signals from the processor and either rejects or accepts a return bottle as valid or invalid.

36. The apparatus of claim 13 further comprising a temperature-controlled heating unit secured in the enclosure to heat the enclosure.

37. The apparatus of claim 13 further comprising a temperature-controlled cooling unit secured in the enclosure to cool the enclosure.

38. The apparatus of claim 37 further comprising a plurality of sensors secured in the enclosure in proximity to a vend door, wherein a second sensor is configured to detect a presence of a filled bottle positioned to removal from the apparatus, wherein the sensors send signals to, and receives signals from, the processor.

39. The apparatus of claim 38 further comprising a sniffer sensor secured in the enclosure in proximity to the vend door, wherein a sniffer sensor is configured to detect a presence of unwanted volatiles and chemicals on a deposited empty bottle.

* * * * *